US011384298B2

(12) United States Patent
Koseoglu

(10) Patent No.: US 11,384,298 B2
(45) Date of Patent: Jul. 12, 2022

(54) INTEGRATED PROCESS AND SYSTEM FOR TREATMENT OF HYDROCARBON FEEDSTOCKS USING DEASPHALTING SOLVENT

(71) Applicant: Saudi Arabian Oil Company, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/840,386

(22) Filed: Apr. 4, 2020

(65) Prior Publication Data

US 2021/0309926 A1 Oct. 7, 2021

(51) Int. Cl.

| | |
|---|---|
| ***C10G 67/14*** | (2006.01) |
| ***C10G 67/06*** | (2006.01) |
| ***C10G 67/04*** | (2006.01) |
| ***C10G 67/16*** | (2006.01) |

(52) U.S. Cl.

CPC ..... *C10G 67/14* (2013.01); *C10G 67/0454* (2013.01); *C10G 67/06* (2013.01); *C10G 67/16* (2013.01); *C10G 2300/107* (2013.01); *C10G 2300/1044* (2013.01); *C10G 2300/202* (2013.01); *C10G 2300/206* (2013.01); *C10G 2300/301* (2013.01); *C10G 2300/308* (2013.01)

(58) Field of Classification Search

CPC ..... C10G 67/14; C10G 2300/202; C10G 2300/107; C10G 2300/1044; C10G 2300/301; C10G 2300/308; C10G 2300/20; C10G 55/00; C10G 55/02; C10G 55/08; C10G 67/04; C10G 67/02; C10G 67/16

See application file for complete search history.

(56) References Cited

U.S. PATENT DOCUMENTS

| | | | | |
|---|---|---|---|---|
| 4,088,540 | A * | 5/1978 | Bunas | B01D 11/043 196/14.52 |
| 4,239,616 | A * | 12/1980 | Gearhart | C10G 21/003 208/309 |
| 4,452,691 | A | 6/1984 | Polomski | |
| 5,958,365 | A * | 9/1999 | Liu | C01B 3/48 423/655 |
| 6,171,477 | B1 | 1/2001 | Morel et al. | |

(Continued)

FOREIGN PATENT DOCUMENTS

EP 1731588 A1 12/2006

OTHER PUBLICATIONS

PCT International Search Report and Written Opinion from corresponding PCT Application No. PCT/US2021/024803 dated Jul. 19, 2021.

*Primary Examiner* — Randy Boyer
*Assistant Examiner* — Juan C Valencia
(74) *Attorney, Agent, or Firm* — Leason Ellis LLP

(57) ABSTRACT

Separation of asphaltenes from residual oil is carried out with naphtha as solvent. In particular, straight run naphtha obtained from the same crude oil source as the residual oil feed is used as the solvent. The mixture of deasphalted oil and solvent is passed to a hydroprocessing zone, without typical separation and recycle of the solvent back to the solvent deasphalting unit. Asphalt is separated from the residual oil (residue from atmospheric or vacuum distillation); the mixture of deasphalted oil and naphtha solvent is passed to the hydroprocessing unit.

29 Claims, 13 Drawing Sheets

(56) References Cited

U.S. PATENT DOCUMENTS

| | | | | |
|---|---|---|---|---|
| 7,214,308 | B2 | 5/2007 | Colyar | |
| 7,381,320 | B2 | 6/2008 | Iqbal et al. | |
| 7,749,378 | B2 | 7/2010 | Iqbal et al. | |
| 7,763,163 | B2 | 7/2010 | Koseoglu | |
| 7,799,211 | B2 | 9/2010 | Koseoglu et al. | |
| 7,867,381 | B2 | 1/2011 | Koseoglu | |
| 7,955,496 | B2 | 6/2011 | Iqbal et al. | |
| 7,964,090 | B2 | 6/2011 | Iqbal | |
| 8,372,267 | B2 | 2/2013 | Kressmann et al. | |
| 8,632,673 | B2 | 1/2014 | Kressmann et al. | |
| 8,721,927 | B2 | 5/2014 | Koseoglu | |
| 8,728,300 | B2 | 5/2014 | Iqbal et al. | |
| 8,986,622 | B2 | 3/2015 | Koseoglu et al. | |
| 9,056,771 | B2 | 6/2015 | Koseoglu et al. | |
| 9,234,146 | B2 | 1/2016 | Koseoglu | |
| 9,260,671 | B2 | 2/2016 | Shafi et al. | |
| 9,266,730 | B2 | 2/2016 | Kresna et al. | |
| 9,273,256 | B2 | 3/2016 | Gillis et al. | |
| 9,359,917 | B2 | 6/2016 | Koseoglu et al. | |
| 9,469,816 | B2 | 10/2016 | Iqbal et al. | |
| 9,493,708 | B2 | 11/2016 | Nakamura et al. | |
| 9,670,766 | B2 * | 6/2017 | Grande | C10G 55/04 |
| 10,422,046 | B2 | 9/2019 | Koseoglu et al. | |
| 2008/0093260 | A1 * | 4/2008 | Koseoglu | C10G 21/003 208/96 |
| 2010/0018904 | A1 | 1/2010 | Kressmann et al. | |
| 2010/0122934 | A1 | 5/2010 | Kaizmann et al. | |
| 2011/0083996 | A1 | 4/2011 | Shafi et al. | |
| 2012/0187027 | A1 | 7/2012 | Koseoglu | |
| 2013/0319910 | A1 | 12/2013 | Koseoglu et al. | |
| 2014/0221709 | A1 | 8/2014 | Baldassari et al. | |
| 2014/0262961 | A1 * | 9/2014 | Agolli | C10G 21/003 208/309 |
| 2015/0152027 | A1 | 6/2015 | Shafi et al. | |
| 2016/0068768 | A1 * | 3/2016 | Ganyu | C10G 67/0463 208/86 |
| 2016/0145509 | A1 * | 5/2016 | Mukherjee | C10G 47/00 208/59 |
| 2018/0148651 | A1 | 5/2018 | Koseoglu | |
| 2019/0264116 | A1 | 8/2019 | Gunther et al. | |

* cited by examiner

INTEGRATED PROCESS AND SYSTEM FOR TREATMENT OF HYDROCARBON FEEDSTOCKS USING DEASPHALTING SOLVENT

RELATED APPLICATIONS

Not applicable.

BACKGROUND OF THE INVENTION

Field of the Invention

This invention relates to processes and systems for treatment of hydrocarbon feedstocks including crude oil.

Description of Related Art

Crude oil is conventionally processed by distillation into several fractions, followed by various refining processes such as cracking, solvent refining and hydroconversion processes, where each process is targeted to each fraction. The types of refining processes are selected and operated at conditions effective to produce a desired slate of fuels, lubricating oil products, chemicals, chemical feedstocks and the like. An example of a conventional process includes distillation of a crude oil in an atmospheric distillation column for separation into gaseous product, naphtha, gas oil, and atmospheric residue. In most processes, atmospheric residue is further fractionated in a vacuum distillation column to produce vacuum gas oil and a vacuum residue. Vacuum gas oil is usually cracked to more valuable light transportation fuel products by fluid catalytic cracking or hydrocracking. Vacuum residue may be further upgraded to recover a higher amount of useful products. Such upgrading methods may include one or more of, for example, residue hydrotreating, residue fluid catalytic cracking, coking, and solvent deasphalting. Streams recovered from crude distillation at the boiling point of fuels have typically been used directly as fuels.

Solvent deasphalting is a physical separation process wherein the components of the feed are recovered in their original state (no reaction is taking place). Typically, a paraffinic solvent with carbon number ranging 3-8, is used to separate the components in the heavy crude oil fractions. Solvent deasphalting is a flexible process utilized to separate atmospheric and vacuum heavy residues into typically two products, deasphalted oil (DAO) and asphalt. The solvent composition, operating temperature and solvent-to-oil ratio are selected to achieve the desired split between the lighter DAO and heavy asphaltenes products. As the molecular weight of the solvent increases, so does the solubility of the charge. The solvent most often used for production of lube oil bright stock is propane or a blend of propane and iso-butane. For applications where the DAO is sent to conversion processes such as fluid catalytic cracking, the solvent with higher carbon number such as butane or pentane, or mixtures thereof is selected. Typical uses for DAO include lube bright stock, lube hydrocracker feed, fuels hydrocracker feed, fluid catalytic cracker feed or fuel oil blending. Depending on the operation, the asphalt product may be suitable for use as a blending component for various grades of asphalt, as a fuel oil blending component, or as feedstock to a heavy oil conversion unit such as a coker or ebullated bed residue hydrocracker or gasification. Conventional solvent deasphalting is carried out with no catalyst or adsorbent. Commonly owned U.S. Pat. No. 7,566,394 entitled "Enhanced Solvent Deasphalting Process for Heavy Hydrocarbon Feedstocks Utilizing Solid Adsorbent," which is incorporated by reference herein in its entirety, employs solid adsorbents to increase the quality of DAO, as the poly-nuclear aromatics are separated from DAO during the process.

The available methods for upgrading/desulfurizing crude oil feeds have limitations. For example, the fixed-bed reactor units processing crude oil require frequent shut-down of the reactors for catalyst unloading and replacement due to the high metal content present in the crude oil. This reduces the on-stream factor and as a result increases the processing costs of the hydroprocessing units.

Despite the current efforts, a need remains for improved processes and systems for treating feedstreams such as crude oil.

SUMMARY

The above objects and further advantages are provided by the system and process for treating feedstreams.

In certain embodiments, separation of asphaltenes from residual oil is carried out with naphtha as solvent. In particular, straight run naphtha obtained from the same crude oil source as the residual oil feed is used as the solvent. The mixture of deasphalted oil and solvent is passed to a hydroprocessing zone, without typical separation and recycle of the solvent back to the solvent deasphalting unit. Asphalt is separated from the residual oil (ADU or VDU residue); the mixture of deasphalted oil and naphtha solvent is passed to the hydroprocessing unit. Asphalt can be sent to a gasification unit for hydrogen production, which can be used in the hydroprocessing unit.

In certain embodiments, a feedstream such as a crude oil feed can be upgraded to produce low sulfur synthetic crude oil in a tightly integrated process and system including atmospheric distillation, optionally vacuum distillation, asphaltene separation, and hydroprocessing. In certain embodiments a low sulfur synthetic crude oil can be produced that is bottomless (asphalt free), or having at least a major portion, a significant portion or a substantial portion of the asphaltene content of the original crude oil feed removed.

In certain embodiments, an integrated system includes an asphaltene separation zone, within which light naphtha is used as solvent for deasphalting of atmospheric residue and/or vacuum residue. The naphtha from the crude oil distillation and/or hydrocracking unit is used as solvent. The combined solvent and deasphalted oil mixture is passed to the hydrocracking unit for refining and cracking, and in certain embodiments no solvent separation step is necessary to separate the deasphalted oil and the solvent. Furthermore, in certain embodiments no additional solvent is used in the process, other that the solvent obtained from the initial distillation and optionally from the hydroprocessor effluent naphtha. The asphaltene separation zone using solvent deasphalting can be operated with or without an adsorbent. For instance, in embodiments in which the asphaltene separation zone operates with an adsorbent, aspects of the process described in U.S. Pat. No. 7,566,394, which is incorporated by reference herein in its entirety, can be integrated, in which the adsorbent material passes with the asphalt phase.

In certain embodiments, asphaltene reduction is carried out with adsorption treatment of the atmospheric residue and/or vacuum residue, followed by desorption with solvent obtained from the initial distillation and optionally from the hydroprocessor effluent naphtha. For instance, aspects of the process described in U.S. Pat. Nos. 7,763,163 and 7,867,381, 7,799,211 or 8,986,622, which are incorporated by reference herein in their entireties, can be integrated.

In certain embodiments, the mixture of naphtha and deasphalted oil is sent to a hydroprocessing zone for refining and cracking. The hydroprocessing zone can be once-thru (single reactor) or series flow (two or more reactors) or two stage (two or more reactors) containing single or multiple catalysts designed for hydrodemetallization, hydrodesulfurization, hydrodenitrogenation, hydrogenation and hydrocracking. The feedstock is desulfurized and denitrogenated to remove the heteroatom containing hydrocarbons. In addition, heavier molecules are cracked in the presence of hydrogen to form lighter molecules to produce hydrocarbons fractions, for instance, suitable for transportation fuels. Catalysts that are effective for hydrotreating and hydrocracking deasphalted oil and/or vacuum gas oil are used.

In certain embodiments, asphalt produced from the asphaltene separation step is gasified in a gasification reactor. The gasification reactor can be a refractory wall gasifier or a membrane wall gasifier, depending upon, for instance the gasifier feed and hydrogen production requirement. In embodiments that utilize asphaltene separation with solid adsorbent materials, membrane wall type gasifiers are suitable. In embodiments that utilize a gasification step, hydrogen produced is supplied to the hydroprocessing zone.

An embodiment of a process described herein for upgrading a feedstock comprises:

separating the feedstock into at least a naphtha fraction or a light naphtha fraction, and a residue fraction;

treating all or a portion of the residue fraction for removal of asphaltenes and/or contaminants using a deasphalting solvent and/or a stripping solvent, recovering a treated residue fraction, and discharging asphaltenes and/or contaminants; and hydroprocessing all or a portion of the treated residue fraction in the presence of hydrogen to produce a hydroprocessed effluent, and optionally separating hydrocracked naphtha or hydrocracked light naphtha from the hydroprocessed effluent;

wherein the deasphalting solvent and/or the stripping solvent comprises all or a portion of the naphtha fraction or the light naphtha fraction obtained from separating the feedstock, and/or all or a portion of the hydrocracked naphtha fraction or hydrocracked light naphtha fraction obtained from the hydroprocessed effluent.

An embodiment of a system for upgrading a feedstock described herein comprises:

a separation zone having an inlet in fluid communication with the feedstock, and at least a naphtha outlet and a residue outlet, wherein the separation zone is operable to separate the feedstock into at least a naphtha fraction or a light naphtha fraction that is discharged from the naphtha outlet, and a residue fraction that is discharged from the residue outlet;

a treatment zone having one or more inlets in fluid communication with a source of deasphalting solvent and/or a source of stripping solvent, and in fluid communication with the residue outlet, the treatment zone further comprising one or more outlets for discharging a treated residue fraction and one or more outlets for discharging asphaltenes and/or contaminants; and a hydroprocessing zone having an inlet in fluid communication with the treated residue fraction outlet and a hydroprocessed effluent outlet optionally including a hydrocracked naphtha outlet;

wherein the source of deasphalting solvent and/or the source of stripping solvent comprise the naphtha outlet of the separation zone and/or the hydrocracked naphtha outlet of the hydroprocessing zone.

An embodiment of a process described herein for upgrading a feedstock comprises:

separating the feedstock into at least a naphtha fraction or a light naphtha fraction, and a residue fraction;

removing asphaltenes from all or a portion of the residue fraction by contacting with a deasphalting solvent to induce phase separation into an asphaltene reduced residue fraction and an asphaltene phase by solvent-flocculation of solid asphaltenes; and hydroprocessing all or a portion of the asphaltene reduced residue fraction in the presence of hydrogen to produce a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

An embodiment of a system for upgrading a feedstock described herein comprises:

a separation zone having an inlet in fluid communication with the feedstock, and at least a naphtha outlet and a residue outlet, wherein the separation zone is operable to separate the feedstock into at least a naphtha fraction or a light naphtha fraction that is discharged from the naphtha outlet, and a residue fraction that is discharged from the residue outlet;

an asphaltene separation zone having one or more inlets in fluid communication with a source of deasphalting solvent and with the residue outlet, one or more outlets for discharging an asphaltene reduced residue fraction and one or more outlets for discharging asphaltenes; and a hydroprocessing zone having an inlet in fluid communication with the asphaltene reduced residue fraction outlet and a hydroprocessed effluent outlet optionally including a hydrocracked naphtha outlet;

wherein the source of deasphalting solvent comprises the naphtha outlet of the separation zone and/or the hydrocracked naphtha outlet of the hydroprocessing zone.

An embodiment of a process described herein for upgrading a feedstock comprises:

separating the feedstock into at least a naphtha fraction or a light naphtha fraction, and a residue fraction;

treating the residue fraction with solid adsorbent material to adsorb contaminants contained in the residue fraction and to produce an adsorbent-treated residue fraction, and stripping adsorbed contaminants from the solid adsorbent material with a stripping solvent;

hydroprocessing all or a portion of the adsorbent-treated residue fraction in the presence of hydrogen to produce a hydroprocessed effluent, and optionally separating hydrocracked naphtha or hydrocracked light naphtha from the hydroprocessed effluent;

wherein the stripping solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

An embodiment of a system for upgrading a feedstock described herein comprises:

a separation zone having an inlet in fluid communication with the feedstock, and at least a naphtha outlet and a residue outlet, wherein the separation zone is operable to separate the feedstock into at least a naphtha fraction or a light naphtha fraction that is discharged from the naphtha outlet, and a residue fraction that is discharged from the residue outlet;

an adsorption treatment zone having one or more inlets in fluid communication with a source of solid adsorbent material, a source of stripping solvent, and the residue outlet, the adsorption treatment zone further comprising one or more outlets for discharging an adsorbent-treated residue fraction, and one or more outlets for discharging contaminants stripped from adsorbent material; and a hydroprocessing zone having an inlet in fluid communication with the adsorbent-treated residue fraction outlet and a hydroprocessed effluent outlet optionally including a hydrocracked naphtha outlet;

wherein the source of stripping solvent comprises the naphtha outlet of the separation zone and/or the hydrocracked naphtha outlet of the hydroprocessing zone.

In the above embodiments, the treated residue fraction that is passed to hydroprocessing (including the asphaltene reduced residue fraction and/or the adsorbent-treated residue fraction) contains at least a portion of the initial deasphalting solvent and/or stripping solvent that was used for treatment of the residue fraction.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings, in which optional components are shown in dashed lines, and where.

DETAILED DESCRIPTION

Figure 1A:
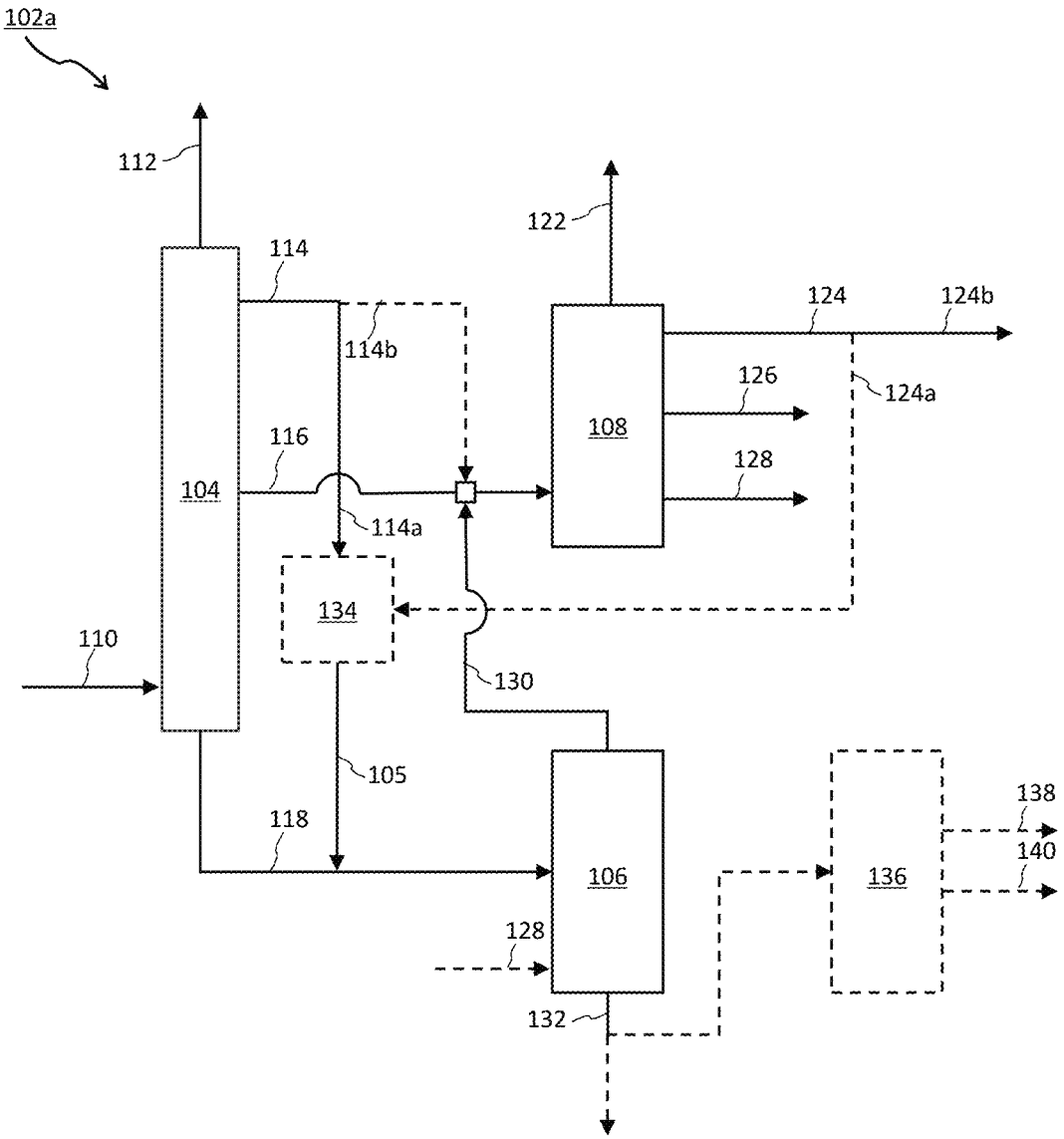
FIG. 1A is a schematic diagram of an embodiment of a system for upgrading a feedstock integrating separation, hydroprocessing and removal of asphaltenes.

As used herein, the term "stream" (and variations of this term, such as hydrocarbon stream, feed stream, product stream, and the like) may include one or more of various hydrocarbon compounds, such as straight chain, branched or cyclical alkanes, alkenes, alkadienes, alkynes, alkylaromatics, alkenyl aromatics, condensed and non-condensed di-, tri- and tetra-aromatics, and gases such as hydrogen and methane, C2+ hydrocarbons and further may include various impurities.

The term "zone" refers to an area including one or more equipment, or one or more sub-zones. Equipment may include one or more reactors or reactor vessels, heaters, heat exchangers, pipes, pumps, compressors, and controllers. Additionally, an equipment, such as reactor, dryer, or vessels, further may include one or more zones.

Volume percent or "V %" refers to a relative at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "crude oil" as used herein refers to petroleum extracted from geologic formations in its unrefined form. Crude oil suitable as the source material for the processes herein include but are not limited to Arabian Heavy, Arabian Medium, Arabian Light, Arabian Extra Light, Arabian Super Light, other Gulf crudes, Brent, North Sea crudes, North and West African crudes, Indonesian, Chinese crudes, or mixtures thereof. As used herein, "crude oil" refers to whole range crude oil or topped crude oil. As used herein, "crude oil" also refers to such mixtures that have undergone some pre-treatment such as water-oil separation; and/or gas-oil separation; and/or desalting; and/or demineralizing; and/or stabilization. In certain embodiments, crude oil refers to any of such mixtures having an API gravity (ASTM D287 standard), of greater than or equal to about 20°, 30°, 32°, 34°, 36°, 38°, 40°, 42° or 44°.

As used herein, all boiling point ranges relative to hydrocarbon fractions derived from crude oil via atmospheric and/or shall refer to True Boiling Point values obtained from a crude oil assay, or a commercially acceptable equivalent The acronym "LPG" as used herein refers to the well-known acronym for the term "liquefied petroleum gas," and generally is a mixture of C3-C4 hydrocarbons. In certain embodiments, these are also referred to as "light ends."

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 20-80, 20-75, 20-68, 32-110, 32-100, 32-90, 32-88, 32-80, 32-75, 32-68, 36-110, 36-100, 36-90, 36-88, 38-80, 32-75 or 32-68° C.

The term "heavy naphtha" as used herein refers to hydrocarbons boiling in the range of about 68-220, 68-210, 68-200, 68-190, 68-180, 68-170, 75-220, 75-210, 75-200, 75-190, 75-180, 75-170, 80-220, 80-210, 80-200, 80-190, 80-180, 80-170, 88-220, 88-210, 88-200, 88-190, 88-180, 88-170, 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

In certain embodiments naphtha, light naphtha and/or heavy naphtha refer to such petroleum fractions obtained by crude oil distillation, or distillation of intermediate refinery processes as described herein. The modifying term "straight run" is used herein having its well-known meaning, that is, describing fractions derived directly from an atmospheric distillation unit or flash zone, optionally subjected to steam stripping, without other refinery treatment such as hydroprocessing, fluid catalytic cracking or steam cracking. An example of this is "straight run naphtha" and its acronym "SRN" which accordingly refers to "naphtha" defined above that is derived directly from an atmospheric distillation unit or flash zone, optionally subjected to steam stripping, as is well known. In other embodiments, the modifying term "cracked" is used in conjunction with fractions having boiling ranges defined herein derived from hydrocracking unit(s), also sometimes referred to as "wild naphtha."

The term "middle distillates" as used herein relative to effluents from the atmospheric distillation unit or flash zone refers to hydrocarbons boiling in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-360, 210-350, 210-340, 210-320, 200-370, 200-360, 200-350, 200-340 or 200-320° C.

The term "atmospheric residue" and its acronym "AR" as used herein relative to effluents from the atmospheric distillation unit or flash zone refer to the bottom hydrocarbons having an initial boiling point corresponding to the end point of the middle distillates range hydrocarbons, and having an end point based on the characteristics of the crude oil feed.

The term "vacuum distillates" as used herein refer to hydrocarbons obtained from the vacuum distillation unit or flash zone with atmospheric residue as the feed, and has an initial boiling point depending on the initial boiling point of the corresponding atmospheric residue, and having an end point of 565, 550, 540, 530 or 510° C.

The term "vacuum residue" and its acronym "VR" as used herein refer to the bottom hydrocarbons obtained from the vacuum distillation unit or flash zone having an initial boiling point corresponding to the end point of the vacuum distillates, and having an end point based on the characteristics of the crude oil feed.

The term "unconverted oil" and its acronym "UCO," is used herein having its known meaning, and refers to a highly paraffinic fraction obtained from a separation zone associated with a hydroprocessing reactor, and contains reduced nitrogen, sulfur and nickel content relative to the reactor feed, and includes in certain embodiments hydrocarbons having an initial boiling point in the range of about 340-370° C., for instance about 340, 360 or 370° C., and an end point in the range of about 510-560° C., for instance about 540, 550, 560° C. or higher depending on the characteristics of the feed to the hydroprocessing reactor, and hydroprocessing reactor design and conditions. UCO is also known in the industry by other synonyms including "hydrowax."

The term "cracked diesel" refers to a hydrocarbon fraction obtained from a separation zone associated with a hydroprocessing reactor, and contains reduced nitrogen, sulfur and nickel content relative to the reactor feed, and includes in certain embodiments hydrocarbons having an initial boiling point corresponding to the end point of the hydrocracked naphtha fraction(s) obtained from the separation zone associated with the hydroprocessing reactor, and having an end boiling point corresponding to the initial boiling point of the unconverted oil.

As used herein, the term "spent solid adsorbent material" means used adsorbent material that has been determined to no longer have efficacy as adsorbent material for its intended application, and can include non-catalytic adsorbent materials and adsorbent materials that were originally used as catalytic materials, for instance, in hydrotreating, hydrocracking, and fluid catalytic cracking refinery processes. In certain embodiments, solid adsorbent material is "spent" when more than 50% of its original pore volume has been blocked by deposited carbonaceous material and other contaminants. In further embodiments, solid adsorbent material is considered "spent" when less than 50% of its original pore volume has been blocked by deposited carbonaceous material and other contaminants, for example, 25-49, 25-45, or 25-40%, particularly where a gasification reactor is used to recover value from the partially spent material. Spent solid adsorbent material can include adsorbed heavy polynuclear aromatic molecules, compounds containing sulfur, compounds containing nitrogen, and/or compounds containing metals and/or metals.

As used herein, the term "asphalt" means a highly viscous liquid or semi-solid bitumen mixture that can be derived from natural deposits or petroleum refinery operations.

Additionally, as used herein, the term "process reject materials" means materials discharged from petroleum refinery operations as undesirable constituents including heavy hydrocarbon molecules containing sulfur, nitrogen and/or heavy aromatic molecules, heavy polynuclear aromatic molecules, and metals such as nickel and vanadium.

Figure 1B:
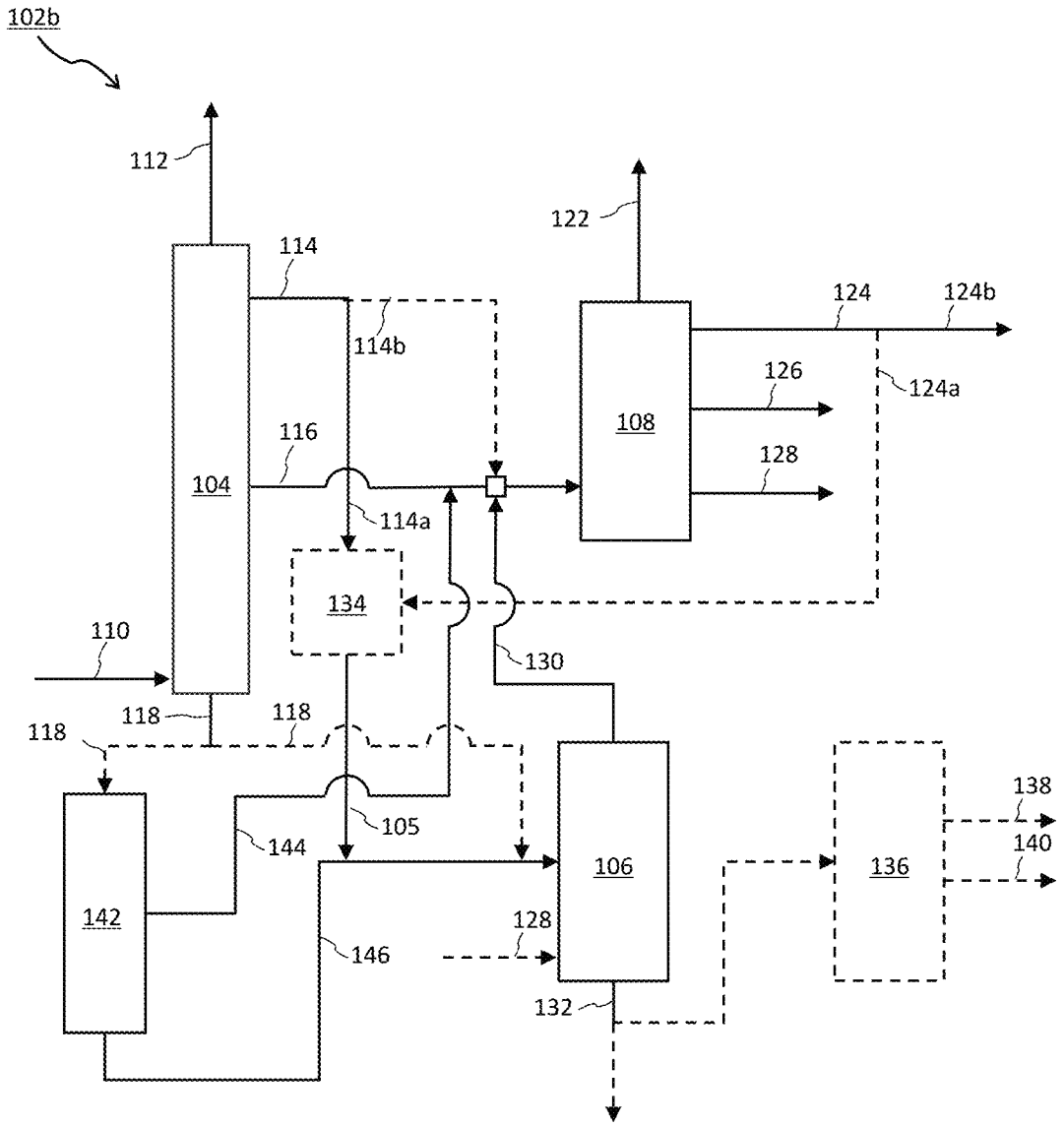
FIG. 1B is a schematic diagram of another embodiment of a system for upgrading a feedstock integrating first and second stages of separation, hydroprocessing and removal of asphaltenes.

In certain embodiments, and with reference to the process flow schematics of FIGS. 1A and 1B, integrated systems 102*a* and 102*b* each include a feed separation zone 104, a treatment zone 106, and a hydroprocessing zone 108 operable to hydrotreat and optionally hydrocrack DAO and distillates. The system shown in FIG. 1B also integrates a vacuum separation zone 142. In certain embodiments, a gasification zone 136 is also integrated.

The feed separation zone 104, which can be an atmospheric distillation unit (ADU) or a series of separation vessels, includes an inlet in fluid communication with a source of a feedstream 110, such as crude oil. In certain embodiments, volatile materials are removed from the crude oil feedstream prior to atmospheric distillation or within the atmospheric distillation step, to remove at least a portion of volatile materials. In certain embodiments at least a major portion, a significant portion or a substantial portion of the crude oil feed is subjected to desulfurization in the hydroprocessing zone 108.

The feed separation zone 104 includes outlets for discharging a light gas stream 112, a naphtha fraction 114, a middle distillate fraction 116 and an atmospheric residue fraction 118. The light gas stream 112 includes LPG and other gases, and its outlet is typically in fluid communication with one or more gas purification and separation units. In certain embodiments, the feed separation zone 104 comprises, or is preceded by, a topping unit to remove certain light fractions. In the present systems and processes, when naphtha or light naphtha for deasphalting is derived from the initial feedstream (in contrast to systems and processes in which naphtha or light naphtha for deasphalting is derived from another source), such topping unit is operable to retain in the feedstream 110 sufficient naphtha for use in the treatment zone 106 for asphaltene and/or contaminant removal. In additional embodiments, naphtha or light naphtha from a topping unit can be used as all or a portion of the naphtha fraction 114, so that the naphtha or light naphtha for deasphalting is derived from the initial feedstream.

The naphtha fraction 114 outlet is in fluid communication with the treatment zone 106 to route a naphtha or light naphtha fraction 114, or a portion of a naphtha or light naphtha fraction, stream 114*a*, as deasphalting solvent and/or as desorbing solvent. The stream 114 or 114*a* is generally brought to the deasphalting and/or desorbing temperature and pressure conditions prior to use as solvent in the respective steps. In certain embodiments, all, a substantial portion, a significant portion or a major portion of solvent for deasphalting and/or desorbing is obtained from naphtha or light naphtha that is derived from the feedstream. Any remainder of stream 114*a* can be passed with the hydroprocessing feed, and/or diverted and used elsewhere, for example as a gasoline blending component or as feed for petrochemicals production (for instance via steam cracking). In certain embodiments additional solvent can be provided from a hydrocracked naphtha stream 124 as described herein.

In certain embodiments, the naphtha fraction outlet is in direct fluid communication via stream 114 or 114*a* with the treatment zone 106, without intermediate separation (for instance aromatic separation), hydrotreating, desulfurization, or other processing steps (but including steps to bring the stream 114 or 114*a* to deasphalting and/or desorbing temperature and pressure conditions). In additional embodiments (not shown), the naphtha fraction outlet is in fluid communication with an intermediate separation step, such as an aromatics extraction unit, or an intermediate hydrodesulfurization unit or other desulfurization unit.

In certain embodiments the naphtha fraction 114 outlet is in fluid communication with the DAO/distillates hydroprocessing zone 108 to route a portion of the naphtha fraction 114, stream 114*b*, as additional hydroprocessing feed. In certain embodiments, the portions 114*a*, 114*b* can be divided quantitatively (on a volume or weight basis, for example, with a diverter, not shown) so that the same boiling range naphtha fraction is routed to the treatment zone 106 as solvent 114*a* and the hydroprocessing zone 108 as feed 114*b*, in different or the same proportions. In embodiments in which the naphtha fraction 114 contains light naphtha and all or some of the heavy naphtha range components of the feedstream, diverting could pass aromatics to the treatment zone 106 via stream 114*a*; in these circumstances a higher volume of deasphalted oil is produced, however aromatics such as benzene increases the asphaltene content in the deasphalted oil as certain asphaltenes are soluble in certain aromatics. In embodiments in which the naphtha fraction 114 contains substantially light naphtha, heavy naphtha can be discharged from the separation zone 104 via stream 116 with the middle distillates and subjected to hydroprocessing, and/or it can be discharged as a separate stream (not shown) and used elsewhere, for example as a gasoline blending component or as feed for petrochemicals production (for instance via steam cracking).

In certain embodiments, the naphtha fraction 114 is a light naphtha fraction, and all, a substantial portion, a significant portion or a major portion of solvent for deasphalting and/or desorbing comprises light naphtha from the feedstream. Any remainder can be passed with the hydroprocessing feed, and/or diverted and used elsewhere, for example as a gasoline blending component or as feed for petrochemicals production (for instance via steam cracking).

In embodiments in which the naphtha fraction 114 includes light naphtha and all or a portion of heavy naphtha from the initial feedstock, streams 114*a* and 114*b* can be different boiling ranges and separated by fractionating. For instance, in embodiments in which the separation zone 104 is an ADU, streams 114*a* and 114*b* can be distinct draws from the column (not shown), with stream 114*a* being a light naphtha stream and stream 114*b* can be being a heavy naphtha stream. In other embodiments, in which the separation zone 104 is an ADU or a multi-stage flashing system, a naphtha separation vessel (not shown) can be provided within the separation zone 104 to separate a light naphtha stream 114*a* and a heavy naphtha stream 114*b*. In certain embodiments, all, a substantial portion, a significant portion or a major portion of solvent for deasphalting and/or desorbing is obtained from light naphtha that is derived from the feedstream. Any remainder of stream 114*a* can be passed with the hydroprocessing feed, and/or diverted and used elsewhere, for example as a gasoline blending component or as feed for petrochemicals production (for instance via steam cracking).

In the embodiment of FIG. 1A, the system 102*a* includes the atmospheric residue fraction 118 outlet in fluid communication with the treatment zone 106. FIG. 1B is similar to FIG. 1A, wherein the system 102*b* includes a vacuum separation zone 142, which can be a vacuum distillation unit (VDU) or a multi-stage flashing system operating under vacuum conditions; in the system 102*b*, the atmospheric residue fraction 118 outlet in fluid communication with the treatment zone 106, the vacuum separation zone 142, or both the treatment zone 106 and the vacuum separation zone 142. The vacuum separation zone 142 includes an inlet in fluid communication with the atmospheric residue fraction 118 outlet, and outlets including an outlet for discharging a vacuum distillates fraction 144 that is in fluid communication with the hydroprocessing zone 108 and an outlet for discharging a vacuum residue fraction 146 that is in fluid communication with the treatment zone 106. In certain embodiments, a portion of the atmospheric residue fraction 118 is be routed to the treatment zone 106, so that the treatment zone 106 is in fluid communication with both the atmospheric residue fraction 118 outlet and the vacuum residue fraction 146 outlet.

The hydroprocessing zone 108 includes one or more inlets is in fluid communication with the middle distillate fraction 116, in certain embodiments a stream 114*b*, and a deasphalted and/or adsorbent-treated stream 130 from the treatment zone 106. In the embodiments of FIG. 1B, the hydroprocessing zone 108 also includes one or more inlets in fluid communication with the vacuum distillates fraction 144. The hydroprocessing zone 108 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feeds. In certain embodiments, a fractionator or other separation scheme is provided in the DAO/distillates hydroprocessing zone 108 to provide suitable fractions. As shown in FIGS. 1A and 1B, outlets are provided for discharging a light gases stream 122, the hydrocracked naphtha stream 124, a hydrocracked diesel stream 126, and an unconverted oil stream 128. In certain embodiments, the only separation within the DAO/distillates hydroprocessing zone 108 is to separate vapors so that the entire liquid effluent is discharged as a single feed, for instance, as a synthetic crude oil product stream (not shown in FIGS. 1A and 1B).

In certain embodiments, the hydrocracked naphtha stream 124 outlet is in fluid communication with the treatment zone 106 to pass a portion 124*a* of the hydrocracked naphtha stream as deasphalting solvent and/or as desorbing solvent. A portion 124*b* is recovered, for instance for further refinery operations. The portions 124*a*, 124*b* can be divided (on a volume or weight basis, for example, with a diverter, not shown) so that the same boiling range hydrocracked naphtha fraction is passed to the treatment zone 106 as solvent 124*a* and recovered as a hydrocracked naphtha portion 124*b*, in different or the same proportions. In additional embodiments the portions 124*a* and 124*b* are different boiling range naphtha fractions and are separated by fractionating. For instance, streams 124*a* and 124*b* can be separate draws from the hydrocracker fractionating column (not shown), with stream 124*a* being a light naphtha stream and stream 124*b* being a heavy naphtha stream.

The treatment zone 106 generally includes one or more inlets for the atmospheric residue and/or vacuum residue, and the solvent (deasphalting and/or stripping solvent), one or more outlets for discharging a treated residue fraction 130, which is a deasphalted and/or adsorbent-treated stream, and one or more outlets for discharging an asphaltene-rich and/or contaminant-rich stream 132.

In certain embodiments, zone 106 can operate similar to a solvent deasphalting operation, or an enhanced solvent deasphalting operation similar to that described in U.S. Pat. No. 7,566,394, which is incorporated by reference herein in its entirety. In other embodiments described herein zone 106 can be replaced by, or supplemented with, an adsorption treatment step, for instance, similar to those described in U.S. Pat. Nos. 7,763,163 and 7,867,381, 7,799,211 or 8,986,622, which are incorporated by reference herein in their entireties. In a solvent deasphalting arrangement, zone 106 is an asphaltene separation zone and generally includes one or more inlets for the solute, the atmospheric residue and/or vacuum residue, and the solvent. In addition, zone 106 includes at least two outlets for discharging the treated residue fraction 130, which is a deasphalted oil stream and in certain embodiments a mixture of deasphalted oil and deasphalting solvent. An asphalt phase forms the asphaltene-rich and/or contaminant-rich stream 132 that is discharged and generally contains asphaltenes, and also contains contaminants including metal and other heteroatoms present in the heavy fraction of the initial feed subjected to separation. The treated residue fraction 130 can contain a mixture of deasphalted oil and solvent (all or a portion thereof that is not entrained in the asphalt phase and/or that is not recycled within the asphaltene separation zone), that is, an asphaltene reduced atmospheric residue fraction and/or an asphaltene reduced vacuum residue fraction.

In certain embodiments, zone 106 can operate similar to an adsorbent treatment zone, wherein adsorbent material is regenerated using a stripping solvent obtained from one or more internal solvent sources as described herein. An example of a process and system that can be integrated in this manner is disclosed in commonly owned U.S. Pat. Nos. 7,799,211 and 8,986,622, which are incorporated herein in their entireties. As shown in FIGS. 1A and 1B, a treated residue fraction 130 is an adsorbent-treated stream that contains oil that has been subjected to the adsorbent treatment. In certain embodiments the treated residue fraction 130 is an adsorbent-treated atmospheric residue fraction and/or an adsorbent-treated vacuum residue fraction Contaminants that have been stripped from adsorbent material using one or more internal solvent sources are discharged are removed as the contaminant stream 132.

In the embodiment of FIG. 1A, the atmospheric residue fraction 118 outlet is in fluid communication with the treatment zone 106 to recover DAO and asphalt. In the embodiment of FIG. 1B, the vacuum residue fraction 146 outlet is in fluid communication with the treatment zone 106 to recover DAO and asphalt, and optionally the atmospheric residue fraction 118 outlet is also in fluid communication with the treatment zone 106. As noted above, the outlet discharging the treated residue fraction 130 is in fluid communication with the hydroprocessing zone 108. In certain embodiments, a significant portion or a substantial portion of the initial solvent used in the treatment zone 106 passes with the treated residue fraction 130.

The treatment 106 includes requisite separation vessel(s), heaters and other units to process, and operates under effective operating conditions and in certain embodiments with effective adsorbent treatment (as described further herein) to carry out the desired degree of asphaltene separation and/or contaminant removal. In the integrated system and process herein, solvent that is used in the treatment zone 106 is derived from the separation zone 104 and in certain embodiments from the hydroprocessing zone 108, that is, streams 114, 114*a* and/or 124*a*. In certain embodiments one or more optional solvent drums 134 (shown as one drum in FIGS. 1A and 1B) is integrated to receive the naphtha fraction 114 or stream 114*a* prior to routing to the treatment zone 106. In certain embodiments (not shown) separate drums are used to receive the naphtha fraction 114 or stream 114*a*, and the hydrocracked naphtha 124*a*, prior to routing to the treatment zone 106. In certain embodiments internal solvent, that is from stream 114 or 114*a*, and in certain embodiments hydrocracked naphtha stream 124*a*, comprises all or a substantial portion of the total solvent used for the treatment zone 106. In certain embodiments if another solvent source is used it could be known deasphalting solvents such as paraffinic solvents with carbon number in the range of 3-8, 5-8, 3-7 or 5-7.

In certain embodiments, the asphalt stream 132 outlet is in fluid communication with a gasification zone 136. The gasification zone can include a refractory wall gasifier or a membrane wall gasifier. In embodiments that utilize an asphaltene separation zone with solid adsorbents that pass to the asphalt phase, membrane wall type gasifiers are particularly effective to accommodate the increased slag levels. Products from the gasification zone generally include steam 138 and hydrogen 140.

In operation of the systems 102*a* and 102*b*, the feedstream 110 is passed to the separation zone 104 to recover the light gas stream 112, for instance, which can be used elsewhere in the refinery, for instance as fuel gas, and in embodiments in which thermal cracking is integrated in the refinery, C2-C4 gases can be used as stream cracker feed. In certain embodiments at least a portion of the naphtha or light naphtha fraction 114, or at least a portion of stream 114*a*, is routed from the appropriate outlet of the separation zone 104 to the treatment zone 106 as solvent to be used for deasphalting and/or desorbing operations. All or a portion of the remainder of naphtha or heavy naphtha in the fraction 114, stream 114*b*, is routed to the hydroprocessing zone 108. In certain embodiments in which thermal cracking is integrated in the refinery, all or portion of stream 114*b* can be used as steam cracker feed. As noted above, streams 114*a* and 114*b* can be divided quantitatively or fractions based on boiling point ranges. In certain embodiments an optional solvent drum 134 is integrated to receive at least a portion of the naphtha fraction 114 or the stream 114*a* prior to routing to the treatment zone 106. At least a portion of the middle distillate fraction 116 is routed from the separation zone 104 to the hydroprocessing zone 108. In certain embodiments, all, a substantial portion, a significant portion or a major portion of the middle distillate fraction 116 is routed from the separation zone 104 to the hydroprocessing zone 108.

In certain embodiments, naphtha or light naphtha used in deasphalting and/or desorbing operations can comprise 0-70, 0-50, 0-25, 0-10, 1-70, 1-50, 1-25, 1-10, 3-70, 3-50, 3-25 or 3-10 wt % of the naphtha or light naphtha derived from the feedstream. In embodiments in which naphtha from the feedstream is not used, at least a portion of the stream 124*a* is routed from the appropriate outlet of the hydroprocessing zone 108 to the treatment zone 106 as solvent to be used for deasphalting and/or desorbing operations. In certain embodiments, naphtha or light naphtha used in deasphalting and/or desorbing operations can comprise 0-70, 0-50, 0-25, 0-10, 1-70, 1-50, 1-25, 1-10, 3-70, 3-50, 3-25 or 3-10 wt % of the hydrocracked naphtha or hydrocracked light naphtha 124*a* derived from the hydroprocessing zone 108. In embodiments in which hydrocracked naphtha from the hydroprocessing zone 108 is not used, at least a portion of the naphtha or light naphtha stream 114, or at least a portion of stream 114*a*, is routed from the appropriate outlet to the treatment zone 106 as solvent to be used for deasphalting and/or desorbing operations. The ratio of naphtha or light naphtha to residue (stream 118 optionally in combination with stream 128 as shown in FIG. 1A; or stream 146, optionally in combination with stream 118, and optionally in combination with stream 128, as shown in FIG. 1B), the ratio of naphtha or light naphtha/feed (V/V) in the asphaltene and/or contaminant separation zone is in the range of about 2:1 to 1:30, 2:1 to 1:10, 2:1 to 1:8, 2:1 to 1:5, 2:1 to 1:2, 1:1 to 1:30, 1:1 to 1:10, 1:1 to 1:8 or 1:1 to 1:5.

In the embodiment of FIG. 1A, all, a substantial portion, a significant portion or a major portion of the atmospheric residue fraction 118 is routed to the treatment zone 106 for separation of asphaltenes and/or removal of contaminants. In the embodiment of FIG. 1B, the atmospheric residue fraction 118 can be routed to the vacuum separation zone 142 and/or the treatment zone 106. In certain embodiments, all, a portion, a substantial portion, a significant portion or a major portion of the atmospheric residue fraction 118 is routed to the vacuum separation zone 142, and any remaining portion is routed to the treatment zone 106. In other embodiments, all, a portion, a substantial portion, a significant portion or a major portion of the atmospheric residue fraction 118 is routed to the treatment zone 106, and any remaining portion is routed to the vacuum separation zone 142. Accordingly, the system 102*b* can be operated in different modes as a flexible system. For example, in certain instances the system 102*b* operates without the vacuum distillation unit where all or a portion of the atmospheric residue fraction 118 is used as feed to the treatment zone 106. In other instances, the system 102*b* operates with the vacuum distillation unit 142 where all or a portion of the vacuum residue fraction 146 is used as feed to the treatment zone 106. In still further instances the system 102*b* operates with the atmospheric residue fraction 118 divided between vacuum distillation unit 142 and zone the treatment 106 (where the treatment zone 106 also receives as feed all or a portion of the vacuum residue fraction 146).

The solvent demands of the treatment zone 106 are met with the naphtha or light naphtha from the crude oil distillation, an integrated process solvent. This solvent is used for deasphalting of atmospheric residue and/or vacuum residue, and/or for desorption of adsorbent used in certain embodiments of asphaltene reduction. In certain embodiments, hydrocracked naphtha or hydrocracked light naphtha from the hydrocracking unit is used as a deasphalting solvent and/or as a desorption solvent, alone or in combination with the naphtha or light naphtha from the crude oil distillation.

In certain embodiments, the treatment zone carries out asphaltene separation in a manner similar to known solvent deasphalting, or similar to enhanced solvent deasphalting using adsorbent material as shown, for instance, in commonly owned U.S. Pat. No. 7,566,394, which is incorporated by reference herein in its entirety. In these processes, an extract phase is produced containing solvent and deasphalted oil, and a raffinate phase containing asphalt is recovered. These are represented in FIGS. 1A and 1B as the stream 130, the solvent deasphalting extract phase, containing a major portion of the solvent and deasphalted oil, and as the asphalt stream 132, the rejected solvent deasphalting phase. In certain embodiments all or a portion of the asphalt stream 132 can be passed to the gasification zone 136. The asphalt stream 132 can contain a minor portion of solvent, which can remain with the asphalt (for instance for separation at a later stage) or can be separated and recycled within the treatment zone 106 (not shown). In further embodiments, substantially all of the solvent that remains in the asphalt phase is removed and recycled within the treatment zone 106 (not shown). In certain embodiments adsorbent material is used to enhance deasphalting, similar to the process and system described in U.S. Pat. No. 7,566,394, wherein the asphalt stream 132 contains the adsorbent material; in these embodiments all or a portion of the asphalt stream 132 can be passed to the gasification zone 136, in particular membrane wall type gasifiers. The combined solvent and deasphalted oil mixture, stream 130, is passed to the hydroprocessing zone for refining and cracking. In certain embodiments, less than a minor portion of the solvent that remains in stream 130 is recycled within the treatment zone 106. In other embodiments, less than 10, 7, 5, or 1 wt % of the solvent that remains in stream 130 is recycled within the treatment zone 106. In further embodiments, there is no step of solvent separation whereby the entirety of the solvent that remains in stream 130 is routed to the hydroprocessing zone 108 with the deasphalted oil. Furthermore, in certain embodiments the only source of solvent used in the treatment zone 106 is the naphtha stream 114 obtained from the separation zone 104. In further embodiments the only source of solvent used in the treatment zone 106 is the stream 114*a*, which is the portion of naphtha stream 114 obtained from the separation zone 104, wherein stream 114*a* can be full range naphtha or light naphtha as described herein. In additional embodiments, the only sources of solvent used in the treatment zone 106 are from the separation zone 104, stream 114 or 114*a*, the hydrocracked naphtha stream 124*a* from the hydrocracker effluent naphtha (wherein stream 124*a* can be a full range hydrocracked naphtha stream or a light hydrocracked naphtha stream), or a combination thereof.

In other embodiments, in combination with asphaltene separation by solvent deasphalting, or as a standalone process, asphaltene reduction is carried out by an adsorbent treatment process, for instance, in one or more arrangements similar to those shown in commonly owned U.S. Pat. Nos. 7,763,163 and 7,867,381, 7,799,211 and 8,986,622, which are incorporated by reference herein in their entireties. For instance, in certain embodiments, naphtha or light naphtha from the crude oil distillation and/or hydrocracking unit is used as the solvent for desorption of adsorbent used for asphaltene reduction of atmospheric residue and/or vacuum residue, wherein the adsorbent treatment is followed by atmospheric and vacuum separation of the bottoms and adsorbent material. The atmospheric residue and/or vacuum residue is mixed with adsorbent material, and the mixture is passed to an atmospheric separation zone. The oil and adsorbent material are contacted under conditions effective for adsorption of asphaltenes and other contaminants. Atmospheric distillates are removed and passed to the hydroprocessing zone 108. Bottoms from the atmospheric separation zone containing adsorbent material are passed to a vacuum separation zone. Vacuum distillates are removed and passed to the hydroprocessing zone 108. Bottoms from the vacuum separation zone containing adsorbent material is passed to a filtration/regeneration zone. The adsorbent material is partially regenerated by solvent desorption using naphtha or light naphtha from the crude oil distillation and/or hydrocracking unit. In these processes, the stream 130 that is routed to the hydroprocessing zone 108 includes adsorbent-treated components from the atmospheric distillates and vacuum distillates, and also a solvent/solute component including the solvent and the compounds dissolved therein from the adsorbent material, including asphaltenes and resins, particularly those containing nitrogen.

In other embodiments, naphtha or light naphtha from the crude oil distillation and/or hydrocracking unit is used as the solvent for desorption of adsorbent used for asphaltene reduction of atmospheric residue and/or vacuum residue. The feed is passed through at least one packed bed column containing adsorbent material, or is mixed with adsorbent material and passed through a slurry column. Asphaltene and other contaminants are adsorbed. The adsorbent-treated atmospheric residue and/or vacuum residue is recovered as part of the stream that is passed to the hydroprocessing zone 108. The adsorbent material is partially regenerated by solvent desorption using naphtha or light naphtha from the crude oil distillation and/or hydrocracking unit. In these processes, the stream 130 that is routed to the hydroprocessing zone 108 includes the adsorbent-treated component, the discharged atmospheric residue and/or vacuum residue, and also a solvent/solute component including the solvent and the compounds dissolved therein from the adsorbent material, including asphaltenes and resins, particularly those containing nitrogen.

In the above embodiments using adsorption treatment with internal naphtha desorption treatments, the stream 132 contains the adsorbent material having asphaltenes adsorbed thereon or therein. In certain embodiments all or a portion of the asphaltene-loaded adsorbent stream 132 can be passed to the gasification zone 136. In certain embodiments, less than a minor portion of the total amount of solvent used for desorption is recycled within the treatment zone 106, that is, within the filtration/regeneration step of the treatment zone 106. In other embodiments, less than 10, 7, 5, or 1 wt % of the total amount of solvent used for desorption is recycled within the treatment zone 106. In further embodiments, there is no step of solvent separation whereby the entirety of the solvent used for desorption is routed to the hydroprocessing zone 108 with the solute component. Furthermore, in certain embodiments the only source of solvent used in the treatment zone 106 for desorption is the naphtha stream 114 obtained from the separation zone 104. In further embodiments the only source of solvent used in the treatment zone 106 for desorption is the stream 114*a*, which is the portion of naphtha stream 114 obtained from the separation zone 104, wherein stream 114*a* can be full range naphtha or light naphtha as described herein. In additional embodiments, the only sources of solvent used in the treatment zone 106 for desorption are from the separation zone 104, stream 114 or 114*a*, and the hydrocracked naphtha stream 124*a* from the hydrocracker effluent naphtha, wherein stream 124*a* can be a full range hydrocracked naphtha stream or a light hydrocracked naphtha stream.

The treated residue fraction 130 (in certain embodiments comprising a mixture of naphtha and the treated atmospheric residue and/or treated vacuum residue), the middle distillate fraction 116, and in certain embodiments stream 114*b* from naphtha 114 derived from separation zone 104, are sent to the distillates hydroprocessing zone 108 for refining and cracking. The distillates hydroprocessing zone 108 can be any suitable configuration to achieve the desired degree of refining and conversion, such as a once-thru (single reactor) or series flow (two or more reactors) configuration, or two stage (two or more reactors) configuration, containing single or multiple catalysts designed for hydrodemetallization, hydrodesulfurizati on, hydrodenitrogenation, hydrogenation and hydrocracking. The charge to the hydroprocessing zone 108 is desulfurized and denitrogenated to remove the heteroatom containing hydrocarbons. For example, the charge can be desulfurized for 99, 95 or 99 W % sulfur reduction. In addition, heavier molecules are cracked in the presence of hydrogen to form lighter molecules to produce hydrocarbons fractions, for instance, suitable for transportation fuels. In certain embodiments catalysts that are effective for hydrotreating and hydrocracking deasphalted oil and/or vacuum gas oil are used. Note that while one inlet is shown in FIGS. 1A and 1B, plural inlets can be provided, for instance, to receive the different streams at different locations within the hydroprocessing zone or at a different level within a reactor.

In certain embodiments, reaction products are separated (not shown) within the DAO/distillates hydroprocessing zone 108. As shown in FIGS. 1A and 1B, outlets are provided for discharging a light gases stream 122, a hydrocracked naphtha stream 124, a hydrocracked diesel stream 126, and an unconverted oil stream 128. In certain embodiments, the entire effluent from the reaction zones within the DAO/distillates hydroprocessing zone 108, or the entire liquid effluent, can be discharged as a single feed, for instance, as a synthetic crude oil product stream (not shown in FIGS. 1A and 1B). In certain embodiments, hydroprocessed effluents from the hydroprocessing zone 108 are used to obtain a bottomless synthetic oil product that contains at least the contents of streams 126 and 128. In certain embodiments, using advanced and recently developed hydroprocessing catalyst for deasphalted oil and/or vacuum gas oil, in conjunction with other optimized parameters, a bottomless synthetic oil product can be recovered having a sulfur level of less than 100, 50 or 20 ppmw, and wherein the API gravity of the synthetic crude oil is at least 8, 10 or 12 degrees higher than that of the initial feedstock. By removal of asphaltenes, which contains metals such as nickel and vanadium, and heavy poly-nuclear aromatics, catalyst lifetime in the hydroprocessing zone can be improved.

In certain embodiments, the asphalt stream 132 is processed in the gasification zone 136. The produced hydrogen 140 can advantageously be supplied to the hydroprocessing zone 108. In addition, the produced steam 138 can be used as a utility stream for various purposes within the integrated system 102. In certain embodiments hydrogen from gasifying is the only source of hydrogen for hydroprocessing when equilibrium is reached.

In an embodiment of a process employing the arrangements shown in FIG. 1A or 1B, a hydroprocessing zone 108 is integrated that is effective for hydroprocessing the combined feeds, which in certain embodiments is in the full range of crude oil, with asphaltenes removed disclosed herein. For example, hydroprocessing zone 108 includes one or more unit operations as described in commonly owned United States Patent Publication Number 2011/0083996 and in PCT Patent Application Publication Numbers WO2010/009077, WO2010/009082, WO2010/009089 and WO2009/073436, all of which are incorporated by reference herein in their entireties. For instance, a hydroprocessing zone 108 can include one or more beds containing an effective amount of hydrodemetallization catalyst, and one or more beds containing an effective amount of hydroprocessing catalyst having hydrodearomatization, hydrodemetallization (HDM), hydrodenitrogenation (HDN), hydrodesulfurization (HDS) and/or hydrocracking functions. In additional embodiments hydroprocessing zone 108 includes more than two catalyst beds. In further embodiments hydroprocessing zone 108 includes plural reaction vessels each containing one or more catalyst beds, e.g., of different function.

Hydroprocessing zone 108 operates under parameters effective to hydrodemetallize, hydrodearomatize, hydrodenitrogenate, hydrodesulfurize and/or hydrocrack the crude oil feedstock. In certain embodiments, hydroprocessing is carried out using the following general conditions: operating temperature in the range of from 300-450° C.; operating pressure in the range of from 30-180 or 70-180 bars; and a liquid hour space velocity in the range of from 0.1-10 $h^{-1}$. In further embodiments, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (standard liters per liter of hydrocarbon feed (SLt/Lt)) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

In certain embodiments, effluents from the hydroprocessing reaction vessels are cooled in an exchanger and sent to a high pressure cold or hot separator. Separator tops are cleaned in an amine unit and the resulting hydrogen rich gas stream is passed to a recycling compressor to be used as a recycle gas in the hydroprocessing reaction zone. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include C1-C4 hydrocarbons, can be conventionally purged from the low pressure cold separator and sent for further processing, such as flare processing or fuel gas processing.

The hydroprocessed effluent contains a reduced content of contaminants (i.e., metals, sulfur and nitrogen), an increased paraffinicity/naphthenicity, reduced BMCI, and an increased American Petroleum Institute (API) gravity. In certain embodiments, selective hydroprocessing or hydrotreating processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenating. In one embodiment, the sequence of catalysts to perform hydrodemetallization and hydrodesulfurization is as follows: (1) A hydrodemetallization catalyst. The catalyst in the HDM section are generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically, the active metals on the catalyst surface are sulfides of Nickel and Molybdenum in the ratio Ni/Ni+Mo<0.15. The concentration of Nickel is lower on the HDM catalyst than other catalysts as some Nickel and Vanadium is anticipated to be deposited from the feedstock itself during the removal, acting as catalyst. The dopant used can be one or more of phosphorus (see, e.g., United States Patent Publication Number US 2005/0211603 which is incorporated by reference herein in its entirety), boron, silicon and halogens. The catalyst can be in the form of alumina extrudates or alumina beads. In certain embodiments alumina beads are used to facilitate un-loading of the catalyst HDM beds in the reactor as the metals uptake will range between 30 to 100% at the top of the bed. (2) An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm. (3) The catalyst in the HDS section can include those having gamma alumina based support materials, with typical surface area towards the higher end of the HDM range, e.g. about ranging from 180-240 $m^2/g$. This required higher surface for HDS results in relatively smaller pore volume, e.g., lower than 1 $cm^3/g$. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85. (4) A final catalyst (which could optionally replace the second and third catalyst) is designed to perform hydrogenation of the feedstock (rather than a primary function of hydrodesulfurization), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$ gr. This required higher surface for HDS results in relatively smaller pore volume, e.g., lower than 1 $cm^3/g$.

Figure 2A:
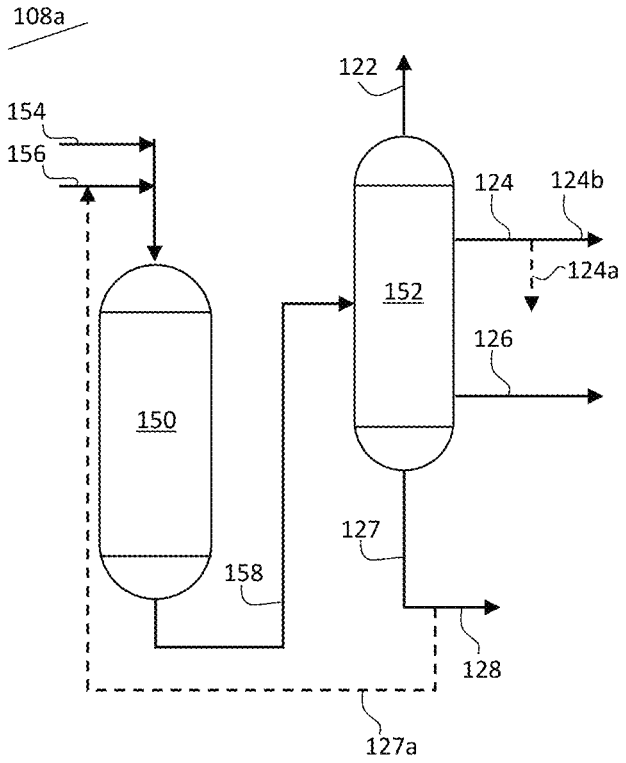
FIGS. 2A, 2B and 2C are schematic diagrams of hydroprocessing sub-systems that are integrated in the systems for upgrading a feedstock.

FIG. 2A is a process flow diagram of an embodiment of an integrated hydroprocessing zone 108*a* including a reaction zone 150 and a fractionating zone 152. Reaction zone 150 generally includes one or more inlets in fluid communication with the feedstocks 154 (including streams 116, 130 and optionally 114*b* as shown in FIGS. 1A and 1B) and a source of hydrogen gas 156. One or more outlets of reaction zone 150 that discharge an effluent stream 158 is in fluid communication with one or more inlets of the fractionating zone 150 (optionally having one or more high pressure and low pressure separation stages therebetween for recovery of recycle hydrogen, not shown). Fractionating zone 152 includes one or more outlets for discharging the light gases stream 122, the hydrocracked naphtha stream 124, the hydrocracked diesel stream 126, and an unconverted oil stream 127. The stream 128 is the unconverted oil that is discharged, which can be all or a portion of stream 127. A suitable portion (V %) of the unconverted oil stream 127, in certain embodiments about 0-10, 0-5, 0-3, 1-10, 1-5 or 1-3, can be discharged as stream 128. In certain optional embodiments, all or a portion of an unconverted oil stream 127 can be recycled to the reaction zone 150 shown as stream 127*a* and/or purged from the system and discharged, shown as stream 128. In embodiments in which unconverted oil stream is recycled to extinction, or substantially recycled to extinction, stream 128 will not be discharged from the system 108*a*, or stream 128 will be a minor portion relative to the total amount of the unconverted oil stream 127.

In operation of the hydroprocessing zone 108*a*, streams 116, 130, and optionally 114*b*, shown as stream 154 in FIG. 2A, and a hydrogen stream 156, are charged to the reaction zone 150. In certain embodiments recycle stream 127*a* is also charged as additional feed. Hydrogen stream 156 an effective quantity of hydrogen to support the requisite degree of hydrotreating and/or hydrocracking, feed type, and other factors, and can be any combination including make-up hydrogen, recycle hydrogen from optional gas separation subsystems (not shown) between reaction zone 150 and fractionating zone 152, and/or derived from fractionator gas stream 122. Reaction effluent stream 158 (optionally after one or more high pressure and low pressure separation stages to recover recycle hydrogen) contains converted, partially converted and unconverted hydrocarbons.

The reaction effluent stream 158 is passed to fractionating zone 152, generally to recover the light gases stream 122, the hydrocracked naphtha stream 124, the hydrocracked diesel stream 126, and the unconverted oil stream 127. In certain embodiments, a portion 124*a* of the hydrocracked naphtha stream 124 is routed to the treatment zone 106 as deasphalting solvent and/or as desorbing solvent. A portion 124*b* is recovered, for instance for further refinery operations. The portions 124*a*, 124*b* can be divided (on a volume or weight basis, for example, with a diverter, not shown) so that the same boiling range hydrocracked naphtha fraction is passed to the treatment zone 106 as solvent 124*a* and recovered as a hydrocracked naphtha portion 124*b*, in different or the same proportions. In additional embodiments the portions 124*a* and 124*b* are different boiling range naphtha fractions and are separated by fractionating. For instance, streams 124*a* and 124*b* can be separate draws from the hydrocracker fractionating column (not shown), with stream 124*a* being a light naphtha stream and stream 124*b* being a heavy naphtha stream.

Reaction zone 150 can contain one or more fixed-bed, ebullated-bed, slurry-bed, moving bed, continuous stirred tank (CSTR), or tubular reactors, in series and/or parallel arrangement, which can operate in batch, semi-batch or continuous modes. The reactor(s) are generally operated under conditions effective for the desired level of treatment, degree of conversion, type of reactor, the feed characteristics, and the desired product slate. In certain embodiments the reactors operate to reduce the sulfur and nitrogen concentrations in the effluent to at least about 75, 80 or 90 W % relative to the levels of sulfur and nitrogen in the feed. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (standard liters per liter of hydrocarbon feed (SLt/Lt)) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

Figure 2B:
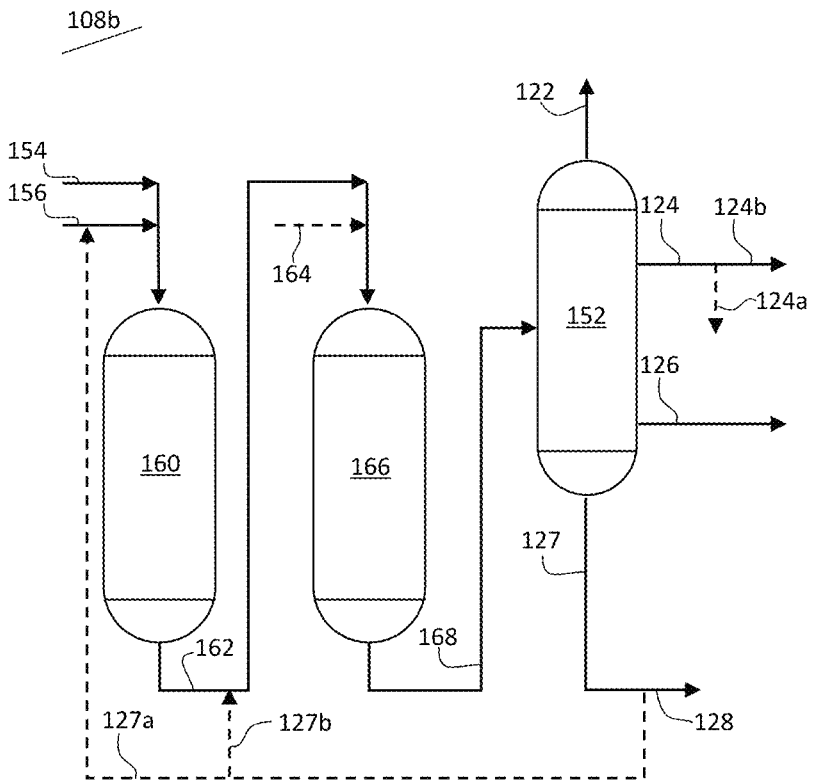

FIG. 2B is a process flow diagram of an embodiment of an integrated hydroprocessing zone 108*b* which is arranged as a series-flow hydrocracking system. In general, system 108*b* includes a first reaction zone 160, a second reaction zone 166 and a fractionating zone 152. The first reaction zone 160 generally includes one or more inlets in fluid communication with the feedstocks 154 (including streams 116, 130 and optionally 114*b* as shown in FIGS. 1A and 1B) and a source of hydrogen gas 156. One or more outlets of the first reaction zone 160 that discharge effluent stream 162 is in fluid communication with one or more inlets of the second reaction zone 166 and a source of hydrogen gas 164. In certain embodiments, the effluents 162 are passed to the second reaction zone 166 without separation of any excess hydrogen and light gases. In optional embodiments, one or more high pressure and low pressure separation stages are provided between the first and second reaction zones 160, 166 for recovery of recycle hydrogen (not shown). The second reaction zone 166 generally includes one or more inlets in fluid communication with one or more outlets of the first reaction zone 160 and the source of additional hydrogen gas 164. One or more outlets of the second reaction zone 166 that discharge effluent stream 168 are in fluid communication with one or more inlets of the fractionating zone 152 (optionally having one or more high pressure and low pressure separation stages therebetween for recovery of recycle hydrogen, not shown). Fractionating zone 152 includes one or more outlets for discharging the light gases stream 122, the hydrocracked naphtha stream 124, the hydrocracked diesel stream 126, and an unconverted oil stream 127. The stream 128 is the unconverted oil that is discharged, which can be all or a portion of stream 127. A suitable portion (V %) of the unconverted oil stream 127, in certain embodiments about 0-10, 0-5, 0-3, 1-10, 1-5 or 1-3, can be discharged as stream 128. In certain embodiments, all or a portion of an unconverted oil stream 127 can be recycled to the first reaction zone 160 shown as stream 127*a*, recycled to the second reaction zone 166 shown as stream 127*b*, and/or purged from the system and discharged as stream 128. In embodiments in which unconverted oil stream is recycled to extinction, or substantially recycled to extinction, stream 128 will not be discharged from the system 108*b*, or stream 128 will be a minor portion relative to the total amount of the unconverted oil stream 127.

In operation of the system 108*b*, streams 116, 130, and optionally 114*b*, shown as stream 154 in FIG. 2B, and a hydrogen stream 156 are charged to the first reaction zone 160. In certain embodiments recycle stream 127*a* is also charged as additional feed. Hydrogen stream 156 includes an effective quantity of hydrogen to support the requisite degree of hydrotreating and/or hydrocracking, feed type, and other factors, and can be any combination including make-up hydrogen, recycle hydrogen from optional gas separation subsystems (not shown) between reaction zones 160 and 166, and/or recycle hydrogen from optional gas separation subsystems (not shown) between reaction zone 166 and fractionator 152. First reaction zone 160 operates under effective conditions for production of reaction effluent stream 162 (optionally after one or more high pressure and low pressure separation stages to recover recycle hydrogen) which is passed to the second reaction zone 166, optionally along with additional hydrogen stream 164. Hydrogen stream 164 includes an effective quantity of hydrogen to support the requisite degree of hydrotreating and/or hydrocracking, feed type, and other factors, and can be any combination including make-up hydrogen, recycle hydrogen from optional gas separation subsystems (not shown) between reaction zone 160 and 166, and/or recycle hydrogen from optional gas separation subsystems (not shown) between reaction zone 166 and fractionator 152. Second reaction zone 166 operates under conditions effective for production of the reaction effluent stream 168, which contains converted, partially converted and unconverted hydrocarbons.

The reaction effluent stream 168 is passed to fractionating zone 152, generally to recover the light gases stream 122, the hydrocracked naphtha stream 124, the hydrocracked diesel stream 126, and the unconverted oil stream 128. In certain embodiments, a portion 124*a* of the hydrocracked naphtha stream 124 is routed to the treatment zone 106 as deasphalting solvent and/or as desorbing solvent. A portion 124*b* is recovered, for instance for further refinery operations. The portions 124*a*, 124*b* can be divided (on a volume or weight basis, for example, with a diverter, not shown) so that the same boiling range hydrocracked naphtha fraction is passed to the treatment zone 106 as solvent 124*a* and recovered as a hydrocracked naphtha portion 124*b*, in different or the same proportions. In additional embodiments the portions 124*a* and 124*b* are different boiling range naphtha fractions and are separated by fractionating. For instance, streams 124*a* and 124*b* can be separate draws from the hydrocracker fractionating column (not shown), with stream 124*a* being a light naphtha stream and stream 124*b* being a heavy naphtha stream.

First reaction zone 160 can contain one or more fixed-bed, ebullated-bed, slurry-bed, moving bed, CSTR, or tubular reactors, in series and/or parallel arrangement, which can operate in batch, semi-batch or continuous modes. The reactor(s) are generally operated under conditions effective for the level of treatment and degree of conversion in the first reaction zone 160, the particular type of reactor, the feed characteristics, and the desired product slate. For example, the reactor(s) are generally operated under conditions effective to reduce sulfur to levels below about 1000, 500 or 100 ppmw, and to reduce nitrogen to levels below about 200, 100 or 50 ppmw. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SLt/Lt) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

Second reaction zone 166 can contain one or more fixed-bed, ebullated-bed, slurry-bed, moving bed, CSTR, or tubular reactors, in series and/or parallel arrangement, which can operate in batch, semi-batch or continuous modes. The reactor(s) are generally operated under conditions effective for the level of treatment and degree of conversion in the second reaction zone 166, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SLt/Lt) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

Figure 2C:
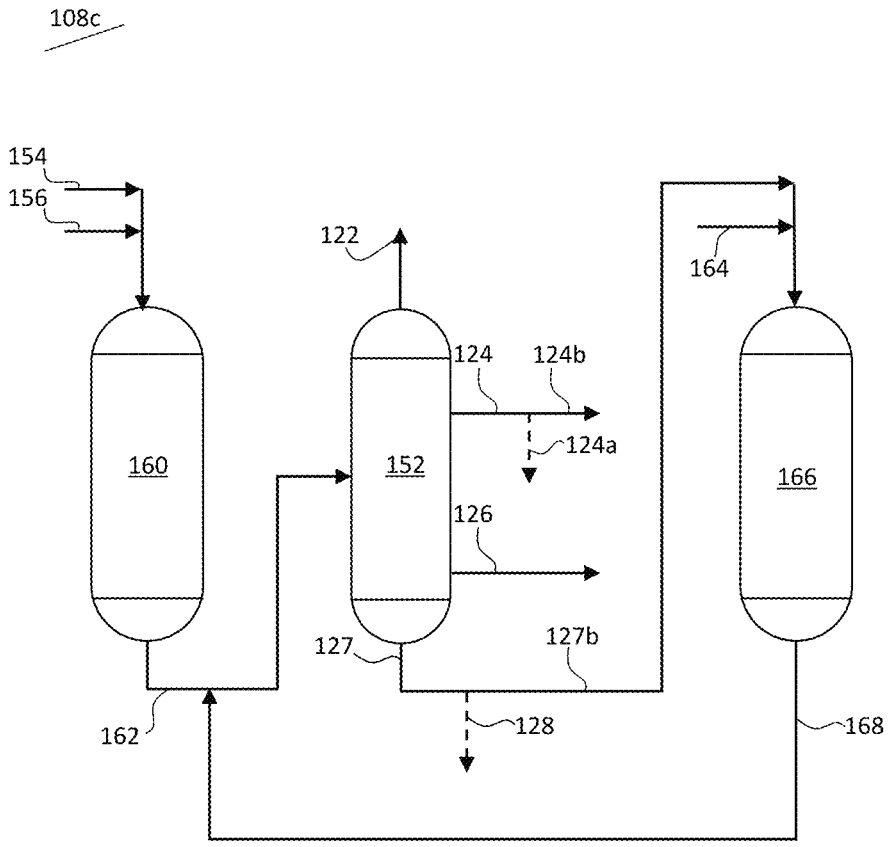

FIG. 2C is a process flow diagram of another embodiment of an integrated hydrocracking unit operation, system 108*c*, which operates as two stage hydrocracking system with recycle. In general, system 108*c* includes a first reaction zone 160, a second reaction zone 166 and a fractionating zone 152. The first reaction zone 160 generally includes one or more inlets in fluid communication with the feedstocks 154 (including streams 116, 130 and optionally 114*b* as shown in FIGS. 1A and 1B) and a source of hydrogen gas 156. One or more outlets of the first reaction zone 160 that discharge effluent stream 162 is in fluid communication with one or more inlets of the fractionating zone 152 (optionally having one or more high pressure and low pressure separation stages therebetween for recovery of recycle hydrogen, not shown). Fractionating zone 152 includes one or more outlets for discharging the light gases stream 122, the hydrocracked naphtha stream 124, the hydrocracked diesel stream 126, and an unconverted oil stream 127. The stream 128 is the unconverted oil that is discharged, which can be all or a portion of stream 127. A suitable portion (V %) of the unconverted oil stream 127, in certain embodiments about 0-10, 0-5, 0-3, 1-10, 1-5 or 1-3, can be discharged as stream 128. In certain embodiments, all or a portion of an unconverted oil stream 127 can be recycled to the first reaction zone 160 shown as stream 127*a*, recycled to the second reaction zone 166 shown as stream 127*b*, and/or purged from the system and discharged as stream 128. In certain embodiments, stream 127*b* comprise at least about 50, 30 or 20 W % relative to stream 127. In embodiments in which unconverted oil stream is recycled to extinction, or substantially recycled to extinction, stream 128 will not be discharged from the system 108*b*, or stream 128 will be a minor portion relative to the total amount of the unconverted oil stream 127. The fractionating zone 152 bottoms outlet is in fluid communication with one or more inlets of the second reaction zone 166 for recycle of stream 127 or a portion 127*b*. One or more outlets of the second reaction zone 166 that discharge effluent stream 168 are in fluid communication with one or more inlets of the fractionating zone 152 (optionally having one or more high pressure and low pressure separation stages therebetween for recovery of recycle hydrogen, not shown).

In operation of the system 108*c*, streams 116, 130, and optionally 114*b*, shown as stream 154 in FIG. 2C, and a hydrogen stream 156 are charged to the first reaction zone 160. In certain embodiments recycle stream 127*a* is also charged as additional feed. Hydrogen stream 154 includes an effective quantity of hydrogen to support the requisite degree of hydrotreating and/or hydrocracking, feed type, and other factors, and can be any combination including make-up hydrogen, recycle hydrogen from optional gas separation subsystems (not shown) between first reaction zone 160 and fractionating zone 152, and/or recycle hydrogen from optional gas separation subsystems (not shown) between second reaction zone 166 and fractionating zone 152. First reaction zone 160 operates under effective conditions for production of reaction effluent stream 162 (optionally after one or more high pressure and low pressure separation stages to recover recycle hydrogen) which is passed to the fractionating zone 152. The fractionation zone 152 generally operates to recover the light gases stream 122, the hydrocracked naphtha stream 124, the hydrocracked diesel stream 126, and the unconverted oil stream 127. In certain embodiments, a portion 124*a* of the hydrocracked naphtha stream 124 is routed to the treatment zone 106 as deasphalting solvent and/or as desorbing solvent. A portion 124*b* is recovered, for instance for further refinery operations. The portions 124*a*, 124*b* can be divided (on a volume or weight basis, for example, with a diverter, not shown) so that the same boiling range hydrocracked naphtha fraction is passed to the treatment zone 106 as solvent 124*a* and recovered as a hydrocracked naphtha portion 124*b*, in different or the same proportions. In additional embodiments the portions 124*a* and 124*b* are different boiling range naphtha fractions and are separated by fractionating. For instance, streams 124*a* and 124*b* can be separate draws from the hydrocracker fractionating column (not shown), with stream 124*a* being a light naphtha stream and stream 124*b* being a heavy naphtha stream. The stream 127*b* from the fractionator bottoms stream 127 is passed to the second reaction zone 166, along with hydrogen 164. Hydrogen stream 164 includes an effective quantity of hydrogen to support the requisite degree of hydrotreating and/or hydrocracking, feed type, and other factors, and can be any combination including make-up hydrogen, recycle hydrogen from optional gas separation subsystems (not shown) between first reaction zone 160 and fractionating zone 152, and/or recycle hydrogen from optional gas separation subsystems (not shown) between second reaction zone 166 and fractionating zone 152. Second reaction zone 166 operates under conditions effective for production of the reaction effluent stream 168, which contains converted, partially converted and unconverted hydrocarbons and is recycled to the fractionating zone 152, optionally through one or more gas separators to recovery recycle hydrogen and remove certain light gases First reaction zone 160 can contain one or more fixed-bed, ebullated-bed, slurry-bed, moving bed, CSTR, or tubular reactors, in series and/or parallel arrangement, which can operate in batch, semi-batch or continuous modes. The reactor(s) are generally operated under conditions effective for the level of treatment and degree of conversion in the first reaction zone 160, the particular type of reactor, the feed characteristics, and the desired product slate. For example, the reactor(s) are generally operated under conditions effective to reduce sulfur to levels below about 1000, 500 or 100 ppmw, and to reduce nitrogen to levels below about 200, 100, 50 or 10 ppmw. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SLt/Lt) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

The catalyst used in the first reaction zone 160 contains one or more active metal components of metals or metal compounds (oxides or sulfides) selected from the Periodic Table of the Elements IUPAC Groups 6, 7, 8, 9 and 10. In certain embodiments the active metal component is one or more of cobalt, nickel, tungsten and molybdenum, typically deposited or otherwise incorporated on a support, which can be amorphous and/or structured, such as alumina, silica-alumina, silica, titania, titania-silica, titania-silicates, or zeolites.

Second reaction zone 166 can contain one or more fixed-bed, ebullated-bed, slurry-bed, moving bed, CSTR, or tubular reactors, in series and/or parallel arrangement, which can operate in batch, semi-batch or continuous modes. The reactor(s) are generally operated under conditions effective for the level of treatment and degree of conversion in the second reaction zone 166, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SLt/Lt) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2.

The catalyst used in the reaction zone 150 of the hydroprocessing zones 108*a*, or the first reaction zone 160 of the hydroprocessing zones 108*b* or 108*c*, contains one or more active metal components of metals or metal compounds (oxides or sulfides) selected from the Periodic Table of the Elements IUPAC Groups 6, 7, 8, 9 and 10. In certain embodiments the active metal component is one or more of cobalt, nickel, tungsten and molybdenum. The active metal component(s) are typically deposited or otherwise incorporated on a support, which can be amorphous and/or structured, such as alumina, silica alumina, silica, titania, titania-silica, titania-silicate or zeolites. In certain embodiments the reaction zone 150 of the hydroprocessing zones 108*a*, or the first reaction zone 160 of the hydroprocessing zones 108*b* or 108*c*, include plural reactors in series to carry out catalytic functions of demetallization, desulfurization and/or denitrogenation. For instance, if demetallization, desulfurization and denitrogenation are required, a sequence can include a first vessel or bed with HDM catalysts, a second vessel or bed with HDM, HDS and HDN catalysts (particles with combined functionality or separate particles), and a third bed with HDS and HDN catalysts (particles with combined functionality or separate particles).

The catalyst used in the second reaction zone 166 contains one or more active metal components of metals or metal compounds (oxides or sulfides) selected from the Periodic Table of the Elements IUPAC Groups 6, 7, 8, 9 and 10. In certain embodiments the active metal component is one or more of cobalt, nickel, tungsten and molybdenum. In embodiments in which the first reaction zone reduces contaminants such as sulfur and nitrogen, so that hydrogen sulfide and ammonia are minimized in the second reaction zone, active metal components effective as hydrogenation catalysts can include one or more noble metals such as platinum, palladium or a combination of platinum and palladium. The active metal component(s) are typically deposited or otherwise incorporated on a support, which can be amorphous and/or structured, such as alumina, silica-alumina, silica, titania, titania-silica, titania-silicates, or zeolites. In certain embodiments zeolites are modified, for instance, by steam, ammonia treatment and/or acid washing, and wherein transition metals are inserted into the zeolite structure, for example, as disclosed in U.S. Pat. Nos. 9,221,036 and 10,081,009, which are incorporated herein by reference in their entireties, where modified USY zeolite supports having one or more of Ti, Zr and/or Hf substituting the aluminum atoms constituting the zeolite framework thereof is disclosed.

The treatment zone 106 advantageously minimizes or eliminates the conventional catalyst deactivation problems associated with heavy oil hydroprocessing by asphaltene and/or contaminant removal. In certain embodiments the asphalt fraction, which contains a majority of process reject materials, is separated from a feed such as crude oil. The treated oil such as deasphalted oil, which is almost free of process reject materials, is hydroprocessed.

Figure 3A:
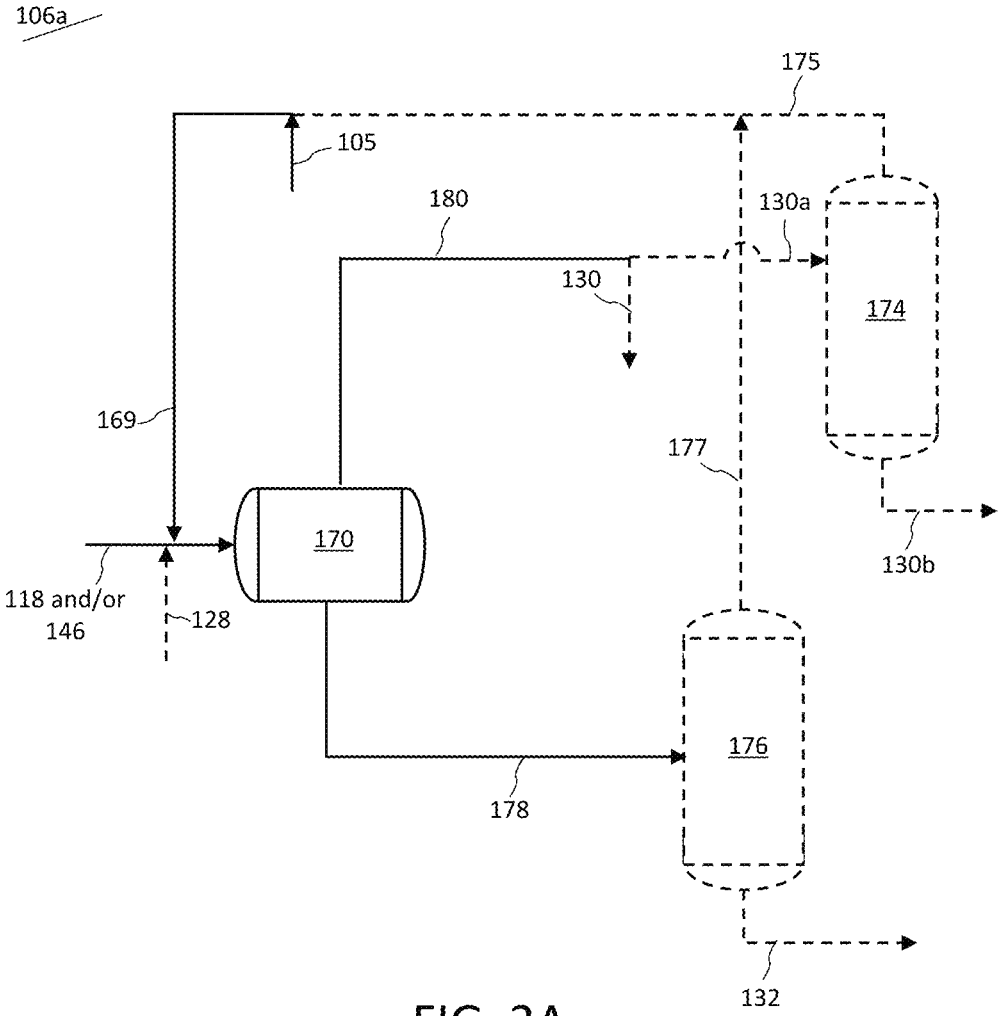
FIGS. 3A, 3B, 3C, 3D, 3E, 3F and 3G are schematic diagrams of sub-systems for removal of asphaltenes and/or contaminants that are integrated in the systems for upgrading a feedstock.

FIG. 3A schematically depicts an embodiment of a treatment 106*a* which is an asphaltene separation zone that operates as a modified solvent deasphalting unit that can be integrated with the herein processes and systems 102*a*, 102*b*, as the treatment 106, or in combination with another treatment step as part of the treatment zone 106 The asphaltene separation zone 106*a* receives a feedstream of atmospheric residue 118 and/or vacuum residue 146, and in certain embodiments all or a portion of unconverted oil 128. The asphaltene separation zone 106*a* generally produces deasphalted oil, shown in FIG. 3A as and either or both of a deasphalted oil stream 130 which contains solvent and deasphalted oil, or a deasphalted oil stream 130*b* having solvent removed for recycle. In addition asphalt is discharged from the asphaltene separation zone 106*a* via an asphaltene-rich and/or contaminant-rich stream 132 (the asphaltene-rich stream 132). The treatment zone 106*a* includes a phase separation zone 170. In certain optional embodiments, a solvent-deasphalted oil separation zone 174 is included for partial or total recycle of solvent from the phase separation zone 170. In other optional embodiments, a solvent-asphalt separation zone 176 is included for partial or total recycle of solvent from the asphaltene-rich stream 132.

The phase separation zone 170 includes one or more inlets in fluid communication with sources of feed including the outlet(s) discharging streams 118 and/or 146, and optionally the outlet(s) discharging unconverted oil 128. The first phase separation zone 170 is in fluid communication with a source of solvent, stream 169. The phase separation zone 170 includes, for example, one or more settler vessels suitable to accommodate the mixture of feed and solvent. In certain embodiments the phase separation zone 170 includes necessary components to operate at suitable temperature and pressure conditions to promote solvent-flocculation of solid asphaltenes, such as below the critical temperature and pressure of the solvent, in certain embodiments between the boiling and critical temperature of the solvent, and below the critical pressure. The phase separation zone 170 also includes one or more outlets for discharging an asphalt phase 178, and one or more outlets for discharging a reduced asphalt content phase 180, which is the deasphalted oil phase. In certain embodiments the outlet for discharging the asphalt phase 178 is in fluid communication with a gasification zone described with respect to FIGS. 1A and 1B (or another unit such as a delayed coking unit, or an asphalt pool), and/or is in fluid communication with the optional solvent-asphalt separation zone 176.

In certain optional embodiments the reduced asphalt content phase 180 outlet is in fluid communication with the hydroprocessing zone described with respect to FIGS. 1A and 1B, shown as the combined deasphalted oil stream 130 in FIG. 3A. In certain optional embodiments a solvent-deasphalted oil separation zone 174 is integrated, and includes one or more inlets in fluid communication with the reduced asphalt content phase 180 outlet, shown as stream 130*a* in FIG. 3A. The separation zone 174 contains one or more flash vessels or fractionation units operable to separate solvent and deasphalted oil. The separation zone 174 includes one or more outlets for discharging a solvent stream 175, which is in fluid communication with one or more inlets of the first phase separation zone 170 as recycle, and one or more outlets for discharging deasphalted oil 130*b*. In certain embodiments, the outlet discharging stream 130*b* is in fluid communication with the hydroprocessing zone described with respect to FIGS. 1A and 1B.

In certain optional embodiments a solvent-asphalt separation zone 176 is integrated, and includes one or more inlets in fluid communication with the outlet(s) discharging asphalt stream 178. The separation zone 176 contains one or more flash vessels or fractionation units operable to separate solvent and asphaltic materials, and can include, for instance, necessary heat exchangers to increase the temperature before a separation vessel. Separation zone 176 also includes one or more outlets for discharging a recycle solvent stream 177, which is in fluid communication with the first phase separation zone 170, and an outlet for discharging an asphalt phase, the asphaltene-rich stream 132. In additional embodiments (not shown) all or a portion of the stream 177 from the separation zone 176 can be passed to the hydroprocessing zone 108. In certain embodiments, the outlet discharging the asphaltene-rich stream 132 is in fluid communication with a gasification zone described with respect to FIGS. 1A and 1B, or another unit such as a delayed coking unit, or an asphalt pool.

The solvent stream 169 is derived from one or more solvent sources comprising an integrated process solvent stream 105, optionally one or both of recycle solvent stream 175 and/or recycle solvent stream 177, and in certain embodiments make-up solvent (not shown) which can be those used in typical solvent deasphalting processes such as C3-C7 paraffinic hydrocarbons. The following Table 1 provides critical temperature and pressure data for C3 to C7 paraffinic solvents. In certain embodiments, a solvent drum (not shown) is integrated to receive the sources of recycle and make-up solvent in the solvent deasphalting system. Solvent stream 105 comprises one or more of the aforementioned internal naphtha solvent sources, that is, obtained from stream 114 or stream 114*a*, and in certain embodiments obtained from stream 124 as stream 124*a*, as shown in FIGS. 1A and 1B.

TABLE 1

| Carbon Number | Temperature, ° C. | Pressure, bar |
|---|---|---|
| $C_3$ | 97 | 42.5 |
| $C_4$ | 152 | 38.0 |
| $C_5$ | 197 | 34.0 |
| $C_6$ | 235 | 30.0 |
| $C_7$ | 267 | 27.5 |

In operation of a deasphalting process herein, the feedstream is atmospheric residue 118 and/or vacuum residue 146, and optionally in certain embodiments all or a portion of unconverted oil 128. The feedstream or combined feedstreams, and the solvent stream 169, are mixed, for example using an in-line mixer or a separate mixing vessel (not shown). Mixing can occur as part of the phase separation zone 170 or prior to entering the phase separation zone 170.

The mixture of hydrocarbon and solvent is passed to phase separation zone 170 in which phase separation occurs. The phase separation zone 170 is operable to extract deasphalted oil from the feedstock. The two phases formed in the phase separation zone 170 are an asphalt phase 178 and a primary deasphalted oil phase 180. The temperature at which the contents of the first phase separation zone 170 are maintained is sufficiently low to maximize recovery of the deasphalted oil from the feedstock. In certain embodiments conditions in the phase separation zone 170 are maintained below the critical temperature and pressure of the solvent.

In general, components with a higher degree of solubility in the non-polar solvent will pass with the primary deasphalted oil phase 180. The primary deasphalted oil phase 180 includes a major portion, a significant portion or a substantial portion of the solvent, a minor portion of the asphalt content of the feedstock and a major portion, a significant portion or a substantial portion of the deasphalted oil content of the feedstock. The asphalt phase 178 generally contains a minor portion of the solvent leaves the bottom of the vessel. In certain embodiments, all or any portion of the asphalt stream 178 is passed to the gasification zone described with respect to FIGS. 1A and 1B, or another unit such as a delayed coking unit, or an asphalt pool.

The deasphalted oil phase is discharged as stream 180 from the phase separation zone 170. In conventional solvent deasphalting operations where solvent is substantially recycled, the entire stream 180 is passed to the deasphalted oil separation zone 174 to recover and recycle solvent. In the present arrangement of FIG. 3A, the deasphalted oil separation zone 174 is optional. Accordingly, in certain embodiments, the deasphalted oil stream 130 is drawn from deasphalted oil phase 180. Stream 130 can be all, a substantial portion, a significant portion or a major portion of deasphalted oil phase 180, as the combination of the solvent and the deasphalted oil that is passed to the hydroprocessing zone 108. Any remainder of stream 180 (that is not used as stream 130) can pass as a stream 130*a* for separation of solvent, stream 175, from the deasphalted oil, that can be used for recycle within the asphaltene separation zone 106*a*. When the deasphalted oil separation zone 174 is not used, or only a portion of the stream 180 is passed to the deasphalted oil separation zone 174, all, a major portion, a significant portion or a substantial portion of the solvent used for deasphalting passes to the hydroprocessing zone 108.

In additional embodiments, a stream 130*a* from the deasphalted oil phase 180 is passed to the solvent-deasphalted oil separation zone 174. The stream 130*a* can be all, a substantial portion, a significant portion or a major portion of secondary deasphalted oil phase 173, and any remainder can pass as stream 130. The separation zone 174 generally includes one or more suitable vessels arranged and dimensioned to permit a rapid and efficient flash separation of solvent from deasphalted oil. Solvent is flashed and discharged as the stream 175 for recycle to the phase separation zone 170, in certain embodiments in a continuous operation. A deasphalted oil stream 130*b* from the separation zone can optionally be subjected to steam stripping (not shown) as is conventionally known to recover a steam stripped DAO product stream, and a steam and solvent mixture for solvent recovery. Stream 130*b* is passed to the hydroprocessing zone 108 shown in FIGS. 1A and 1B. In additional embodiments (not shown) all or a portion of the stream 175 from the separation zone 174 can be passed to the hydroprocessing zone 108.

All or any portion of the asphalt stream 178 from phase separation zone 170 can be charged to the optional solvent-asphalt separation zone 176. In conventional operations the separation zone 176 is utilized to recycle solvent. In certain embodiments all or a portion of stream 178 is routed to the solvent-asphalt separation zone 176; any remainder can be discharged and treated as with the asphalt stream. That is, in certain embodiments of the process herein, all or a portion of the stream 178, before separation of solvent, can be passed to the gasification zone 136 show in FIGS. 1A and 1B, or passed to another unit such as a delayed coking unit, or integrated in an asphalt pool. In embodiments in which solvent is recovered from all or a portion of streams 178, 171, the asphalt can optionally be heated in heater (not shown) before being passed to the inlet of separation zone 176. Additional solvent is flashed from separation zone 176 and discharged as a stream 177, for recycle to the phase separation zone 170. A bottoms asphalt phase is shown as the asphaltene-rich stream 132 which is optionally passed from separation zone 176 to a steam stripper (not shown) for steam stripping of the asphalt as conventionally known to recover a steam stripped asphalt phase, and a steam and solvent mixture for solvent recovery. Stream 132 containing precipitated asphaltenes is removed from the solvent deasphalting unit on regular basis to facilitate the deasphalting process, and precipitated asphaltenes can be sent to other refining processes such as gasification zone 136 shown herein, or to another unit such as a delayed coking unit, or integrated in an asphalt pool.

Two stage solvent deasphalting operations are well-known processes in which suitable solvent is used to precipitate asphaltenes from the feed. In general, in a solvent deasphalting zone, a feed is mixed with solvent so that the deasphalted oil is solubilized in the solvent. The insoluble pitch precipitates out of the mixed solution. Separation of the DAO phase (solvent-DAO mixture) and the asphalt/pitch phase typically occurs in one or more vessels or extractors designed to efficiently separate the two phases and minimize contaminant entrainment in the DAO phase. The DAO phase is then heated to conditions at which the solvent becomes supercritical. In typical solvent deasphalting processed, separation of the solvent and DAO is facilitated in a DAO separator. Any entrained solvent in the DAO phase and the pitch phase is stripped out, typically with a low pressure steam stripping apparatus. Recovered solvent is condensed and combined with solvent recovered under high pressure from the DAO separator. The solvent is then recycled back to be mixed with the feed. According to the process herein, steps associated with separation of the solvent and the DAO can be reduced or in certain embodiments eliminated.

Solvent deasphalting is typically carried-out in liquid phase thus the temperature and pressure are set accordingly. There are generally two stages for phase separation in solvent deasphalting. In a first separation stage, the temperature is maintained at a lower level than the temperature in the second stage to separate the bulk of the asphaltenes. The second stage temperature is carefully selected to control the final deasphalted oil quality and quantity. Excessive temperature levels will result in a decrease in deasphalted oil yield, but the deasphalted oil will be lighter, less viscous, and contain less metals, asphaltenes, sulfur, and nitrogen. Insufficient temperature levels have the opposite effect such that the deasphalted yield increases but the product quality is reduced. Operating conditions for solvent deasphalting units are generally based on a specific solvent and charge stock to produce a deasphalted oil of a specified yield and quality. Therefore, the extraction temperature is essentially fixed for a given solvent, and only small adjustments are typically made to maintain the deasphalted oil quality. The composition of the solvent is also an important process variable. Solvents used in typical solvent deasphalting processes include C3-C7 paraffinic hydrocarbons. The solubility of the solvent increases with increasing critical temperature, such that C3<iC4<nC4<iC5, i.e., the solubility of iC5 is greater than that of nC4, which is greater than that of iC4, is greater than that of C3. An increase in critical temperature of the solvent increases the deasphalted oil yield. However, solvents having higher critical temperatures afford less selectivity resulting in lower deasphalted oil quality. Solvent deasphalting units are operated at pressures that are high enough to maintain the solvent in the liquid phase, and are generally fixed and vary with solvent composition. The volumetric ratio of the solvent to the solvent deasphalting unit charge is also important in its impact on selectivity, and to a lesser degree, on the deasphalted oil yield. The major effect of the solvent-to-oil ratio is that a higher ratio results in a higher quality of the deasphalted oil for a fixed deasphalted yield. A high solvent-to-oil ratio is preferred because of better selectivity, but increased operating costs conventionally dictate that ratios be limited to a relatively narrow range. Selection of the solvent is also a factor in establishing operational solvent-to-oil ratios. The necessary solvent-to-oil ratio decreases as the critical solvent temperature increases. The solvent-to-oil ratio is, therefore, a function of desired selectivity, operation costs and solvent selection.

The asphalt phase contains a majority of the process reject materials from the charge, i.e., metals, asphaltenes, Conradson carbon, and is also rich in aromatic compounds and asphaltenes. In addition to the solvent deasphalting operations described herein, other solvent deasphalting operations, although less common, are suitable. For instance, a three-product unit, in which resin, DAO and pitch can be recovered, can be used, where a range of bitumens can be manufactured from various resin/pitch blends.

Figure 3B:
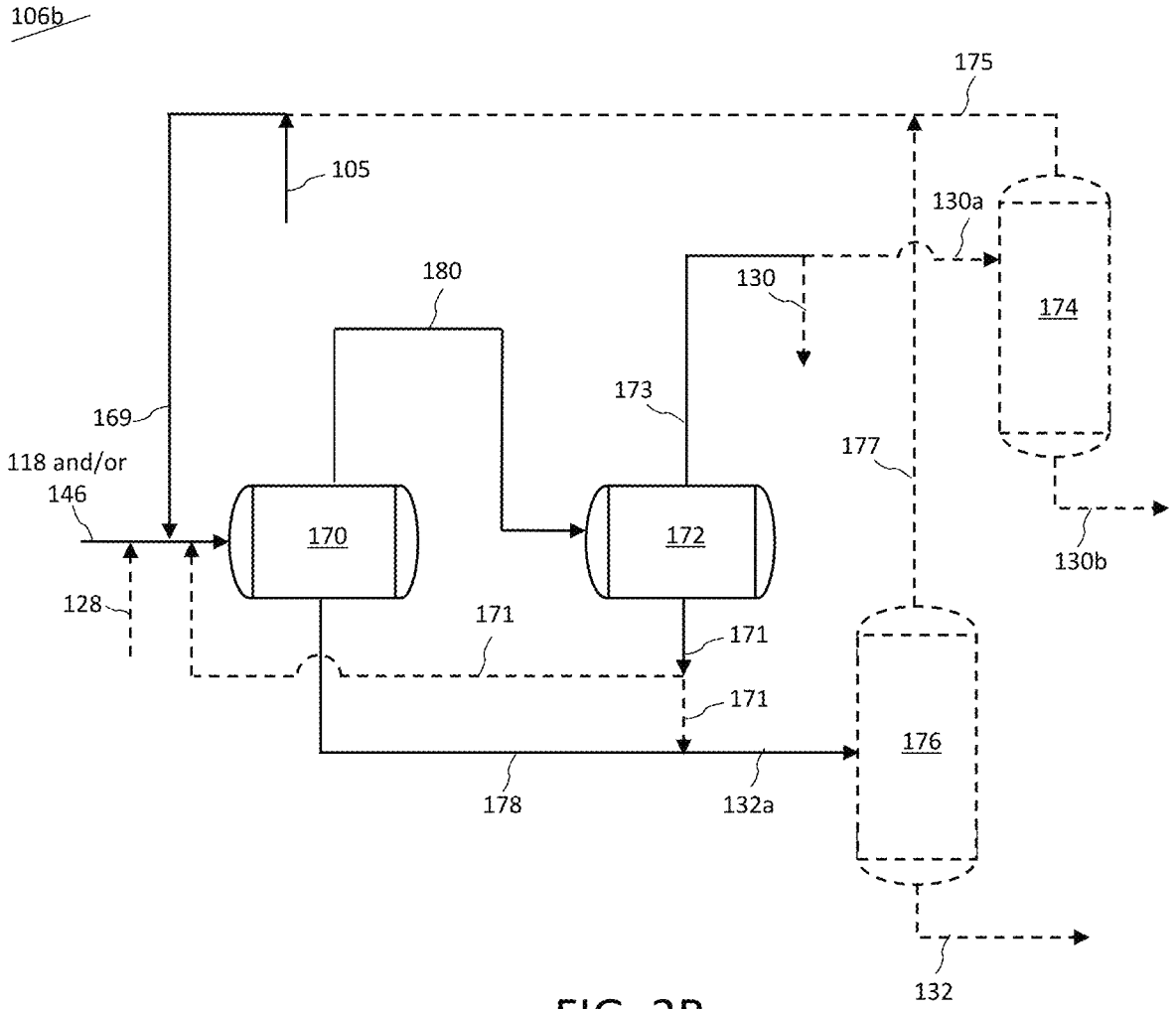

FIG. 3B schematically depicts an embodiment of a treatment zone 106*b* which is an asphaltene separation that operates as a modified solvent deasphalting unit that can be integrated with the herein processes and systems 102*a*, 102*b*, as the an asphaltene separation zone 106, or in combination with another treatment step as part of the treatment zone 106 The asphaltene separation zone 106*b* receives a feedstream of atmospheric residue 118 and/or vacuum residue 146, and in certain embodiments all or a portion of unconverted oil 128. The asphaltene separation zone 106*b* generally produces deasphalted oil, shown in FIG. 3B as either or both of a combined deasphalted oil stream 130 which contains solvent and deasphalted oil, or a deasphalted oil stream 130*b* having solvent removed for recycle. In addition asphalt is discharged from the asphaltene separation zone 106*b* via an asphaltene-rich and/or contaminant-rich stream 132 (the asphaltene-rich stream 132). The asphaltene separation zone 106*b* generally includes a first phase separation zone 170 and a second phase separation zone 172. In certain optional embodiments, a solvent-deasphalted oil separation zone 174 is included for partial or total recycle of solvent from the first phase separation zone 170. In other optional embodiments, a solvent-asphalt separation zone 176 is included for partial or total recycle of solvent from the second phase separation zone 172.

The first phase separation zone 170 includes one or more inlets in fluid communication with sources of feed including the outlet(s) discharging streams 118 and/or 146, and optionally the outlet(s) discharging unconverted oil 128. The first phase separation zone 170 is in fluid communication with a source of solvent, stream 169. The first phase separation zone 170 includes, for example, one or more primary settler vessels suitable to accommodate the mixture of feed and solvent. In certain embodiments the first phase separation zone 170 includes necessary components to operate at suitable temperature and pressure conditions to promote solvent-flocculation of solid asphaltenes, such as below the critical temperature and pressure of the solvent, in certain embodiments between the boiling and critical temperature of the solvent, and below the critical pressure. The first phase separation zone 170 also includes one or more outlets for discharging a primary asphalt phase 178, and one or more outlets for discharging a reduced asphalt content phase 180, which is the primary deasphalted oil phase. In certain embodiments the outlet for discharging the asphalt phase 178 is in fluid communication with a gasification zone described with respect to FIGS. 1A and 1B (or another unit such as a delayed coking unit, or an asphalt pool), and/or is in fluid communication with the optional solvent-asphalt separation zone 176.

The second phase separation zone 172 includes one or more inlets in fluid communication with the reduced asphalt content phase 180 outlet from the first phase separation zone 170, and includes, for example, one or more secondary settler vessels suitable to accommodate the feed. In certain embodiments the second phase separation zone 172 includes necessary components to operate at temperature and pressure conditions below that of the solvent. The second phase separation zone 172 includes one or more outlets for discharging an asphalt phase 171. In certain embodiments the outlet for discharging the asphalt phase 171 is in fluid communication with a gasification zone described with respect to FIGS. 1A and 1B (or another unit such as a delayed coking unit, or an asphalt pool), the optional solvent-asphalt separation zone 176, the first phase separation zone 170, or any combination thereof. Second phase separation zone 172 also includes one or more outlets for discharging a reduced asphalt content phase stream 173, which is the secondary deasphalted oil phase.

In certain embodiments, the outlet discharging stream 173 is in fluid communication with the hydroprocessing zone described with respect to FIGS. 1A and 1B, shown as the combined deasphalted oil stream 130 in FIG. 3B. In certain optional embodiments a solvent-deasphalted oil separation zone 174 is integrated, and includes one or more inlets in fluid communication with the reduced asphalt content phase 173 outlet, shown as stream 130*a*. The separation zone 174 contains one or more flash vessels or fractionation units operable to separate solvent and deasphalted oil. The separation zone 174 includes one or more outlets for discharging a solvent stream 175, which is in fluid communication with one or more inlets of the first phase separation zone 170, and one or more outlets for discharging deasphalted oil 130*b*. In certain embodiments, the outlet discharging stream 130*b* is in fluid communication with the hydroprocessing zone described with respect to FIGS. 1A and 1B.

In certain optional embodiments a solvent-asphalt separation zone 176 is integrated, and includes one or more inlets in fluid communication with the outlet(s) discharging asphalt streams 178 and/or 171. The separation zone 176 contains one or more flash vessels or fractionation units operable to separate solvent and asphaltic materials, and can include, for instance, necessary heat exchangers to increase the temperature before a separation vessel. Separation zone 176 also includes one or more outlets for discharging a recycle solvent stream 177, which is in fluid communication with the first phase separation zone 170, and an outlet for discharging an asphalt phase, the asphaltene-rich stream 132. In certain embodiments, the outlet discharging the asphaltene-rich stream 132 is in fluid communication with a gasification zone described with respect to FIGS. 1A and 1B, or another unit such as a delayed coking unit, or an asphalt pool.

The solvent stream 169 is derived from one or more solvent sources comprising an integrated process solvent stream 105, optionally one or both of recycle solvent stream 175 and/or recycle solvent stream 177, and in certain embodiments make-up solvent (not shown) which can be those used in typical solvent deasphalting processes such as C3-C7 paraffinic hydrocarbons, for example having critical temperature and pressure data indicated in Table 1 above. In certain embodiments, a solvent drum (not shown) is integrated to receive the sources of recycle and make-up solvent in the solvent deasphalting system. Solvent stream 105 comprises one or more of the aforementioned internal naphtha solvent sources, that is, obtained from stream 114 or stream 114*a*, and in certain embodiments obtained from stream 124 as stream 124*a*, as shown in FIGS. 1A and 1B.

In operation of a deasphalting process herein, the feedstream is atmospheric residue 118 and/or vacuum residue 146, and optionally in certain embodiments all or a portion of unconverted oil 128. The feedstream or combined feedstreams, and the solvent stream 169, are mixed, for example using an in-line mixer or a separate mixing vessel (not shown). Mixing can occur as part of the first phase separation zone 170 or prior to entering the first phase separation zone 170. The volumetric ratio of the solvent in stream 169 to the feedstream (V/V) in the asphaltene separation zone 106*b* is in the range of about 2:1 to 1:30, 2:1 to 1:10, 2:1 to 1:8, 2:1 to 1:5, 2:1 to 1:2, 1:1 to 1:30, 1:1 to 1:10, 1:1 to 1:8 or 1:1 to 1:5.

The mixture of hydrocarbon and solvent is passed to first phase separation zone 170 in which phase separation occurs. First phase separation zone 170 serves as the first stage for the extraction of deasphalted oil from the feedstock. The two phases formed in the first phase separation zone 170 are an asphalt phase 178 and a primary deasphalted oil phase 180. The temperature at which the contents of the first phase separation zone 170 are maintained is sufficiently low to maximize recovery of the deasphalted oil from the feedstock. In certain embodiments conditions in the first phase separation zone 170 are maintained below the critical temperature and pressure of the solvent.

In general, components with a higher degree of solubility in the non-polar solvent will pass with the primary deasphalted oil phase 180. The primary deasphalted oil phase 180 includes a major portion, a significant portion or a substantial portion of the solvent, a minor portion of the asphalt content of the feedstock and a major portion, a significant portion or a substantial portion of the deasphalted oil content of the feedstock. The asphalt phase 178 generally contains a minor portion of the solvent leaves the bottom of the vessel. In the second phase separation zone 172, the deasphalted oil phase from the first phase separation zone 170, which contains some asphalt, enters a separation vessel, for example, a secondary settler. An asphalt phase separates and forms at the bottom of the secondary settler that, due to increased temperature, is approaching the critical temperature of the solvent. The rejected asphalt 171 from the secondary settler contains a relatively small amount of solvent and deasphalted oil. In certain embodiments all or any portion of the asphalt phase 171 is recycled back to first phase separation zone 170 for the recovery of remaining deasphalted oil. In other embodiments all or any portion of the asphalt phase 171 is mixed with asphalt stream 178, as a combined stream 132*a*. In certain embodiments, all or any portion of the asphaltene-rich streams 178, 171, 132*a* and/or 132 is/are passed to the gasification zone described with respect to FIGS. 1A and 1B, or another unit such as a delayed coking unit, or an asphalt pool.

The secondary deasphalted oil phase is discharged as stream 173 from the second phase separation zone 172. In conventional solvent deasphalting operations where solvent is substantially recycled, the entire stream 173 is passed to the deasphalted oil separation zone 174 to recover and recycle solvent. In the present arrangement of FIG. 3B, the deasphalted oil separation zone 174 is optional. Accordingly, in certain embodiments, the deasphalted oil stream 130 is drawn from secondary deasphalted oil phase 173. Stream 130 can be all, a substantial portion, a significant portion or a major portion of secondary deasphalted oil phase 173, as the combination of the solvent and the deasphalted oil that is passed to the hydroprocessing zone 108. Any remainder of stream 180 (that is not used as stream 130) can pass as a stream 130*a* for separation of solvent, stream 175, from the deasphalted oil. When the deasphalted oil separation zone 174 is not used, or only a portion of the stream 173 is passed to the deasphalted oil separation zone 174, all, a major portion, a significant portion or a substantial portion of the solvent used for deasphalting passes to the hydroprocessing zone 108.

In additional embodiments, a stream 130*a* from the secondary deasphalted oil phase 173 is passed to the solvent-deasphalted oil separation zone 174. The stream 130*a* can be all, a substantial portion, a significant portion or a major portion of secondary deasphalted oil phase 173, and any remainder can pass as stream 130. The separation zone 174 generally includes one or more suitable vessels arranged and dimensioned to permit a rapid and efficient flash separation of solvent from deasphalted oil. Solvent is flashed and discharged as the stream 175 for recycle to the first phase separation zone 170, in certain embodiments in a continuous operation. A deasphalted oil stream 130*b* from the separation zone can optionally be subjected to steam stripping (not shown) as is conventionally known to recover a steam stripped DAO product stream, and a steam and solvent mixture for solvent recovery. Stream 130*b* is passed to the hydroprocessing zone 108 shown in FIGS. 1A and 1B. In additional embodiments (not shown) all or a portion of the stream 175 from the separation zone 174 can be passed to the hydroprocessing zone 108.

All or any portion of the asphalt stream 178 from first phase separation zone 170, and/or the asphalt stream 171 from second phase separation zone 172, combined as stream 132*a*, can be charged to the optional solvent-asphalt separation zone 176. In certain embodiments, the asphalt stream 171 is routed to the solvent-asphalt separation zone 176, the first phase separation zone 170, or both the solvent-asphalt separation zone 176 and the first phase separation zone 170. In conventional operations the separation zone 176 is utilized to recycle solvent. In certain embodiments only all or a portion of stream 178 is routed to the solvent-asphalt separation zone 176; in further embodiments only all or a portion of stream 171 is routed to the solvent-asphalt separation zone 176; any remainder can be discharged and treated as with the asphalt stream. That is, in certain embodiments of the process herein, all or a portion of the stream 132*a*, before separation of solvent, can be passed to the gasification zone 136 show in FIGS. 1A and 1B, or passed to another unit such as a delayed coking unit, or integrated in an asphalt pool. In embodiments in which solvent is recovered from all or a portion of streams 178, 171, the asphalt can optionally be heated in heater (not shown) before being passed to the inlet of separation zone 176. Additional solvent is flashed from separation zone 176 and discharged as a stream 177, for recycle to the first phase separation zone 170. In additional embodiments (not shown) all or a portion of the stream 177 from the separation zone 176 can be passed to the hydroprocessing zone 108. A bottoms asphalt phase is shown as the asphaltene-rich stream 132 from separation zone 176 which is optionally passed to a steam stripper (not shown) for steam stripping of the asphalt as conventionally known to recover a steam stripped asphalt phase, and a steam and solvent mixture for solvent recovery. Stream 132, containing precipitated asphaltenes, is removed from the solvent deasphalting unit on regular basis to facilitate the deasphalting process, and precipitated asphaltenes can be sent to other refining processes such as gasification zone 136 shown herein, or to another unit such as a delayed coking unit, or integrated in an asphalt pool.

Figure 3C:
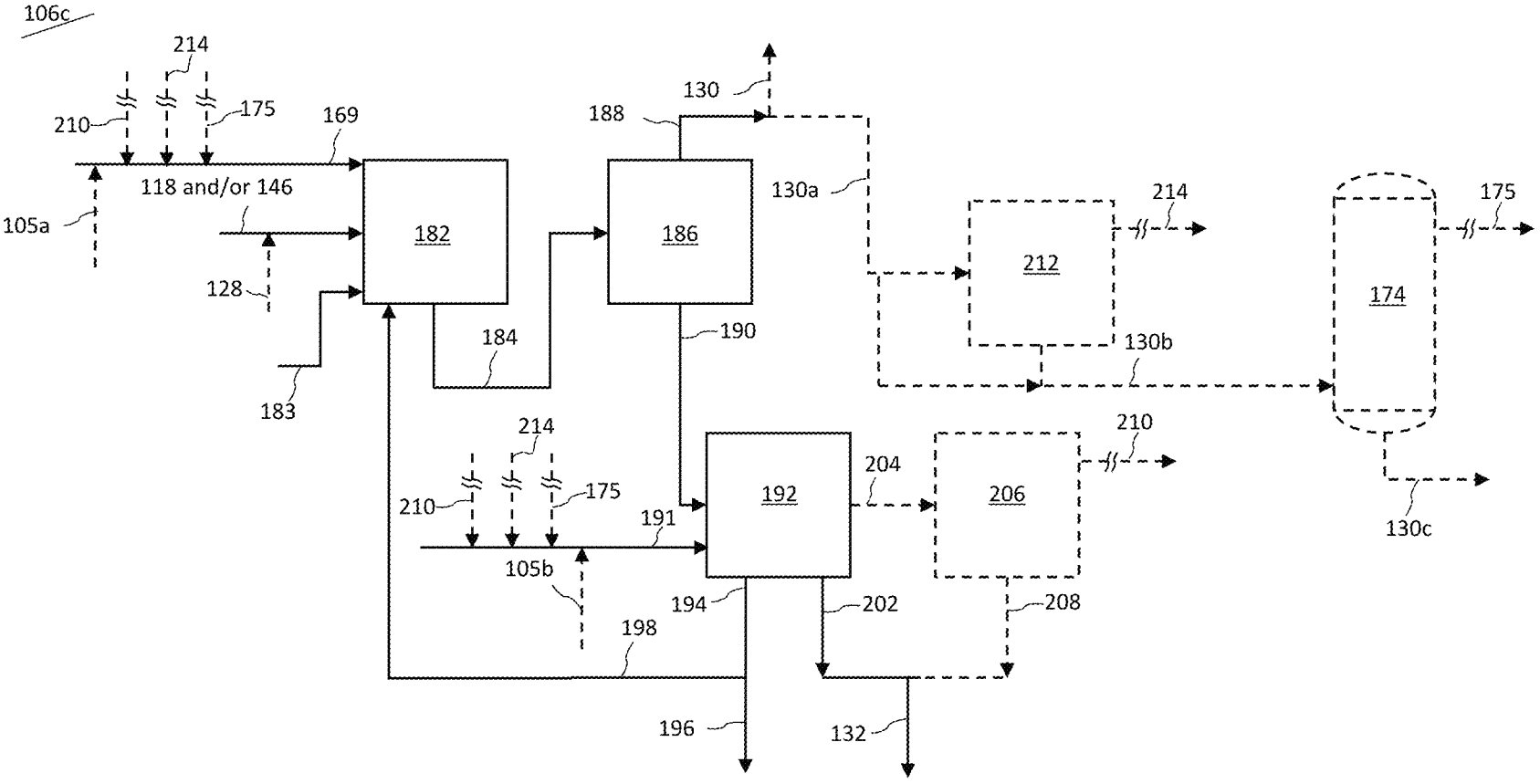

In certain embodiments asphaltene reduction is effectuated by an enhanced solvent deasphalting process, similar to those described in commonly owned U.S. Pat. No. 7,566,394, which is incorporated by reference herein in its entirety. FIG. 3C schematically depicts a treatment zone 106*c* that is an asphaltene and contaminant removal zone which can be integrated with the herein processes and systems 102*a*, 102*b*, as all or part of the treatment zone 106. In general the asphaltene and contaminant removal zone 106*c* receives a feedstream of atmospheric residue 118 and/or vacuum residue 146, and generally produces deasphalted oil, shown in FIG. 3C as one or more of a combined deasphalted and adsorbent-treated stream 130 which contains solvent and deasphalted/adsorbent-treated oil, or a deasphalted and adsorbent-treated oil stream 130*b* or 130*c* having solvent removed for recycle In addition asphalt, process reject materials and spent adsorbent are discharged from the asphaltene and contaminant removal zone 106*c* as an asphaltene-rich and/or contaminant-rich stream 132, and a spent adsorbent discharge 196. The asphaltene and contaminant removal zone 106*c* generally includes a mixing zone 182, a first phase separation zone 186, and an adsorbent stripping zone 192. In certain embodiments, a solvent-asphalt separation zone 206 and/or a second phase separation zone 212 are integrated. In certain optional embodiments, a solvent-deasphalted oil separation zone 174 is included for partial or total recycle of solvent obtained from a solvent-deasphalted oil mixture.

The mixing zone 182 includes one or more inlets in fluid communication with the outlet(s) discharging atmospheric residue 118 and/or vacuum residue 146, and optionally the outlet(s) discharging unconverted oil 128. The mixing zone 182 is also in fluid communication with a source of adsorbent material 183, 198, and a source of deasphalting solvent, stream 169. The mixing zone 182 can be operated as an ebullient bed or fixed-bed reactor, a tubular reactor or a continuous stirred-tank reactor. In certain embodiments mixing zone 182 is equipped with suitable mixing apparatus such as rotary stirring blades or paddles, which provide a gentle, but thorough mixing of the contents. The mixing zone 182 includes one or more outlets for discharging a mixture 184 of the feed, solvent and adsorbent material. In certain embodiments, not shown, mixing can occur in one or more in-line apparatus so that the slurry 184 is formed and send to the first phase separation zone 186.

The slurry 184 outlet is in fluid communication with one or more inlets of the first phase separation zone 186. The first phase separation zone 186 includes, for example, one or more primary settler vessels suitable to accommodate the mixture of feed, solvent and adsorbent material. In certain embodiments the first phase separation zone 186 includes necessary components to operate at temperature and pressure conditions below the critical temperature and pressure of the solvent. The first phase separation zone 186 also includes one or more outlets for discharging a light phase deasphalted and adsorbent-treated stream 188, and one or more outlets for discharging a bottoms phase stream 190. In certain embodiments, the outlet discharging stream 188 is in fluid communication with the hydroprocessing zone described with respect to FIGS. 1A and 1B, shown as the deasphalted and adsorbent-treated stream 130 in FIG. 3C.

In certain optional embodiments a second phase separation zone 212 is integrated and includes one or more inlets in fluid communication with the outlet discharging the deasphalted and adsorbent-treated stream 188, shown as stream 130*a*, for separation of solvent from deasphalted oil. The second phase separation zone 212 includes, for example, one or more settler vessels suitable to accommodate the mixture of deasphalted oil and solvent. The second phase separation zone 212 includes necessary components to operate at suitable temperature and pressure conditions to promote solvent-flocculation of solid asphaltenes, such as below the critical properties of the solvent, in certain embodiments between the boiling and critical temperature of the solvent, and below the critical pressure. Second phase separation zone 212 includes one or more outlets for discharging a recycle solvent stream 214, and one or more outlets for discharging a deasphalted and adsorbent-treated stream 130*b*. In certain embodiments, the outlet discharging the deasphalted and adsorbent-treated stream 130*b* is in fluid communication with the hydroprocessing zone 108 described with respect to FIGS. 1A and 1B. In certain embodiments the recycle solvent stream 214 outlet is in fluid communication with inlet(s) to the mixing zone 182, the adsorbent stripping zone 192, or both the mixing zone 182 and the adsorbent stripping zone 192.

In certain optional embodiments a solvent-deasphalted oil separation zone 174 is integrated for separation of solvent from deasphalted and adsorbent-treated oil (together with separation zone 212, or without using separation zone 212), and includes one or more inlets in fluid communication with the outlet discharging the stream 188, shown as stream 130*a*, and/or in certain embodiments the deasphalted and adsorbent-treated oil stream 130*b* in embodiments in which the second phase separation zone 212 is included. The separation zone 174 contains one or more flash vessels or fractionation units operable to separate solvent and deasphalted oil. The separation zone 174 includes one or more outlets for discharging a solvent stream 175, which is in fluid communication with one or more inlets of the mixing zone 182, and/or the adsorbent stripping zone 192. The separation zone 174 also includes one or more outlets for discharging deasphalted and adsorbent-treated oil 130*c*. In certain embodiments, the outlet discharging stream 130*c* is in fluid communication with the hydroprocessing zone 108 described with respect to FIGS. 1A and 1B.

The bottoms phase stream 190 outlet, and a source of stripping solvent, stream 191, are in fluid communication with one or more inlets of the adsorbent stripping zone 192 to separate and clean the adsorbent material. The adsorbent stripping zone 192 can include one or more filtration vessels, and includes one or more outlets for discharging stripped adsorbent material 194 and one or more outlets for discharging an asphalt stream 202. The adsorbent material 194 outlet is in fluid communication with an inlet of the mixing zone 182 by a recycle stream 198. Spent solid adsorbent material, shown as stream 196, can be discharged. In certain embodiments, the asphalt stream 202 outlet and/or the adsorbent material 194 outlet (via the spent solid adsorbent material stream 196) are in fluid communication with a gasification zone described with respect to FIGS. 1A and 1B (or another unit such as a delayed coking unit, or an asphalt pool).

In certain embodiments the adsorbent stripping zone 192 also includes one or more outlets for discharging a solvent-asphalt mixture 204. In embodiments in which there recycle of all or a portion of the stripping solvent, the solvent-asphalt mixture 204 outlet is in fluid communication with an inlet of the solvent-asphalt separation zone 206, such as a flash vessel or fractionator, to separate solvent. The solvent-asphalt separation zone 206 further includes outlets for discharging an asphalt stream 208 and clean recycle solvent stream 210. In certain embodiments, the asphalt stream 208 outlet is in fluid communication with a gasification zone described with respect to FIGS. 1A and 1B (or another unit such as a delayed coking unit, or an asphalt pool). In certain embodiments the recycle solvent stream 210 outlet is in fluid communication with inlet(s) of the mixing zone 182, the adsorbent stripping zone 192, or both the mixing zone 182 and the adsorbent stripping zone 192.

In general, the deasphalting solvent stream 169 is derived from one or more solvent sources comprising a portion 105*a* of the integrated process solvent stream 105, optionally one or both of recycle solvent stream 210 and/or recycle solvent stream 214 and/or recycle solvent stream 175, and in certain embodiments make-up deasphalting solvent (not shown). In certain embodiments, deasphalting solvent stream 169 comprises sources other than stream 105*a*, such that integrated process solvent is used as stripping solvent, and the solvent stream 169 comprises one or both of recycle solvent stream 210 and/or recycle solvent stream 214, and make-up deasphalting solvent (not shown). Make-up deasphalting solvent (not shown) can be a solvent from another source that is used in typical solvent deasphalting processes such as C3-C7 paraffinic hydrocarbons. In certain embodiments, a solvent drum (not shown) is integrated to receive the sources of recycle and make-up deasphalting solvent in the solvent deasphalting system. Solvent stream 105*a* comprises all or a portion of one or more of the aforementioned internal naphtha solvent sources, that is, streams 114 or stream 114*a*, and in certain embodiments stream 124 or stream 124*a*. The volumetric ratio of the solvent in stream 169 to the feedstream (V/V) in the mixing zone 182 is in the range of about 2:1 to 1:30, 2:1 to 1:10, 2:1 to 1:8, 2:1 to 1:5, 2:1 to 1:2, 1:1 to 1:30, 1:1 to 1:10, 1:1 to 1:8 or 1:1 to 1:5.

In general, the stripping solvent stream 191 can include one or more solvent sources including a portion 105*b* of the integrated process solvent stream 105, optionally one or both of recycle solvent stream 210 and/or recycle solvent stream 210, and in certain embodiments a make-up stripping solvent stream. In certain embodiments, stripping solvent stream 191 comprises sources other than stream 105*b*, such that integrated process solvent is used as deasphalting solvent, and the solvent stream 191 comprises one or both of recycle solvent stream 210 and/or recycle solvent stream 210, and make-up stripping solvent (not shown). In certain embodiments, a solvent drum (not shown) is integrated to receive the sources of recycle and make-up stripping solvent. Solvent stream 105*b* comprises all or a portion of one or more of the aforementioned internal naphtha solvent sources, that is, streams 114*a*, and in certain embodiments stream 124 or stream 124*a*. The mass ratio of the solvent in stream 191 to the adsorbent (W/W) in the adsorbent stripping zone 192 is in the range of about 20:0.1 to 1:1, 20:1 to 1:1, 15:1 to 1:1, 10:1 to 1:1, 20:0.1 to 3:2, 20:1 to 3:2, 15:1 to 3:2, 10:1 to 3:2, 20:0.1 to 2:1, 20:1 to 2:1, 15:1 to 2:1, or 10:1 to 2:1.

In operation of the asphaltene and contaminant removal zone 106*c*, the feedstream is atmospheric residue 118 and/or vacuum residue 146, and optionally in certain embodiments all or a portion of unconverted oil 128. The feedstream or combined feedstreams, adsorbent material 183, and the deasphalting solvent stream 169 are charged to the mixing zone 182 and mixed to provide the slurry 184. The rate of agitation for a given vessel and mixture of adsorbent, solvent and feedstock is selected so that there is minimal, if any, attrition of the adsorbent granules or particles. For example, mixing can be carried out for 30 to 150 minutes. In addition, the feedstream or combined feedstreams, adsorbent material 183, and the deasphalting solvent stream 169 can be mixed in an in-line mixer to produce the slurry 184.

The slurry 184 is passed to the first phase separation zone 186, which operates under temperature and pressure conditions effective to facilitate separation of the feed mixture into an upper layer comprising light and less polar fractions that are removed as stream 188, and the bottoms phase stream 190 comprising asphaltenes and the solid adsorbent. In certain embodiments, vertical flash drum can be utilized for this separation step. Similar to the asphaltene separation zones 106*a* and 106*b* as described in conjunction with FIGS. 3A and 3B, in certain embodiments conditions in the mixing vessel and first phase separation zone are maintained below the critical temperature and pressure of the solvent.

In certain embodiments all of the deasphalted and adsorbent-treated stream 188, or a portion of the stream 188, stream 130 containing solvent and deasphalted oil, is passed to the hydroprocessing zone 108 shown in FIGS. 1A and 1B. In certain embodiments, combined stream 130 is not drawn and stream 130*b* and/or 130*c* having solvent removed therefrom is used as hydroprocessing feed as described herein. In embodiments where a portion of stream 188 is not used directly as hydroprocessing feed, a portion 130*a* is passed through one or more solvent recovery stages (212 and/or 174) to obtain stream 130*b*. In certain embodiments a combination of two or more of streams 130, 130*b* and 130*c* are passed to the hydroprocessing zone 108 shown in FIGS. 1A and 1B. That is, all of the recovered deasphalted oil and solvent stream 188, or a portion 130*a* thereof, can optionally be introduced into a second separation vessel 212 maintained at an effective temperature and pressure to separate solvent from the deasphalted oil, such as between the boiling and critical temperature of the solvent, and below the critical pressure. The solvent stream 214 is recovered and recycled to the mixing zone 182, the adsorbent stripping zone 192, or both the mixing zone 182 and the adsorbent stripping zone 192, in certain embodiments in a continuous operation. In additional embodiments (not shown) all or a portion of the stream 214 from the separation vessel 212 can be passed to the hydroprocessing zone 108. The deasphalted oil stream 130*b* is discharged from the bottom of the vessel 212 and can optionally be passed to a steam stripper (not shown) for steam stripping of the product as is conventionally known to recover a steam stripped DAO product stream, and a steam and solvent mixture for solvent recovery. In certain embodiments, stream 130*a* is not used, or is minimal, and stream 130 is passed to the hydroprocessing zone 108 shown in FIGS. 1A and 1B. In certain embodiments where a portion 130*a* is passed through a solvent recovery stage, stream 130*b* is also passed to the hydroprocessing zone 108 shown in FIGS. 1A and 1B.

In additional embodiments, stream 130*a* and/or 130*b* are passed to the solvent-deasphalted oil separation zone 174. In certain embodiments, the stream 130*a* can be all, a substantial portion, a significant portion or a major portion of light phase stream 188, and any remainder can pass as stream 130. In certain embodiments, the stream 130*b* can be all, a substantial portion, a significant portion or a major portion of effluent from the optional phase separation zone 212, and any remainder can pass as stream 130*b* to the hydroprocessing zone 108 shown in FIGS. 1A and 1B. The separation zone 174 generally includes one or more suitable vessels arranged and dimensioned to permit a rapid and efficient flash separation of solvent from deasphalted oil. Solvent is flashed and discharged as a stream 175, for recycle to the first phase separation zone 170 in certain embodiments in a continuous operation. In additional embodiments (not shown) all or a portion of the stream 175 from the separation zone 174 can be passed to the hydroprocessing zone 108. A deasphalted oil stream 130*c* from the separation zone can optionally be subjected to steam stripping (not shown) as is conventionally known to recover a steam stripped DAO product stream, and a steam and solvent mixture for solvent recovery. Stream 130*c* is passed to the hydroprocessing zone 108 shown in FIGS. 1A and 1B.

The asphalt and adsorbent slurry 190 is mixed with a stripping solvent stream 191 in an adsorbent stripping zone 192 to separate and clean the adsorbent material by solvent desorption. In certain embodiments, the adsorbent slurry and asphalt mixture 190 is washed with two or more aliquots of the solvent 191 in the adsorbent stripping zone 192 in order to dissolve and remove the adsorbed process reject materials. The clean solid adsorbent stream 194 is recovered, and all or a portion 198 is recycled to the mixing zone 182. A portion 196 adsorbent can also be discharged in a continuous, periodic or as-needed manner, for instance, as spent solid adsorbent material. In certain embodiments, an asphalt stream 202 is recovered, and a solvent-asphalt mixture 204 is withdrawn from the adsorbent stripping zone 192. The asphalt stream 202 contains asphaltenes and process reject materials that were desorbed from the adsorbent. In further embodiments (not shown), adsorbent stripping zone 192 can operate to separate the adsorbent material and a solvent-asphalt mixture, without a separate solvent stream, wherein all or a portion of the solvent-asphalt mixture is the stream 132, and can be, for instance, is passed to the gasification zone 136 show in FIGS. 1A and 1B (or another unit such as a delayed coking unit, or an asphalt pool). In embodiments in which solvent is recovered from solvent-asphalt mixture 204, it is sent to separation zone 206 to discharge an asphalt stream 208 and a clean solvent stream 210 which can be recycled to the mixing zone 182, the adsorbent stripping zone 192, or both the mixing zone 182 and the adsorbent stripping zone 192, in certain embodiments in a continuous operation. The asphalt stream 208 contains additional asphaltenes and process reject materials. In additional embodiments (not shown) all or a portion of the stream 210 from the separation zone 206 can be passed to the hydroprocessing zone 108. In embodiments as shown in which the solvent-asphalt mixture is subjected to flashing or fractionation to recover solvent, the asphalt streams 202 and 208 are combined to form asphalt stream 132. Asphalt stream 132 can be sent to other refining processes such as gasification zone 136 shown herein, or to another unit such as a delayed coking unit, or integrated in an asphalt pool.

Figure 3D:
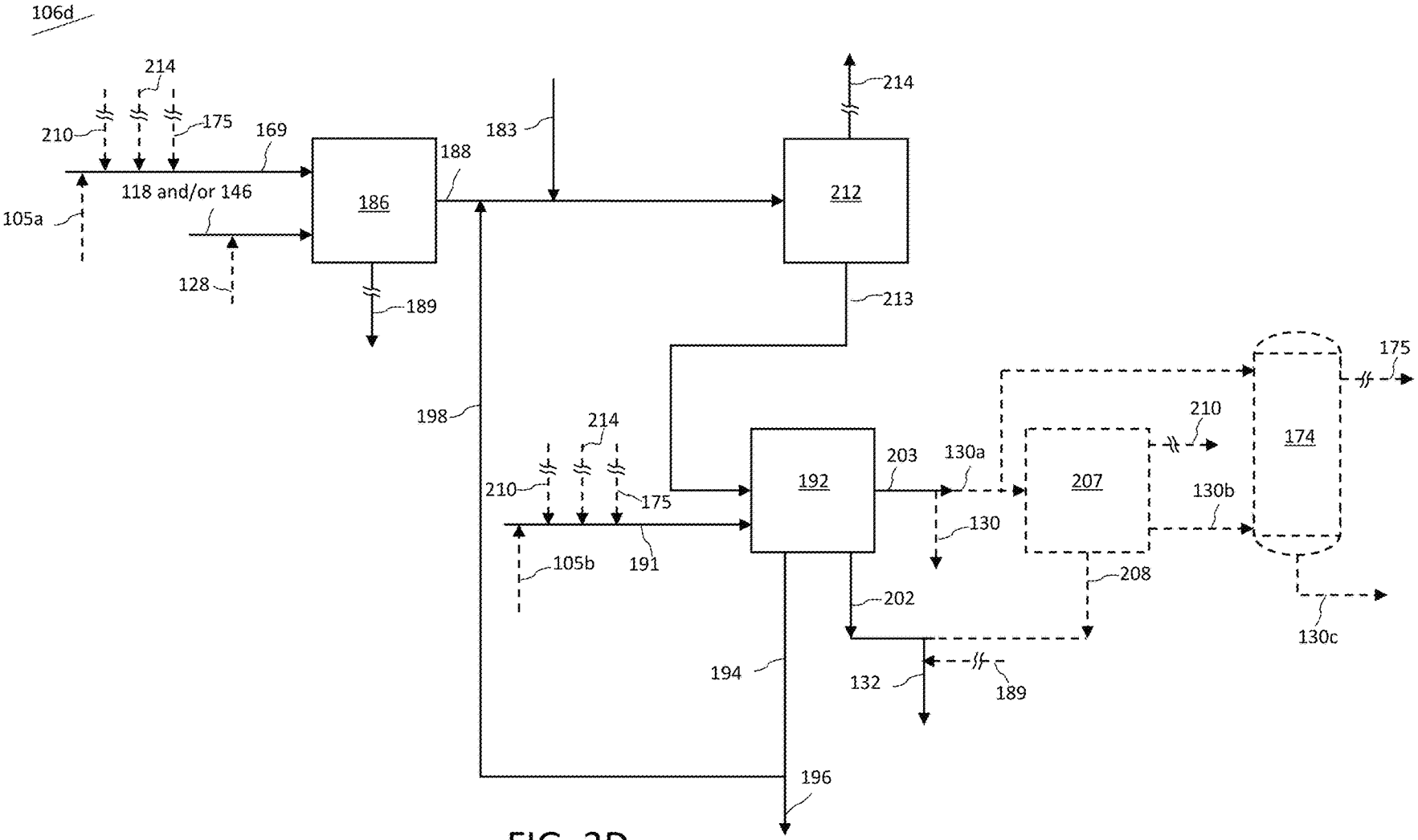

FIG. 3D schematically depicts another embodiment of an asphaltene separation operation, a treatment zone 106*d* that is an asphaltene and contaminant removal zone which can be integrated with the herein processes and systems 102*a*, 102*b*, as all or part of the treatment zone 106. In general the asphaltene and contaminant removal zone 106*d* receives a feedstream of atmospheric residue 118 and/or vacuum residue 146, and generally produces deasphalted oil, shown in FIG. 3D as one or more of a combined deasphalted and adsorbent-treated stream 130 which contains solvent and deasphalted/adsorbent-treated oil, or a deasphalted and adsorbent-treated oil stream 130*b* or 130*c* having solvent removed for recycle In addition asphalt, process reject materials and spent adsorbent are discharged from the asphaltene and contaminant removal zone 106*d* as an primary asphalt stream 189, an asphaltene-rich and/or contaminant-rich stream 132, and a spent adsorbent discharge 196. Zone 106*d* generally includes a first phase separation zone 186, a second phase separation zone 212, and an adsorbent stripping zone 192. In certain embodiments, a separation zone 207 is integrated. In certain optional embodiments, a solvent-deasphalted oil separation zone 174 is included for partial or total recycle of solvent from a solvent-deasphalted oil mixture.

The first phase separation zone 186 includes one or more inlets in fluid communication with the outlet(s) discharging atmospheric residue 118 and/or vacuum residue 146, and optionally the outlet(s) discharging unconverted oil 128. The first phase separation zone 186 is also in fluid communication with a source of deasphalting solvent, stream 169. The first phase separation zone 186 includes, for example, one or more primary settler vessels suitable to accommodate the mixture of feed and solvent. In certain embodiments the first phase separation zone 186 includes necessary components to operate at temperature and pressure conditions to promote solvent-flocculation of solid asphaltenes, such as below the critical temperature and pressure of the solvent, in certain embodiments between the boiling and critical temperature of the solvent, and below the critical pressure. The first phase separation zone 186 also includes one or more outlets for discharging a primary asphalt stream 189 and one or more outlets for discharging a combined deasphalted oil and solvent stream 188. In certain embodiments, the asphalt stream 189 outlet is in fluid communication with a gasification zone described with respect to FIGS. 1A and 1B (or another unit such as a delayed coking unit, or an asphalt pool). In additional embodiments, the asphalt stream 189 outlet can be in fluid communication with a solvent-asphalt separation zone (not shown in FIG. 3D), for example, asphaltene separation zones 106*a* and 106*b* as described in conjunction with FIGS. 3A and 3B.

The second phase separation zone 212 includes one or more inlets in fluid communication with the combined deasphalted oil and solvent stream 188 outlet, and sources of solid adsorbent material 183, 198, to provide contact and residence time with the adsorbent material and to separate solvent from deasphalted oil. The second phase separation zone 212 includes, for example, one or more settler vessels suitable to accommodate the mixture of deasphalted oil and solvent. The second phase separation zone 212 includes necessary components to operate at suitable temperature and pressure conditions, such as below the critical properties of the solvent, in certain embodiments between the boiling and critical temperature of the solvent, and below the critical pressure of the solvent. The second phase separation zone 212 includes one or more outlets for discharging a recycle solvent stream 214, and one or more outlets for discharging a slurry 213 of deasphalted oil and adsorbent material. In certain embodiments the recycle solvent stream 214 outlet is in fluid communication with inlet(s) of the first phase separation zone 186, the adsorbent stripping zone 192, or both the first phase separation zone 186 and the adsorbent stripping zone 192.

The slurry 213 outlet, and a source of stripping solvent stream 191, are in fluid communication with one or more inlets of the adsorbent stripping zone 192, to separate and clean the adsorbent material. The adsorbent stripping zone 192 can include one or more filtration vessels, and includes one or more outlets for discharging stripped adsorbent material 194, one or more outlets for discharging an asphalt stream 202, and one or more outlets for discharging a deasphalted and adsorbent-treated stream 203. The adsorbent material outlet(s) 194 of the adsorbent stripping zone 192 is in fluid communication with the second phase separation zone 212 by a recycle stream 198 of adsorbent material, and spent solid adsorbent material a discharged, shown as stream 196. In certain embodiments, the asphalt stream 202 and/or the spent solid adsorbent material stream 196 are in fluid communication with a gasification zone described with respect to FIGS. 1A and 1B (or another unit such as a delayed coking unit, or an asphalt pool). In certain embodiments, the outlet discharging stream 203 is in fluid communication with the hydroprocessing zone 108 described with respect to FIGS. 1A and 1B, shown as the deasphalted and adsorbent-treated stream 130 in FIG. 3D.

In certain optional embodiments a separation zone 207 is integrated, and includes one or more inlets in fluid communication with the outlet discharging the stream 203, shown as stream 130*a*, for separation of solvent and additional asphalt from deasphalted oil. The separation zone 207 can include one or more settler vessels suitable to accommodate the mixture of deasphalted oil and solvent. The separation zone 207 includes necessary components to operate at suitable temperature and pressure conditions, such as below the critical properties of the solvent, in certain embodiments between the boiling and critical temperature of the solvent, and below the critical pressure of the solvent. Separation zone 207 includes one or more outlets for discharging a recycle solvent stream 210, one or more outlets for discharging a deasphalted and adsorbent-treated stream 130*b*, and one or more outlets for discharging an asphalt stream 208. In certain embodiments, the outlet discharging the deasphalted and adsorbent-treated stream 130*b* is in fluid communication with the hydroprocessing zone described with respect to FIGS. 1A and 1B. In certain embodiments, the outlet discharging the asphalt stream 208 is in fluid communication with a gasification zone described with respect to FIGS. 1A and 1B (or another unit such as a delayed coking unit, or an asphalt pool). In certain embodiments the recycle solvent stream 210 outlet is in fluid communication with inlet(s) of the first phase separation zone 186, the adsorbent stripping zone 192, or both the first phase separation zone 186 and the adsorbent stripping zone 192.

In certain optional embodiments a solvent-deasphalted oil separation zone 174 is integrated for separation of solvent from deasphalted oil (together with separation zone 207, or without using separation zone 207), and includes one or more inlets in fluid communication with the outlet discharging the deasphalted and adsorbent-treated stream 203, shown as stream 130*a*, and/or in certain embodiments the deasphalted and adsorbent-treated oil stream 130*b* in embodiments in which the separation zone 207 is included. The separation zone 174 contains one or more flash vessels or fractionation units operable to separate solvent and deasphalted oil. The separation zone 174 includes one or more outlets for discharging a solvent stream 175, which is in fluid communication with one or more inlets of first phase separation zone 186, and/or the adsorbent stripping zone 192. The separation zone 174 also includes one or more outlets for discharging deasphalted and adsorbent-treated stream 130*c*. In certain embodiments, the outlet discharging stream 130*c* is in fluid communication with the hydroprocessing zone 108 described with respect to FIGS. 1A and 1B.

In general, the deasphalting solvent stream 169 is derived from one or more solvent sources comprising a portion 105*a* of the integrated process solvent stream 105, optionally one or both of recycle solvent stream 210 and/or recycle solvent stream 214 and/or recycle solvent stream 175, and in certain embodiments make-up deasphalting solvent (not shown). In certain embodiments, deasphalting solvent stream 169 comprises sources other than stream 105*a*, such that integrated process solvent is used as stripping solvent, and the solvent stream 169 comprises one or both of recycle solvent stream 210 and/or recycle solvent stream 214, and make-up deasphalting solvent (not shown). Make-up deasphalting solvent (not shown) can be a solvent from another source that is used in typical solvent deasphalting processes such as C3-C7 paraffinic hydrocarbons. In certain embodiments, a solvent drum (not shown) is integrated to receive the sources of recycle and make-up deasphalting solvent in the solvent deasphalting system. Solvent stream 105*a* comprises all or a portion of one or more of the aforementioned internal naphtha solvent sources, that is, streams 114 or stream 114*a*, and in certain embodiments stream 124 or stream 124*a*. The volumetric ratio of the solvent in stream 169 to the feedstream (V/V) in the mixing zone 182 is in the range of about 2:1 to 1:30, 2:1 to 1:10, 2:1 to 1:8, 2:1 to 1:5, 2:1 to 1:2, 1:1 to 1:30, 1:1 to 1:10, 1:1 to 1:8 or 1:1 to 1:5.

In general, the stripping solvent stream 191 can include one or more solvent sources including a portion 105*b* of the integrated process solvent stream 105, optionally one or both of recycle solvent stream 210 and/or recycle solvent stream 210, and in certain embodiments a make-up stripping solvent stream. In certain embodiments, stripping solvent stream 191 comprises sources other than stream 105*b*, such that integrated process solvent is used as deasphalting solvent, and the solvent stream 191 comprises one or both of recycle solvent stream 210 and/or recycle solvent stream 210, and make-up stripping solvent (not shown). In certain embodiments, a solvent drum (not shown) is integrated to receive the sources of recycle and make-up stripping solvent. Solvent stream 105*b* comprises all or a portion of one or more of the aforementioned internal naphtha solvent sources, that is, streams 114 or stream 114*a*, and in certain embodiments stream 124 or stream 124*a*. The mass ratio of the solvent in stream 191 to the adsorbent (W/W) in the adsorbent stripping zone 192 is in the range of about 20:0.1 to 1:1, 20:1 to 1:1, 15:1 to 1:1, 10:1 to 1:1, 20:0.1 to 3:2, 20:1 to 3:2, 15:1 to 3:2, 10:1 to 3:2, 20:0.1 to 2:1, 20:1 to 2:1, 15:1 to 2:1, or 10:1 to 2:1.

In operation of the asphaltene and contaminant removal zone 106*d*, the feedstream is atmospheric residue 118 and/or vacuum residue 146, and optionally in certain embodiments all or a portion of unconverted oil 128. The feedstream or combined feedstreams, adsorbent material 183, and the deasphalting solvent stream 169 are charged to the first phase separation zone 186. The first phase separation zone 186 operates under temperature and pressure conditions effective to facilitate separation of the feed mixture into an upper layer comprising light and less polar fractions that are removed the combined stream 188. The asphalt stream 189 can be combined with other asphalt streams to form stream 132. Conditions in the first separation vessel are maintained below the critical temperature and pressure of the solvent, as described above in the asphaltene separation zones 106*a* and 106*b* as described in conjunction with FIGS. 3A and 3B.

The combined deasphalted oil and solvent stream 188 is discharged from the first phase separation zone 186 and mixed with an effective quantity of solid adsorbent material 183, and recycled adsorbent material 198, for instance using an in-line mixing apparatus and/or a separate mixing zone (not shown) to produce a mixture of deasphalted oil, solvent, and solid adsorbent material, that is passed to the second phase separation zone 212. The mixture is maintained in the second phase separation zone 212 at an effective temperature and pressure to separate solvent from the deasphalted oil, such as between the boiling and critical temperature of the solvent, and below the critical pressure. In addition, the mixture is maintained in the second phase separation zone 212 for a time sufficient to adsorb on the adsorbent material any remaining asphaltenes. The solvent is then separated and recovered from the deasphalted oil and adsorbent material and recycled as stream 214 to the first phase separation zone 186 and/or the adsorbent stripping zone 192. In additional embodiments (not shown) all or a portion of the stream 214 from the separation zone 212 can be passed to the hydroprocessing zone 108.

The slurry 213 of deasphalted oil and adsorbent from the second phase separation zone 212 is mixed with the solvent stream 191 in the adsorbent stripping zone 192 to separate and clean the adsorbent material. In certain embodiments, the adsorbent slurry and deasphalted oil 213 is washed with two or more aliquots of the solvent 191 in the adsorbent stripping zone 192 in order to dissolve and remove the adsorbed compounds. The clean solid adsorbent stream 194 is recovered, and all or a portion 198 is recycled to the second phase separation zone 212. A portion 196 of the adsorbent can also be discharged in a continuous, periodic or as-needed manner, for instance, as spent solid adsorbent material. In certain embodiments, asphalt stream 202 is recovered, and the deasphalted and adsorbent-treated stream 203 is withdrawn from the adsorbent stripping zone 192. The asphalt stream 202 contains asphaltenes and process reject materials that were desorbed from the adsorbent.

In certain embodiments all of the deasphalted and adsorbent-treated stream 203, stream 130 containing solvent and deasphalted oil, is passed to the hydroprocessing zone 108 shown in FIGS. 1A and 1B. In certain embodiments combined stream 130 is not drawn and stream 130*b* and/or 130*c* having solvent removed therefrom is used as hydroprocessing feed. In embodiments where a portion of stream 203 is not used directly as hydroprocessing feed, a portion 130*a* is passed through one or more solvent recovery stages (207 and/or 174) to obtain stream 130*b*. In certain embodiments a combination of two or more of streams 130, 130*b* and 130*c* are passed to the hydroprocessing zone 108. In embodiments in which solvent is recovered from all or a portion of the stream 203, a portion 130*a* it is sent to separation zone 207, or the solvent-deasphalted oil separation zone 174. In embodiments in which the separation zone 207 is used it includes an inlet for receiving the stream 203 or a portion 130*a* thereof, and outlets for discharging an asphalt stream 208, a clean solvent stream 210 which is recycled to adsorbent stripping zone 192, and a deasphalted oil stream 130*b*. In additional embodiments (not shown) all or a portion of the stream 210 from the separation zone 207 can be passed to the hydroprocessing zone 108. The asphalt stream 208 contains additional asphaltenes and process reject materials. In certain embodiments in which a solvent-asphalt separation zone 207 is not used, the stream 130 can be is discharged and is the feed to the hydroprocessing zone described herein, and contains solvent that was used in the adsorbent stripping zone 192. In embodiments in which all of the mixture 203, or a portion 130*a* of the mixture 203, is subjected to fractionation to recover solvent, asphalt streams 202 and 208 are combined to form asphalt stream 132. As noted above, asphalt stream 189 can also contribute to asphalt stream 132 shown in FIGS. 1A and 1B. Asphalt stream 132 can be sent to other refining processes such as gasification zone 136 shown herein, or to another unit such as a delayed coking unit, or integrated in an asphalt pool.

In additional embodiments, stream 130*a* and/or 130*b* are passed to the solvent-deasphalted oil separation zone 174. In certain embodiments, the stream 130*a* can be all, a substantial portion, a significant portion or a major portion of stream 203, and any remainder can pass as stream 130. In certain embodiments, the stream 130*b* can be all, a substantial portion, a significant portion or a major portion of effluent from the optional separation zone 207, and any remainder can pass as stream 130*b* to the hydroprocessing zone 108 shown in FIGS. 1A and 1B. The separation zone 174 generally includes one or more suitable vessels arranged and dimensioned to permit a rapid and efficient flash separation of solvent from deasphalted oil. Solvent is flashed and discharged as a stream 175, for recycle to the first phase separation zone 170 in certain embodiments in a continuous operation. In additional embodiments (not shown) all or a portion of the stream 175 from the separation zone 174 can be passed to the hydroprocessing zone 108. A deasphalted oil stream 130*c* from the separation zone can optionally be subjected to steam stripping (not shown) as is conventionally known to recover a steam stripped DAO product stream, and a steam and solvent mixture for solvent recovery. Stream 130*c* is passed to the hydroprocessing zone 108 shown in FIGS. 1A and 1B.

In certain embodiments asphaltene reduction is effectuated by contacting with an effective type(s) and quantity of adsorbent material, and under effective conditions, to remove asphaltenes and other contaminants including but not limited to nitrogen, sulfur, and polynuclear aromatics. The resulting mixture is then subjected to atmospheric separation to recover an atmospheric light fraction and an atmospheric heavy fraction, with the adsorbent material passing with the heavy fraction. At this stage, asphaltenes from the feed are adsorbed on and/or within the pores of the adsorbent material. The atmospheric heavy fraction is further separated in a vacuum separation zone to recover vacuum light fraction and a vacuum heavy fraction, with the adsorbent material passing with the heavy fraction. The adsorbent material is regenerated using one or more internal solvent sources as described herein, and recycled for contacting with the feed. An example of a process and system that can be integrated in this manner is disclosed in commonly owned U.S. Pat. Nos. 7,799,211 and 8,986,622, which are incorporated herein in their entireties.

Figure 3E:
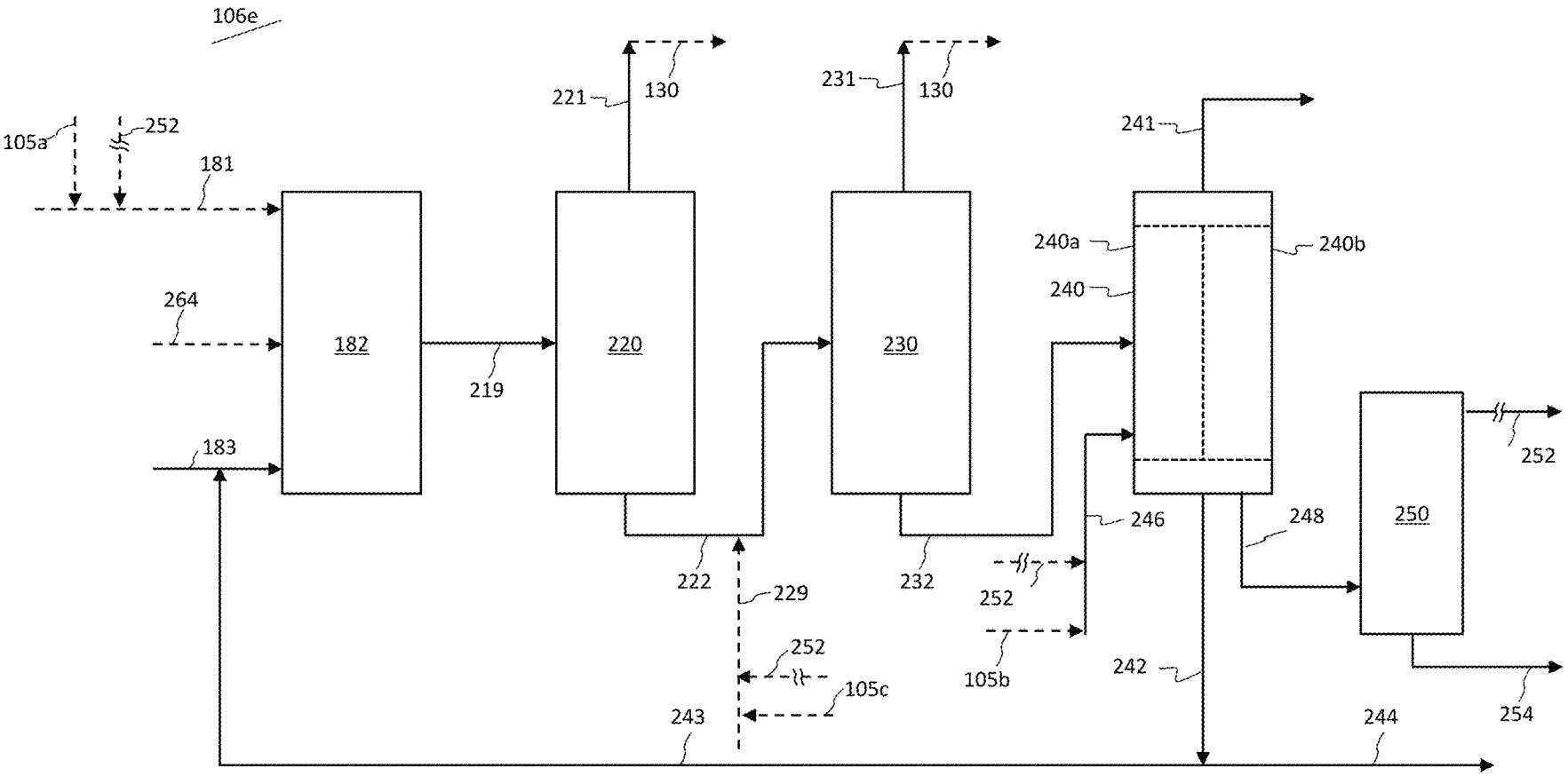

For example, with reference to FIG. 3E, a treatment zone 106*e* utilizes adsorption treatment for contaminant removal and is integrated with the herein processes and systems 102*a*, 102*b*, as all or part of the treatment zone 106. The adsorption treatment zone 106*e* generally includes a mixing zone 182, a source of adsorbent material, an atmospheric separation zone 220, a vacuum separation zone 230, a filtration/regeneration zone 240, and a solvent separation zone 250. The mixing zone 182 includes one or more inlets in fluid communication with the outlet(s) of the atmospheric and/or vacuum separation zones, in certain embodiments with the hydrocracker bottoms outlet, and in certain embodiments with a deasphalted oil outlet, shown schematically in FIG. 3E as stream 264. In addition the mixing zone 182 is in fluid communication with a source of adsorbent material 183, 243. The feedstream 264 to the adsorption treatment zone 106*e* can comprise the atmospheric residue 118 and/or vacuum residue 146 described herein, and in certain embodiment all or a portion of the unconverted oil stream 128. In certain embodiments the stream 264 is a deasphalted oil stream from the processes described with respect to FIGS. 3A-3D (optionally combined with solvent, as in, for instance, stream 130 from one of FIGS. 3A-3D). In this manner, the treatment zone 106 includes one of the treatment zones 106*a*, 106*b*, 106*c* or 106*d*, followed by the adsorption treatment zone 106*e*. In certain embodiments, treated oil from the adsorption treatment zone 106*e* is used as all or a portion of the initial feed to one of the treatment zones 106*a*, 106*b*, 106*c* or 106*d*.

In certain embodiments, the mixing zone 182 includes one or more inlets in fluid communication with a source of elution solvent, stream 181, which can include a portion 105*a* of the solvent stream 105 and/or recycle solvent stream 252. The mixing zone 182 can be operated as an ebullient bed or fixed-bed reactor, a tubular reactor or a continuous stirred-tank reactor. In certain embodiments, the mixing zone 182 operates as a mixing vessel, equipped with suitable mixing apparatus such as rotary stirring blades or paddles, which provide a gentle, but thorough mixing of the contents. The mixing zone 182 includes one or more outlets for discharging a mixture 219 of the residue and adsorbent material. In certain embodiments, not shown, mixing can occur in one or more in-line apparatus so that the slurry 219 is formed and send to the atmospheric flash separation zone 220.

The atmospheric separation zone 220 includes one or more inlets in fluid communication with the outlet discharging the mixture/slurry 219 of the feed and adsorbent material. The atmospheric separation zone 220 includes suitable flash or fractionation vessels operating generally at atmospheric pressure conditions (or in certain embodiments up to about 3 bars) and a temperature in the range of about 20-80° C., with one or more outlets for discharging an atmospheric light fraction 221, and one or more outlets for discharging an atmospheric heavy fraction 222 which contains the adsorbent material. The vacuum separation zone 230 includes one or more inlets in fluid communication with the outlet discharging the atmospheric heavy fraction 222 containing the adsorbent material. In certain embodiments, a source of elution solvent, stream 229, which can include a portion 105*c* of the solvent stream 105 and/or recycle solvent stream 252, is also in fluid communication with the vacuum separation zone 230. The vacuum separation zone 230 includes suitable flash or fractionation vessels operating generally at vacuum pressure conditions and a temperature in the range of about 20-80° C., with one or more outlets for discharging a vacuum light fraction 231, and one or more outlets for discharging a vacuum heavy fraction 232 which contains the adsorbent material. In certain embodiments, either or both of the outlets discharging the atmospheric light fraction 221 and the vacuum light fraction 231 are in fluid communication with the hydroprocessing zone 108 described with respect to FIGS. 1A and 1B, shown as streams 130 in FIG. 3E. In further embodiments, either or both of the outlets discharging the atmospheric light fraction 221 and the vacuum light fraction 231 are in fluid communication with one or more inlets of one of the treatment zones 106*a*, 106*b*, 106*c* or 106*d* as an initial feed.

The filtration/regeneration zone 240 includes one or more inlets in fluid communication with the outlet discharging the vacuum heavy fraction 232, and one or more inlets in fluid communication with a source of stripping solvent 246. The filtration/regeneration zone 240 can include one or more filtration vessels, for example, shown as 240*a* and 240*b*, and includes one or more outlets for discharging a regenerated adsorbent material 242 that is in fluid communication with the mixing zone 182 by an adsorbent recycle stream 243. In addition, spent solid adsorbent material, stream 244, can also be discharged. In certain embodiments, the adsorbent material 242 outlet is in fluid communication, adsorbent stream 244, with a gasification zone described with respect to FIGS. 1A and 1B (or another unit such as a delayed coking unit, or an asphalt pool). In certain embodiments, parallel vessels 240*a*, 240*b* are used so that the system is operated in swing mode. The filtration/regeneration zone 240 also includes one or more outlets outlet for discharging a stream 241 containing vacuum residue product, and one or more outlets for discharging a stream 248 containing a mixture of solvent, asphaltenes and other process reject materials from the adsorbent material. In certain embodiments the outlet discharging stream 241 is in fluid communication with a gasification zone described with respect to FIGS. 1A and 1B (or another unit such as a delayed coking unit, or an asphalt pool).

A solvent separation zone 250 includes one or more inlets in fluid communication with the outlet discharging stream 248 containing the mixture of solvent, asphaltenes and other process reject materials. The separation zone 250 contains one or more flash vessels or fractionation units operable to separate solvent from the mixture, and includes one or more outlets for discharging a solvent stream 252, which is in fluid communication with one or more inlets of the filtration/regeneration zone 240, and one or more outlets for discharging asphaltenes and other process reject materials, stream 254. In additional embodiments (not shown) all or a portion of the stream 252 from the separation zone 250 can be passed to the hydroprocessing zone 108. In certain embodiments, the outlet discharging stream 254 is in fluid communication with a gasification zone described with respect to FIGS. 1A and 1B (or another unit such as a delayed coking unit, or an asphalt pool).

In general, the stripping solvent stream 246 can include one or more solvent sources including a portion 105*b* of the integrated process solvent stream 105, optionally recycle solvent stream 252, and in certain embodiments a make-up stripping solvent stream. In certain embodiments, a solvent drum (not shown) is integrated to receive the sources of recycle and make-up stripping solvent. Solvent stream 105*b* comprises all or a portion of one or more of the aforementioned internal naphtha solvent sources, that is, streams 114 or stream 114*a*, and in certain embodiments stream 124 or stream 124*a*. The mass ratio of the solvent in stream 191 to the adsorbent (W/W) in the adsorbent stripping zone 192 is in the range of about 20:0.1 to 1:1, 20:1 to 1:1, 15:1 to 1:1, 10:1 to 1:1, 20:0.1 to 3:2, 20:1 to 3:2, 15:1 to 3:2, 10:1 to 3:2, 20:0.1 to 2:1, 20:1 to 2:1, 15:1 to 2:1, or 10:1 to 2:1.

In operation of the adsorption treatment zone 106*e*, the feedstream 264, and solid adsorbent 183, are fed to the mixing zone 182 and mixed to form a slurry. The rate of agitation for a given vessel and mixture of adsorbent, solvent and feedstock is selected so that there is minimal, if any, attrition of the adsorbent granules or particles. The solid adsorbent/crude oil slurry mixture 219 is transferred to the atmospheric separator 220 to separate and recover the atmospheric light fraction 221. In certain embodiments, elution solvent 181 is also passed to the atmospheric separator 220, shown in FIG. 3E via the mixing zone 182, although it should be appreciated that elution solvent 181 can be added to the feed directly or introduced to the atmospheric separator 220 separate from the feed and adsorbent. Due to the relatively light nature of the elution solvent from stream 181, all, a substantial portion or a significant portion thereof passed with the atmospheric light fraction 221. The atmospheric heavy fraction 222 from vessel 220 is sent to the vacuum separator 230. The vacuum light fraction stream 231 is withdrawn from the vacuum separator 230 and the bottoms 232 containing vacuum flash residue and solid adsorbent are sent to the adsorbent regeneration zone 240. In certain embodiments, the elution solvent stream 229 is used, which can be combined with the atmospheric heavy fraction 222 (directly or via a mixing zone or in-line section, not shown) prior to routing to the vacuum separator 230, or added to introduced to the vacuum separator 230. Due to the relatively light nature of the elution solvent from stream 229, all, a substantial portion or a significant portion thereof passed with the vacuum light fraction 231. In certain embodiments one or both of the atmospheric light fraction 221 and the vacuum light fraction stream 231 are passed to the hydroprocessing zone 108, shown as streams 130 in FIG. 3E. In certain embodiments, one or both of the atmospheric light fraction 221 and the vacuum light fraction 231 are passed to one of the treatment zones 106*a*, 106*b*, 106*c* or 106*d*, as an initial feed.

The vacuum residue product 241 is withdrawn from the adsorbent regeneration zone 240 and the bottoms 242 are removed and separated so that the reusable regenerated adsorbents 243 are recycled back and introduced with fresh adsorbent material 183 and the feedstock into mixing zone 182; a portion 244 of the adsorbent material is discharged in a continuous, periodic or as-needed manner, for instance, as spent solid adsorbent material. In certain embodiments the vacuum residue product 241 and/or the discharged adsorbent material 244 is passed to the gasification zone described with respect to FIGS. 1A and 1B (or another unit such as a delayed coking unit, or an asphalt pool).

In certain embodiments, the adsorbent regeneration unit 240 is operated in swing mode so that production of the regenerated absorbent is continuous. When the adsorbent material in regeneration unit column 240*a* becomes spent and no longer effective for adsorption, the flow of feedstream 232 is directed to the other column 240*b*. The adsorbed compounds are desorbed in the process herein using solvent treatment, for instance, at a pressure in the range of about 1-30 bars and a temperature range of from about 20-250, 20-200, 20-100 or 20-80° C. The adsorbed compounds are desorbed with a solvent stream 246 to remove at least some of the process reject materials so that at least a portion of the adsorbent material can be recycled, in certain embodiments a major portion, a significant portion or a substantial portion. In certain embodiments, a recycle solvent 252 is also used. The solvent and process reject materials, stream 248, from the regeneration unit 240 is sent to a separation zone 250. The recovered solvent stream 252 is recycled back to the adsorbent regeneration unit 240, or 240*a* and 240*a*, for reuse. A vacuum residue/process reject materials stream 241 is also discharged. The solvent and process reject materials separation bottoms stream 254, and the vacuum residue/process reject materials 241 can be sent to a gasification zone described with respect to FIGS. 1A and 1B (or another unit such as a delayed coking unit, or an asphalt pool).

In certain embodiments asphaltene reduction is effectuated by contacting with an effective type(s) and quantity of adsorbent material, and under effective conditions, to remove asphaltenes. The feed is passed through at least one packed bed column containing adsorbent material, or is mixed with adsorbent material and passed through a slurry column. Asphaltene and other contaminants are adsorbed. The adsorbent material is regenerated with stripping solvent and recycled for contacting with the feed. An example of a process and system that can be integrated in this manner is disclosed in commonly owned U.S. Pat. Nos. 7,763,163 and 7,867,381, which are incorporated herein in their entireties.

Figure 3F:
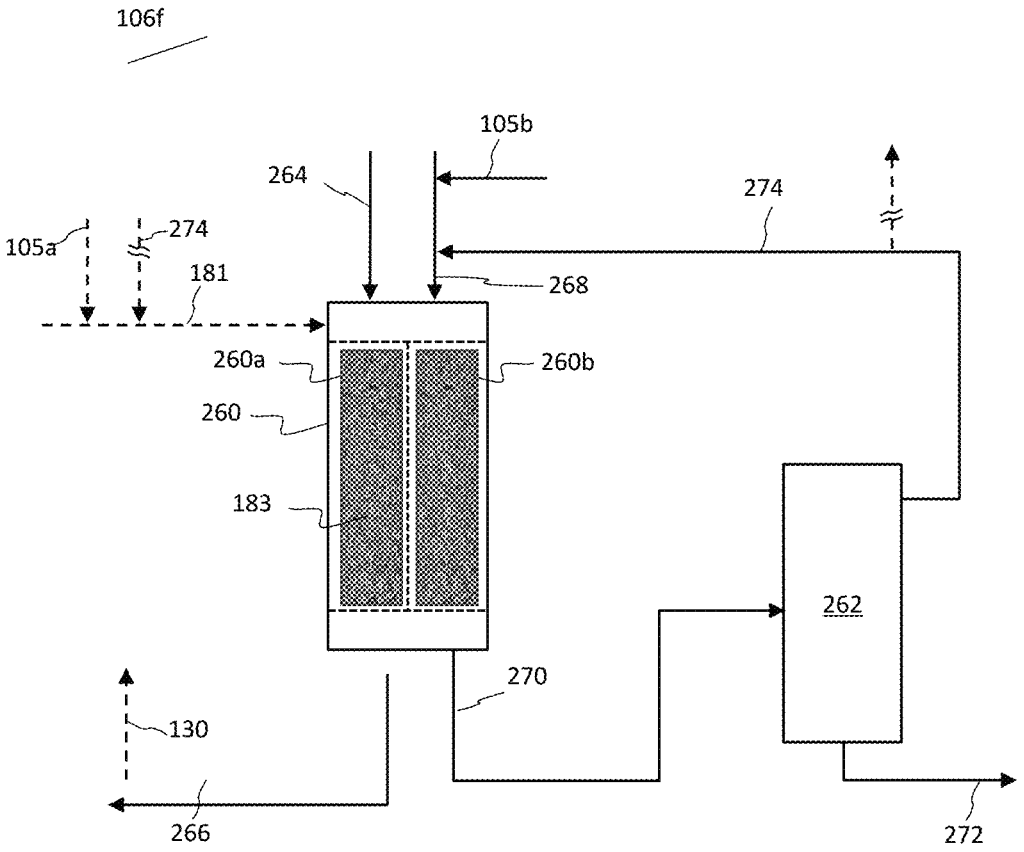

For example, with reference to FIG. 3F, a treatment zone 106*f* utilizes adsorption treatment for contaminant removal and is integrated with the herein processes and systems 102*a*, 102*b*, as all or part of the treatment 106. The adsorption treatment zone 106*f* generally includes an adsorbent contacting zone 260, a source of adsorbent material, and a solvent-asphalt separation zone 262. During an adsorption mode of operation, the adsorbent contacting zone 260 generally includes one or more inlets in fluid communication with the outlet(s) of the atmospheric and/or vacuum separation zones, in certain embodiments with the hydrocracker bottoms outlet, and in certain embodiments with a deasphalted oil outlet, shown schematically in FIG. 3F as stream 264. Accordingly, the feedstream 264 to the adsorption treatment zone 106*f* can comprise the atmospheric residue 118 and/or vacuum residue 146 described herein, and in certain embodiment all or a portion of the unconverted oil stream 128. In certain embodiments the stream 264 is a deasphalted oil stream from the processes described with respect to FIGS. 3A-3D (optionally combined with solvent, as in, for instance, stream 130 from one of FIGS. 3A-3D). In this manner, the treatment zone 106 includes one of the treatment zones 106*a*, 106*b*, 106*c* or 106*d*, followed by the adsorption treatment zone 106*f*. In certain embodiments, treated oil from the adsorption treatment zone 106*f* is used as all or a portion of the initial feed to one of the treatment zones 106*a*, 106*b*, 106*c* or 106*d*.

In certain embodiments, the adsorbent contacting zone 260 includes one or more inlets in fluid communication with a source of elution solvent, stream 181, which can include a portion 105*a* of solvent stream 105 and/or a portion of recycle solvent stream 274. The adsorbent contacting zone 260 contains one or more vessels, for example, shown as 260*a* and 260*b*. The vessel(s) contain an effective of adsorbent material 183, and can be for example one or more packed bed columns. The adsorbent contacting zone 260 includes one or more outlets for discharging an adsorbent-treated stream 266 during an adsorption mode of operation of the adsorbent contacting zone 260. In addition, adsorbent contacting zone 260 comprises one or more inlets in fluid communication with a source of a stripping solvent, stream 268, and one or more outlets for discharging a solvent and process reject materials, stream 270, during a desorption mode of operation. In certain embodiments, the outlet discharging stream 266 is in fluid communication with the hydroprocessing zone 108 described with respect to FIGS. 1A and 1B, shown as stream 130 in FIG. 3F. In further embodiments, the outlet discharging the adsorbent-treated stream 266 is in fluid communication with one or more inlets of the treatment zones 106*a*, 106*b*, 106*c* or 106*d* as an initial feed.

The solvent-asphalt separation zone 262 includes one or more inlets in fluid communication with the stream 270, and contains one or more flash vessels or fractionation units operable to separate solvent and asphaltic materials, and can include, for instance, necessary heat exchangers to increase the temperature before a separation vessel. The solvent-asphalt separation zone 262 also includes one or more outlets for discharging a bottoms stream 272, and one or more outlets for discharging a recycle stripping solvent stream 274 that is in fluid communication with the adsorbent contacting zone 260 during desorbing operations, the source of elution solvent, stream 181, or both the adsorbent contacting zone 260 during desorbing operations and the source of elution solvent, stream 181. In certain embodiments, the bottoms stream 272 outlet is in fluid communication with a gasification zone described with respect to FIGS. 1A and 1B (or another unit such as a delayed coking unit, or an asphalt pool).

In general, the stripping solvent stream 268 can include one or more solvent sources including all or a portion 105*b* of the integrated process solvent stream 105, a portion of the recycle solvent stream 274 and in certain embodiments make-up stripping solvent (not shown). In certain embodiments, a solvent drum (not shown) is integrated to receive the sources of recycle and make-up stripping solvent. Solvent stream 105*b* comprises all or a portion of one or more of the aforementioned internal naphtha solvent sources, that is, streams 114 or stream 114*a*, and in certain embodiments stream 124 or stream 124*a*. The mass ratio of the solvent in stream 268 to the adsorbent (W/W) in the adsorbent contacting zone 260 is in the range of about 20:0.1 to 1:1, 20:1 to 1:1, 15:1 to 1:1, 10:1 to 1:1, 20:0.1 to 3:2, 20:1 to 3:2, 15:1 to 3:2, 10:1 to 3:2, 20:0.1 to 2:1, 20:1 to 2:1, 15:1 to 2:1, or 10:1 to 2:1.

The contacting zone 260 operates in an adsorption mode and a desorption mode. In the adsorption mode, the feedstream 264 is passed to the contacting zone 260 and flows under the effect of gravity or by pressure over the adsorbent material to absorb asphaltenes and other contaminants, and under effective conditions to adsorb at least a portion of asphaltenes and other contaminants in the feed. For instance, effective adsorption conditions include a pressure in the range of about 1-30 bars and a temperature in the range of about 20-250, 20-200, 20-100 or 20-80° C. The cleaned feedstock 266 is removed from the contacting zone 260. In certain embodiments all or a portion of stream 266 is passed to the hydroprocessing zone 108, shown as stream 130 in FIG. 3F. In certain embodiments, the adsorbent-treated stream 266 is passed to one of the treatment zones 106*a*, 106*b*, 106*c* or 106*d*, as an initial feed.

In a desorption mode, adsorbed asphaltenes and other contaminants are eluted with the stripping solvent stream 268 under effective conditions to remove at least a portion thereof. For instance, effective desorption conditions include a pressure in the range of about 1-30 bars and a temperature in the range of about 20-80, 20-250 or 20-205° C. The solvent and process reject materials, stream 270, is removed and passed to the solvent-asphalt separation zone 262. The mixture is separated, for instance by flash separation or fractionation, into the relatively light recycle solvent stream 274 and the relatively heavy bottoms stream 272 which contains the asphaltenes and other contaminants that were stripped from the adsorbent material. In certain embodiments, all or any portion of the bottoms stream 272 is passed to the gasification zone described with respect to FIGS. 1A and 1B, or another unit such as a delayed coking unit, or an asphalt pool. Stream 274 can be recycled to the adsorbent contacting zone 260, mixed as part of the source of elution solvent, stream 181 or both recycled to the adsorbent contacting zone 260 and mixed as part of the source of elution solvent, stream 181. In additional embodiments (not shown) all or a portion of the stream 274 from the separation zone 262 can be passed to the hydroprocessing zone 108. Additionally, the adsorbent material 183 could be removed (not shown) after a certain number of adsorption/desorption cycles and all or any portion thereof can be passed to the gasification zone described with respect to FIGS. 1A and 1B, or another unit such as a delayed coking unit, or an asphalt pool.

In certain embodiments, parallel vessels are used in the adsorbent contacting zone 260 and the system is operated in swing mode so that production of the cleaned feedstock can continuous. For example, when the adsorbent material in vessel 260*a* becomes spent and no longer effective for adsorption, the flow of feedstream 264 is directed to the other column 260*b* containing fresh or regenerated adsorbent material. The feedstream 264 enters the top of one of the columns, for instance, column 260*a*, and flows under the effect of gravity or by pressure over the adsorbent material to absorb asphaltenes and other contaminants. The cleaned feedstock 266 is removed from the bottom of column 260*a*. Concurrently, stripping solvent 268 is fed to the vessel 260*a* to carry out desorption operations as described above.

Figure 3G:
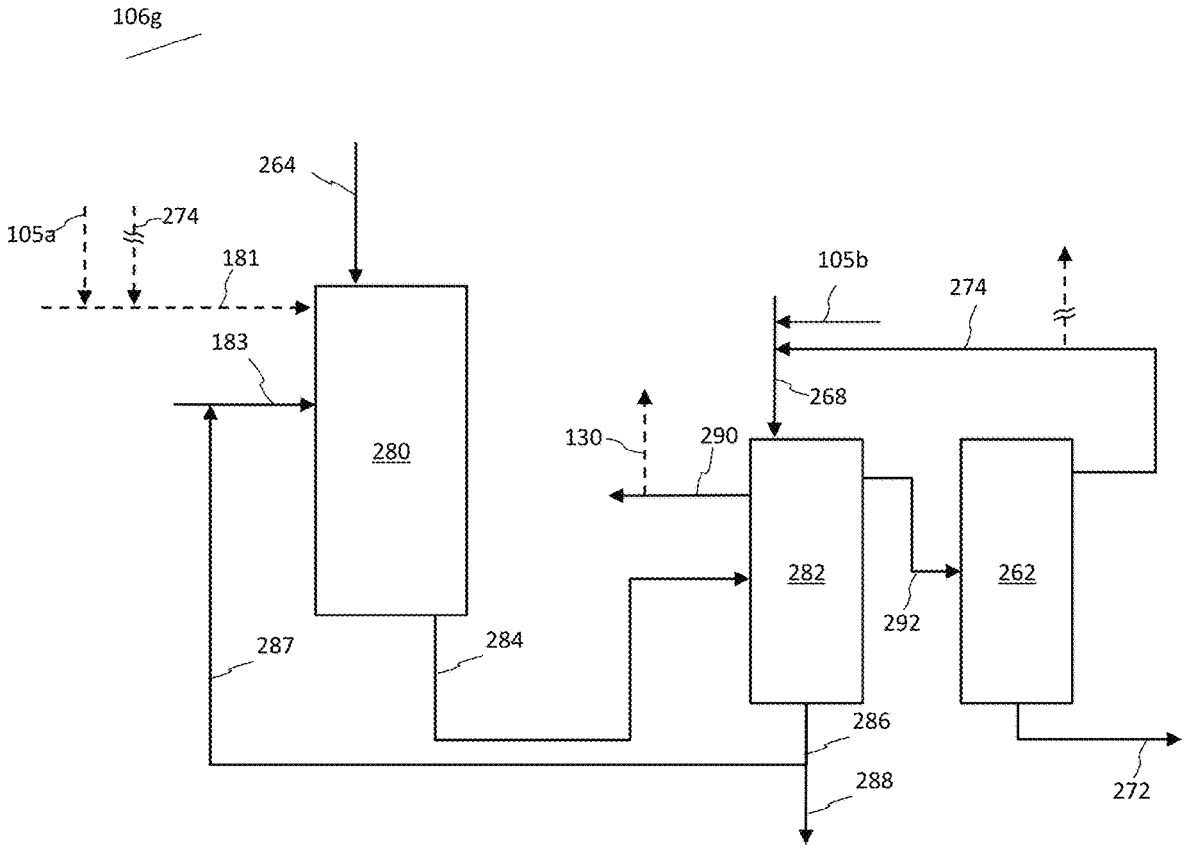

In another embodiment, and with reference to FIG. 3G, a treatment zone 106*g* utilizes adsorption treatment for contaminant removal and is integrated with the herein processes and systems 102*a*, 102*b*, as all or part of the treatment zone 106. The adsorption treatment zone 106*g* generally includes an adsorbent slurry contacting zone 280, a filtration/regeneration zone 282, and a solvent-asphalt separation zone 262. The adsorbent slurry contacting zone 280 includes one or more inlets in fluid communication with the outlet(s) of the atmospheric and/or vacuum separation zones, in certain embodiments with the hydrocracker bottoms outlet, and in certain embodiments with a deasphalted oil outlet, shown schematically in FIG. 3G as stream 264. In addition, the adsorbent slurry contacting zone 280 is in fluid communication with a source of adsorbent material 183, 243. Accordingly, the feedstream 264 to the adsorption treatment zone 106*g* can comprise the atmospheric residue 118 and/or vacuum residue 146 described herein, and in certain embodiment all or a portion of the unconverted oil stream 128. In certain embodiments the stream 264 is a deasphalted oil stream from the processes described with respect to FIG. 3A or 3B (optionally combined with solvent, as in, for instance, stream 130). In this manner, the treatment zone 106 includes one of the treatment zones 106*a*, 106*b*, 106*c* or 106*d*, followed by the adsorption treatment zone 106*g*. In certain embodiments, treated oil from the adsorption treatment zone 106*g* is used as all or a portion of the initial feed to one of the treatment zones 106*a*, 106*b*, 106*c* or 106*d*.

In certain embodiments, the adsorbent slurry contacting zone 280 includes one or more inlets in fluid communication with a source of elution solvent, stream 181, which can include solvent stream 105 and/or recycle solvent stream 274. The adsorbent slurry contacting zone 280 can be operated as an ebullient bed or fixed-bed reactor, a tubular reactor or a continuous stirred-tank reactor. In certain embodiments, the adsorbent slurry contacting zone 280 operates as a mixing vessel, equipped with suitable mixing apparatus such as rotary stirring blades or paddles, which provide a gentle, but thorough mixing of the contents. The adsorbent slurry contacting zone 280 includes one or more outlets for discharging a mixture 284 of the residue and adsorbent material. In certain embodiments, not shown, mixing can occur in one or more in-line apparatus so that the slurry 284 is formed and send to the filtration/regeneration zone 282.

The filtration/regeneration zone 282 includes one or more inlets in fluid communication with the outlet discharging the mixture 284 of the residue and adsorbent material, and one or more inlets in fluid communication with a source of stripping solvent 268. The filtration/regeneration zone 282 mixture 284 of the residue and adsorbent material can include one or more filtration vessels and includes one or more outlets for discharging a regenerated adsorbent material 286 that is in fluid communication with the adsorbent slurry contacting zone 280 by an adsorbent recycle stream 287. In addition, spent solid adsorbent material, stream 288, can also be discharged. In certain embodiments, the adsorbent material 286 outlet is in fluid communication, adsorbent stream 288, with a gasification zone described with respect to FIGS. 1A and 1B (or another unit such as a delayed coking unit, or an asphalt pool). The filtration/regeneration zone 282 also includes one or more outlets outlet for discharging an adsorbent-treated stream 290 containing adsorbent-treated residue, and one or more outlets for discharging a stream 292 containing a mixture of solvent, asphaltenes and other process reject materials from the adsorbent material. In certain embodiments, the outlet discharging stream 290 is in fluid communication with the hydroprocessing zone 108 described with respect to FIGS. 1A and 1B, shown as stream 130 in FIG. 3G. In further embodiments, the outlet discharging the adsorbent-treated stream 290 is in fluid communication with one or more inlets of the treatment zones 106*a*, 106*b*, 106*c* or 106*d* as an initial feed.

The solvent-asphalt separation zone 262 includes one or more inlets in fluid communication with the outlet discharging stream 292, and contains one or more flash vessels or fractionation units operable to separate solvent and asphaltic materials, and can include, for instance, necessary heat exchangers to increase the temperature before a separation vessel. The solvent-asphalt separation zone 262 also includes one or more outlets for discharging a bottoms stream 272, and one or more outlets for discharging a recycle stripping solvent stream 274 that is in fluid communication with the adsorbent slurry contacting zone 280. In certain embodiments, the bottoms stream 272 outlet is in fluid communication with a gasification zone described with respect to FIGS. 1A and 1B (or another unit such as a delayed coking unit, or an asphalt pool).

In general, the stripping solvent stream 268 is derived from one or more solvent sources comprising an integrated process solvent stream 105, recycle solvent stream 274 and in certain embodiments make-up stripping solvent (not shown). In certain embodiments, a solvent drum (not shown) is integrated to receive the sources of recycle and make-up stripping solvent. Solvent stream 105*b* comprises all or a portion of one or more of the aforementioned internal naphtha solvent sources, that is, streams 114 or stream 114*a*, and in certain embodiments stream 124 or stream 124*a*. The mass ratio of the solvent in stream 268 to the adsorbent (W/W) in the adsorbent contacting zone 260 is in the range of about 20:0.1 to 1:1, 20:1 to 1:1, 15:1 to 1:1, 10:1 to 1:1, 20:0.1 to 3:2, 20:1 to 3:2, 15:1 to 3:2, 10:1 to 3:2, 20:0.1 to 2:1, 20:1 to 2:1, 15:1 to 2:1, or 10:1 to 2:1.

In operation of the adsorption treatment zone 106*g*, the feedstream 264 and adsorbent material 183, 287 are charged to the adsorbent slurry contacting zone 280 under conditions effective for adsorption of asphaltenes and other contaminants, and to provide a slurry 284. The rate of agitation for a given vessel and mixture of adsorbent and feedstock is selected so that there is minimal, if any, attrition of the adsorbent granules or particles. For example, mixing can be carried out for 30 to 150 minutes, at a pressure in the range of about 1-30 bars and a temperature in the range of about 20-250, 20-200, 20-100 or 20-80° C. In addition, the feedstream 264 and adsorbent material can be mixed in an in-line mixer to produce the slurry 284.

The slurry 284 is passed to the filtration/regeneration zone 282 for contact with stripping solvent 268 under effective conditions to strip at least a portion of the adsorbed asphaltenes and other contaminants. The adsorbent-treated residue stream 290 is discharged, and all or a portion is routed to the hydroprocessing zone 108, shown as stream 130 in FIG. 3F. In certain embodiments, the adsorbent-treated stream 266 is passed to one of the treatment zones 106*a*, 106*b*, 106*c* or 106*d*, as an initial feed. The stream 292 containing the mixture of solvent, asphaltenes and other process reject materials is passed to the solvent-asphalt separation zone 262 for recovery of solvent. The mixture is separated, for instance by flash separation or fractionation, into the relatively light recycle solvent stream 274 and the relatively heavy bottoms stream 272 which contains the asphaltenes and other contaminants that were stripped from the adsorbent material. Stream 274 can be recycled to the filtration/regeneration zone 282, mixed as part of the source of elution solvent, stream 181 or both recycled to the filtration/regeneration zone 282 and mixed as part of the source of elution solvent, stream 181. In additional embodiments (not shown) all or a portion of the stream 274 from the separation zone 262 can be passed to the hydroprocessing zone 108. Regenerated adsorbent material is discharged, stream 286, and a portion 287 thereof is recycled to the adsorbent slurry contacting zone 280. In certain embodiments, all or any portion of the bottoms stream 272 is passed to the gasification zone described with respect to FIGS. 1A and 1B, or another unit such as a delayed coking unit, or an asphalt pool. Additionally, the portion 288 of adsorbent material can be purged and all or any portion thereof can be passed to the gasification zone described with respect to FIGS. 1A and 1B, or another unit such as a delayed coking unit, or an asphalt pool.

Solid adsorbent materials or mixture of solid adsorbent materials for use in the embodiments of FIGS. 3C-3G that are effective to capture the asphaltenes and other contaminants include those that are characterized by high surface area, large pore volumes, and a wide pore diameter distribution. Types of adsorbent materials that are effective for use in the treatment zones 106*c*, 106*d*, 106*e*, 106*f* and 106*g*, adsorbent material 183, include molecular sieves, silica gel, activated carbon, activated alumina, silica-alumina gel, zinc oxide, clays such as attapulgus clay, fresh zeolitic catalyst materials, used zeolitic catalyst materials, spent catalysts from other refining operations, and mixtures of two or more of these materials. Effective adsorbent materials are characterized by any suitable shape, such as granules, extrudates, tablets, spheres, pellets, or natural shapes, having average particle diameters (mm) in the range of from about 0.01-4.0, 0.1-4.0, or 0.2-4.0, average pore diameters (nm) in the range of from 1-5000, 1-2000, 5-5000, 5-2000, 100-5000 or 100-2000, pore volumes (cc/g) in the range of from about 0.08-1.2, 0.3-1.2, 0.5-1.2, 0.08-0.5, 0.1-0.5, or 0.3-0.5, and a surface area of at least about 100 $m^2/g$. In certain embodiment, solid adsorbent material is attapulgus clay and has an average pore size in the range of from about 10-750 angstroms. In a further embodiment, solid adsorbent material is activated carbon and has an average pore size in the range of from about 5-400 angstroms.

In further embodiments, solid adsorbent material includes spent catalyst. In certain embodiments the spent catalyst can be obtained from any type of reactor that needs to be taken off-stream for catalyst removal due to loss of efficacy of at the end of the normal lifetime of the materials as catalytic materials, such as fixed-bed, continuous stirred tank (CSTR), or tubular reactors. In certain embodiments the source of the spent catalyst is one or more reactors within the hydroprocessing zone 108. In certain embodiments the spent catalyst can be obtained from any type of reactor that includes on-stream catalyst removal and replenishment, for example slurry-bed or moving-bed reactors. For example catalyst that is typically drawn for regeneration or replacement can be used as the solid adsorbent material in any of the embodiments herein that utilize source solid adsorbent material. In further embodiment, for instance when a membrane-wall type gasifier is integrated as described herein, overall process waste is significantly reduced by disposing of the spent solid catalyst materials rather than discard them as a waste material which incurs substantial expense and entails environmental considerations. In certain embodiments the source of the spent catalyst is one or more reactors within the hydroprocessing zone 108 that operates with on-stream catalyst removal and replenishment.

Various low-value material streams are produced in the asphaltene reduction operations herein, including for example asphalt from the asphaltene removal zone 106*a* (FIG. 3A) or 106*b* (FIG. 3B); asphalt and/or adsorbent material from the asphaltene and contaminant removal zone 106*c* (FIG. 3C) or 106*d* (FIG. 3D); or desorbed asphaltenes and contaminants (process reject materials), and/or adsorbent material, from the adsorption treatment zone 106*e* (FIG. 3E), 106*f* (FIG. 3F) or 106*g* (FIG. 3G). All or any portion of these rejected streams can be passed to a gasification zone 136 shown in FIGS. 1A and 1B, which can be any known gasification operation. Gasification is well known in the art and it is practiced worldwide with application to solid and heavy liquid fossil fuels, including refinery bottoms. The gasification process uses partial oxidation to convert carbonaceous materials, such as coal, petroleum, biofuel, or biomass with oxygen at high temperature, i.e., greater than 800° C., into synthesis gas, steam and electricity. The synthesis gas consisting of carbon monoxide and hydrogen can be burned directly in internal combustion engines. In certain embodiments synthesis gas can be used in the manufacture of various chemicals, such as methanol via known synthesis processes and synthetic fuels via the Fischer-Tropsch process. For example the synthesis gas can be subjected to a water-gas shift reaction to increase the total hydrogen produced. In certain embodiments, the integrated process and system herein includes gasification of one or more of the low-value material streams in which and includes preparing a flowable slurry of the low-value material streams; introducing the slurry as a pressurized feedstock into a gasification reactor with a predetermined amount of oxygen and steam that is based on the carbon content of the feedstock; operating the gasification reactor at a temperature effective for partial oxidation to produce hydrogen, carbon monoxide and a slag material.

In the present integrated systems and processes using gasification zone 136, the gasification process provides a source of hydrogen, stream 140, that can be routed to the hydroprocessing zone 108. In addition, it produces electricity and steam 138 for refinery use or for export and sale; it can take advantage of efficient power generation technology. Furthermore, the gasification process provides a local solution for the heavy residues where they are produced, thus avoiding transportation off-site or storage; it also provides the potential for disposal of other refinery waste streams, including hazardous materials; and a potential carbon management tool, that is, a carbon dioxide capture option is provided if required by the local regulatory system.

Three principal types of gasifier technologies are moving bed, fluidized bed and entrained-flow systems. Each of the three types can be used with solid fuels, and the entrained-flow reactor has been demonstrated to process liquid fuels. In an entrained-flow reactor, the fuel, oxygen and steam are injected at the top of the gasifier through a co-annular burner. The gasification usually takes place in a refractory-lined vessel which operates at a pressure of about 40 bars to 60 bars and a temperature in the range of from 1300° C. to 1700° C.

There are two types of gasifier wall construction: refractory and membrane. The gasifier conventionally uses refractory liners to protect the reactor vessel from corrosive slag, thermal cycling, and elevated temperatures that range from about 1400-1700° C. The refractory material is subjected to the penetration of corrosive components from the generation of the synthesis gas and slag and thus subsequent reactions in which the reactants undergo significant volume changes that result in degradation of the strength of the refractory materials. Typically, parallel refractory gasifier units are installed to provide the necessary continuous operating capability. Membrane wall gasifier technology uses a cooling screen protected by a layer of refractory material to provide a surface on which the molten slag solidifies and flows downwardly to the quench zone at the bottom of the reactor. In a membrane wall gasifier, the build-up of a layer of solidified mineral ash slag on the wall acts as an additional protective surface and insulator to minimize or reduce refractory degradation and heat losses through the wall. Thus the water-cooled reactor design avoids what is termed "hot wall" gasifier operation, which requires the construction of thick multiple-layers of expensive refractories which will remain subject to degradation. In the membrane wall reactor, the slag layer is renewed continuously with the deposit of solids on the relatively cool surface. Advantages relative to the refractory type reactor include short start-up/shut down times, and the capability of gasifying feedstocks with high ash content, thereby providing greater flexibility in treating a wider range of coals, petcoke, coal/petcoke blends, biomass co-feed, and liquid feedstocks.

There are two principal types of membrane wall reactor designs that are adapted to process solid feedstocks. One such reactor uses vertical tubes in an up-flow process equipped with several burners for solid fuels, e.g., petcoke. A second solid feedstock reactor uses spiral tubes and down-flow processing for all fuels. For solid fuels, a single burner having a thermal output of about 500 MWt has been developed for commercial use. In both of these reactors, the flow of pressurized cooling water in the tubes is controlled to cool the refractory and ensure the downward flow of the molten slag. Both systems have demonstrated high utility with solid fuels, but not with liquid fuels.

For production of liquid fuels and petrochemicals, a key parameter is the ratio of hydrogen-to-carbon monoxide in the dry synthesis gas. This ratio is usually between 0.85:1 and 1.2:1, depending upon the feedstock characteristics. Thus, additional treatment of the synthesis gas is needed to increase this ratio up to 2:1 for Fischer-Tropsch applications or to convert carbon monoxide to hydrogen through the water-gas shift reaction represented by $CO+H_2O \rightarrow CO_2+H_2$. In some cases, part of the synthesis gas is burned together with some off gases in a combined cycle to produce electricity and steam. The overall efficiency of this process is between 44% and 48%.

The gasification zone 136 shown in FIGS. 1A and 1B can be any known gasification operation. In certain embodiments, a gasification system as disclosed in commonly owned U.S. Pat. Nos. 10,422,046, 9,234,146, 9,056,771 and/or 9,359,917, which are incorporated herein by reference, can be integrated.

Figure 4:
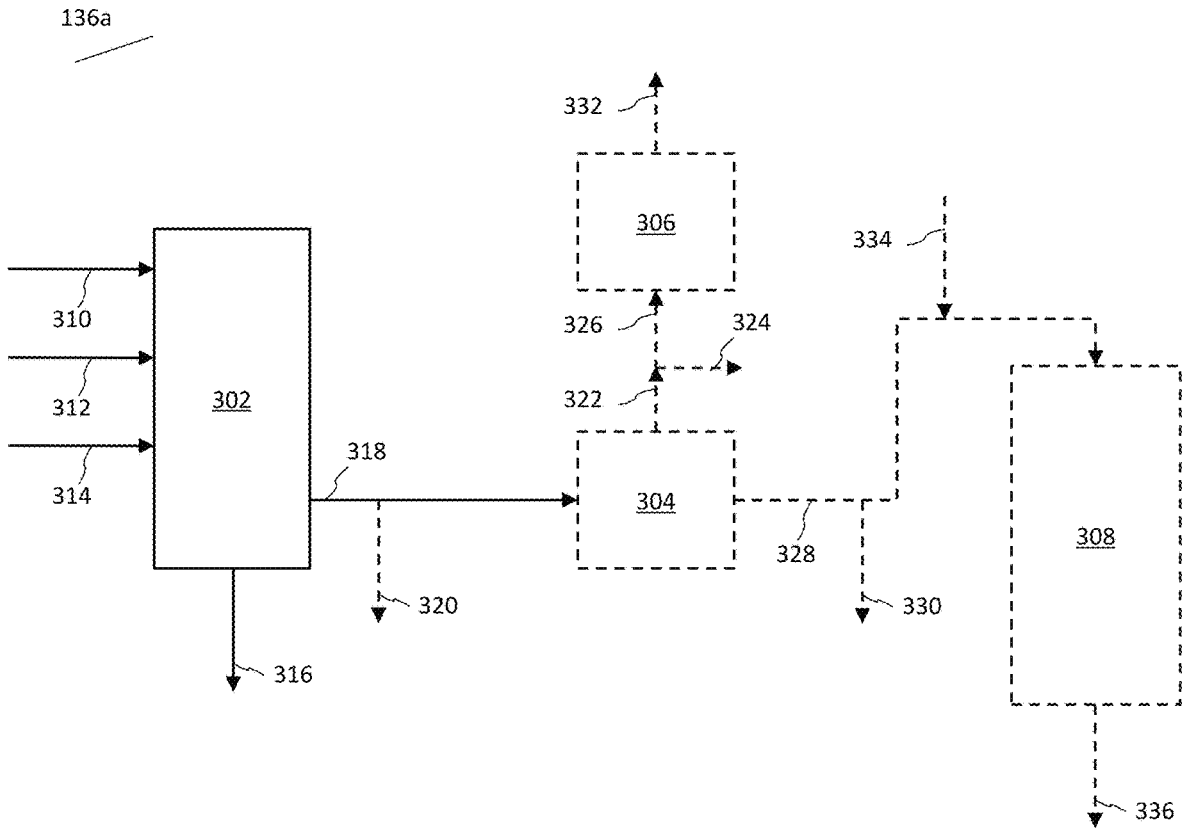
FIG. 4 is a schematic diagram of a gasification subsystems can be integrated in the systems for upgrading a feedstock.

In one embodiment, and with reference to FIG. 4, an example of a gasification zone 136 operates in a manner similar to that disclosed in commonly owned U.S. Pat. No. 8,721,927, which is incorporated by reference herein in its entirety. A gasification zone 136*a* includes a gasification reactor 302 in which a flowable slurry of one or more of the low-value material streams are partially oxidized to produce hydrogen and carbon monoxide as a hot raw synthesis gas, and slag. In certain embodiments, for cooling of the hot synthesis gas and steam generation, a steam generating heat exchanger 304 is integrated. In certain embodiments a turbine 306 is integrated to produce electricity from the steam. In certain embodiments, a water-gas shift reaction vessel 308 is included to convert the carbon monoxide in the syngas to hydrogen through the water-gas shift reaction represented by $CO+H_2O \rightarrow CO_2+H_2$, to thereby increase the volume of hydrogen in the shifted synthesis gas.

Gasification reactor 302, in certain embodiments a membrane wall gasification reactor, includes one or more inlets in fluid communication with a source of a flowable slurry 310 of one or more of the low-value material streams from the process herein, a source of pressurized oxygen or an oxygen-containing gas 312, and a source of steam 314. The gasification reactor 302 also includes one or more outlets 316 for discharging slag, and one or more outlets for discharging hot raw synthesis gas 318. In certain embodiments hot raw synthesis gas 320 is discharged for use in other downstream processes.

Heat exchanger 304 includes one or more inlets in fluid communication with the hot raw synthesis gas 318 outlet, one or more outlets for discharging produced steam 322, and one or more outlets for discharging cooled synthesis gas 328. In certain embodiments all or any portion of steam 322 is drawn, 324, for use in other unit operations. In additional embodiments, all or any portion of steam 322 is conveyed, 326, to the turbine 306 to generate electricity. In certain embodiments, a portion of the cooled synthesis gas 328 is discharged, stream 330. In further embodiments, the cooled synthesis gas 328 or any remaining portion after stream 330 is conveyed to the water-gas shift reaction vessel 308. Turbine 306 includes an inlet in fluid communication with the produced steam 322 outlet and an outlet 332 for discharging electricity. Water-gas shift reaction vessel 308 includes one or more inlets in fluid communication with cooled synthesis gas stream 328 and a source of steam 334, and one or more outlets for discharging a shifted synthesis gas product 336.

A flowable slurry is prepared including one or more low-value material streams produced in the asphaltene reduction operations herein, including for example asphalt from the asphaltene removal zone 106*a* (FIG. 3A) or 106*b* (FIG. 3B); asphalt and/or adsorbent material from the asphaltene and contaminant removal zone 106*c* (FIG. 3C) or 106*d* (FIG. 3D); or desorbed asphaltenes and contaminants, and/or adsorbent material, from the adsorption treatment zone 106*e* (FIG. 3E), 106*f* (FIG. 3F) or 106*g* (FIG. 3G). The flowable slurry is prepared, for example, fluidizing with nitrogen gas when the solvent deasphalting process bottoms are dry, that is, free of solvent and oil, or by diluting them with light or residual oils, such as cycle oils from fluid catalytic cracking or similar fractions, when the solvent deasphalting process bottoms are wet. The one or more low-value material streams and in certain embodiments diluent can be mixed in a mixing vessel with a stirrer or a circulation system before they are fed to the gasification reactor (not shown). For an entrained-flow gasification reactor, the slurry 310 to the reactor 302 can contain solid adsorbent material (weight percent) in the range of from 2-50, 2-20 or 2-10.

The slurry 310 is introduced as a pressurized feedstock with a predetermined amount of oxygen or an oxygen-containing gas 312 and steam 314 into the gasification reactor 302. The feed is partially oxidized in the membrane wall gasification reactor 302 to produce hydrogen, carbon monoxide and slag. The slag material, which is the final waste product resulting from the formation of ash, in certain embodiments from spent solid adsorbent material and its condensation on the water-cooled membrane walls of gasification reactor 302, are discharged 316 recovered for final disposal or for further uses, depending upon its quality and characteristics.

Hydrogen and carbon monoxide are discharged from the gasification reactor 302 as hot raw synthesis gas 318. In certain embodiments all or any portion of the hot raw synthesis gas can optionally be withdrawn as stream 320 for use in other downstream processes. In certain embodiments, all or any portion of the hot raw synthesis gas 318 can be passed to heat exchanger 304 to cool the hot gas. Cooled synthesis gas 328 is discharged. In certain embodiments all or any portion of the cooled synthesis gas 328 is withdrawn, stream 330, for use in other downstream processes. Steam 322 discharged from the heat exchanger 304 can be withdrawn, steam stream 324, and/or be passed, steam stream 326, to turbine 306 to produce electricity that is transmitted via electrical conductor 332.

In certain embodiments, all or any portion of the cooled synthesis gas 328, and steam 334, are conveyed the water-gas shift reaction vessel 308. Steam for the water-gas shift reaction can in certain embodiments be provided from stream 324. Carbon monoxide is converted to hydrogen in the presence of steam by the water-gas shift reaction represented by $CO+H_2O \rightarrow CO_2+H_2$. A mixture of hydrogen, carbon dioxide, unreacted carbon monoxide and other impurities is discharged as shifted synthesis gas 336. The increase in hydrogen content in the shifted synthesis gas is a function of the operating temperature and catalyst(s) used in the water-gas shift process. High purity hydrogen gas is optionally recovered by pressure swing absorption, membrane or liquid absorption, e.g., as described in commonly owned U.S. Pat. No. 6,740,226, which is incorporated by reference herein.

In general, the operating conditions for the membrane wall gasification reactor include: a temperature (° C.) in the range of from about 900-1700, 900-1600, 900-1500, 950-1700, 950-1600, 950-1500, 1000-1700, 1000-1600 or 1000-1500; a pressure (bars) in the range of from about 1-100, 1-75, 1-50, 10-100, 10-75, 10-50, 20-100, 20-75 or 20-50; a molar ratio of oxygen-to-carbon content of the feedstock in the range of from 0.3:1 to 10:1, 0.3:1 to 5:1, 0.3:1 to 3:1, 0.4:1 to 10:1, 0.4:1 to 5:1, 0.4:1 to 3:1, 1:1 to 10:1, 1:1 to 5:1 or 1:1 to 3:1; a molar ratio of steam-to-carbon content of the feedstock in the range of from 0.1:1 to 10:1, 0.1:1 to 2:1, 0.1:1 to 0.6:1, 0.4:1 to 10:1, 0.4:1 to 2:1 or 0.4:1 to 0.6:1. In embodiments where a water-gas shift reactor is used, water-gas shift reaction conditions include a temperature in the range of from 150-400° C.; a pressure in the range of from 1-60 bars; and a mole ratio of water-to-carbon monoxide in the range of from 5:1 to 3:1.

Example

A quantity of 1000 kg of Arab heavy crude oil is fractionated into naphtha (light naphtha and heavy naphtha), middle distillates and atmospheric residue. The atmospheric residue is subjected to solvent deasphalting with SR light naphtha and adsorbents, resulting in a deasphalted oil and asphalt fractions. The properties of the crude oil and its fractions are given in Table 2. The deasphalted oil-naphtha mixture and other distillates from the fractionation tower are refined/hydrocracked in a hydrocracker unit operating at 360° C., 115 bars of hydrogen partial pressure, overall liquid hourly space velocity of 0.3 $h^{-1}$ over Ni—Mo promoted amorphous VGO hydrocracking catalyst and VGO zeolite catalyst at a loading ratio of 3:1.

The asphalt fraction from the solvent deasphalting unit is gasified in a gasification unit to produce hydrogen. The asphalt fraction, oxygen or an oxygen-containing gas, and steam are introduced and gasified in the gasification zone of a membrane wall reactor. The gasification reactor is operated at 1045° C. The water-to-carbon weight ratio is 0.6 and the oxygen-to-pitch weight ratio is 1. After the gasification is completed, the raw syngas products are sent with steam from a boiler or a process heat exchanger as feedstream to a water gas shift reactor to increase the hydrogen yield in the water gas shift products. The water gas shift reactor is operated at 318° C., one bar of pressure and a water-to-hydrogen ratio of 3. The process material balance is given in Table 3 (with reference numerals corresponding to those shown in FIG. 1A).

The method and system of the present invention have been described above and in the attached drawings; however, modifications will be apparent to those of ordinary skill in the art and the scope of protection for the invention is to be defined by the claims that follow.

TABLE 2

Properties of Arab light crude oil and its fractions

| Fraction | Whole Crude Oil | Distillates | Atmospheric Residue |
|---|---|---|---|
| Yield Weight % | 100.0 | 57.3 | 42.7 |
| Yield Volume % | 100.0 | 62.3 | 37.7 |
| Gravity, ° API | 33.2 | 49.4 | 15.0 |
| Gravity, Specific 60/60 ° F. | 0.859 | 0.782 | 0.966 |
| Sulfur, W % | 1.91 | 0.75 | 3.21 |

TABLE 3

Material Balance

| # | Name | Feed kg | Den. Kg/Lt | C W % | H W % | S W % | N ppmw | $H_2S$ Kg/h | $NH_3$ Kg/h | $C_1$-$C_4$ Kg/h | 36-190 ° C. Kg/h | 190-370 ° C. Kg/h | 370-490 ° C. Kg/h | 490+ ° C. Kg/h |
|---|---|---|---|---|---|---|---|---|---|---|---|---|---|---|
| 110 | Arab Heavy CO | 1000 | 0.890 | 84.82 | 12.18 | 2.83 | 1670.0 | 0.0 | 0.0 | 0.0 | 17.4 | 25.8 | 17.9 | 39.0 |
| 114 | Naphtha | 119 | 0.701 | 84.45 | 15.55 | 0.01 | 0.30 | 0.0 | 0.0 | 0.0 | 119.0 | 0.0 | 0.0 | 0.0 |
| 114a | Light Naphtha | 47 | 0.659 | 83.62 | 16.38 | 0.00 | 0.30 | 0.0 | 0.0 | 0.0 | 46.7 | 0.0 | 0.0 | 0.0 |
| 114b | Heavy Naphtha | 72 | 0.728 | 84.99 | 15.01 | 0.01 | 0.30 | 0.0 | 0.0 | 0.0 | 72.3 | 0.0 | 0.0 | 0.0 |
| 116 | Mid Distillates | 280 | 0.824 | 85.43 | 13.65 | 0.92 | 12.31 | 0.0 | 0.0 | 0.0 | 0.0 | 280.3 | 0.0 | 0.0 |
| 118 | Atmospheric Residue | 601 | 0.992 | 83.84 | 10.83 | 4.37 | 2773.19 | 0.0 | 0.0 | 0.0 | 0.0 | 0.0 | 26.3 | 33.8 |
| 130 | DAO + LN | 744 | 0.635 | | | | | 18.3 | 0.8 | 0.0 | 176.0 | 291.3 | 148.4 | 117.8 |
| 132 | Asphalt | 48 | | | | | | 0.0 | 0.0 | 0.0 | 0.0 | 0.0 | 0.0 | 0.0 |
| 124* | Light Naphtha | 327 | | | | <10 | <10 | 0.0 | 0.0 | 0.0 | 327 | 0.0 | 0.0 | 0.0 |
| 124* | Heavy Naphtha | 72 | | | | <10 | <10 | 0.0 | 0.0 | 0.0 | 72 | 0.0 | 0.0 | 0.0 |
| 124a | Light Naphtha Recycle | 720 | | | | <10 | <10 | 0.0 | 0.0 | 0.0 | 720 | 0.0 | 0.0 | 0.0 |
| 126 | Mid Distillates | 391 | | | | <20 | <20 | 0.0 | 0.0 | 0.0 | 0.0 | 391 | 0.0 | 0.0 |
| 128 | Unconverted Oil | 481 | | | | <20 | <20 | 0.0 | 0.0 | 0.0 | 0.0 | 0.0 | 481 | 0.0 |

*Stream 124 represents combined naphtha in FIG. 1A, further details are provided in Table 3.

The invention claimed is:

1. A process for upgrading a feedstock comprising:

separating the feedstock in a distillation unit or one or more flash unit(s) into at least a naphtha fraction or a light naphtha fraction, a middle distillate fraction and a residue fraction;

removing asphaltenes from all or a portion of the residue fraction with an asphaltene separation zone by contacting with a deasphalting solvent to induce phase separation into an asphaltene reduced residue fraction and an asphaltene phase by solvent-flocculation of solid asphaltenes; and hydroprocessing all or a portion of the asphaltene reduced residue fraction and all or a portion of the middle distillate fraction in the presence of hydrogen to produce a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

2. The process as in claim 1, wherein the asphaltene reduced residue fraction contains at least a portion of the deasphalting solvent.

3. The process as in claim 1, wherein removing asphaltenes includes a deasphalting solvent to residue fraction ratio (V/V) of about 2:1 to 1:30.

4. The process as in claim 1, wherein removing asphaltenes comprises:

passing the residue fraction and the deasphalting solvent to a phase separation zone; and maintaining the phase separation zone at conditions to promote phase separation into deasphalted oil and asphaltenes;

wherein the asphaltene reduced fraction that is passed to hydroprocessing comprises the deasphalted oil and at least a portion of the deasphalting solvent.

5. The process as in claim 1, wherein removing asphaltenes comprises:

passing the residue fraction and the deasphalting solvent to a first phase separation zone;

maintaining the first phase separation zone at conditions to promote phase separation into a first deasphalted oil phase and a first asphalt phase;

removing the primary asphalt phase from the first separation zone;

passing all or a portion of the first deasphalted oil phase including deasphalting solvent to a second phase separation zone;

maintaining the second phase separation zone at conditions to promote phase separation into a second deasphalted oil phase and a second asphalt phase; and removing the secondary asphalt phase from the second separation zone;

wherein the asphaltene reduced fraction that is passed to hydroprocessing comprises all or a portion of the secondary deasphalted oil phase, or a portion of the first deasphalted oil phase, and at least a portion of the deasphalting solvent.

6. The process as in claim 1, wherein removing asphaltenes comprises:

mixing the residue fraction, the deasphalting solvent and solid adsorbent material at a temperature and pressure that are below the critical pressure and temperature of the deasphalting solvent and for a time sufficient to adsorb contaminants contained in the residue fraction on the solid adsorbent material;

passing the residue fraction, the deasphalting solvent and the solid adsorbent material to a first separation vessel to separate a bottoms phase comprising asphaltenes and solid adsorbent material from a deasphalted oil phase including deasphalting solvent; and contacting the bottoms phase with a stripping solvent to desorb the adsorbed contaminants and to recover regenerated solid adsorbent material, and optionally using at least a portion of the regenerated solid adsorbent material as the solid adsorbent material in the mixing step, wherein the stripping solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent;

wherein the asphaltene reduced fraction that is passed to hydroprocessing comprises all or a portion of the deasphalted oil phase and at least a portion of the deasphalting solvent.

7. The process as in claim 6, further comprising passing all or a portion of the deasphalted oil phase to a second separation vessel to separate deasphalted oil and deasphalting solvent, and optionally recycling at least a portion of the deasphalting solvent to the mixing step as all or a portion of deasphalting solvent and/or as all or a portion of stripping solvent;

wherein the asphaltene reduced fraction that is passed to hydroprocessing comprises all or a portion of the deasphalted oil from the second separation vessel and at least a portion of the deasphalting solvent.

8. The process as in claim 1, wherein removing asphaltenes comprises:

mixing the residue fraction and the deasphalting solvent in a first separation vessel at a temperature and pressure that are below the critical pressure and temperature of the deasphalting solvent;

discharging asphalt from the first separation vessel;

passing a mixture of deasphalted oil and deasphalting solvent stream from the first separation vessel, and solid adsorbent material, to a second separation vessel;

maintaining the mixture in the second separation vessel for a time sufficient for adsorption by the solid adsorbent material of contaminants in the deasphalted oil; and contacting a slurry of deasphalted oil and solid adsorbent material from the second separation vessel with a stripping solvent to desorb the adsorbed contaminants and to recover a deasphalted oil stream, to regenerate solid adsorbent material, and to discharge asphalt and process reject material that was adsorbed on the solid adsorbent material, and optionally using at least a portion of the regenerated solid adsorbent material as the solid adsorbent material in the second separation vessel, wherein the stripping solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent;

wherein the asphaltene reduced fraction that is passed to hydroprocessing comprises deasphalted oil from the step of contacting with stripping solvent.

9. The process as in claim 1, further comprising:

contacting one of the asphaltene reduced residue fraction obtained from the asphaltene separation zone with solid adsorbent material to produce an adsorbent-treated asphaltene reduced fraction, and stripping adsorbed contaminants from the solid adsorbent material with a stripping solvent; and hydroprocessing all or a portion of the adsorbent-treated asphaltene reduced fraction;

wherein the stripping solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

10. The process as in claim 1, further comprising:

contacting the residue fraction from the separating step with solid adsorbent material to produce an adsorbent-treated residue fraction, and stripping adsorbed contaminants from the solid adsorbent material with a stripping solvent; and removing asphaltenes from the adsorbent-treated residue fraction in the asphaltene separation zone;

wherein the stripping solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

11. The process as in claim 1, wherein separating the feedstock is with atmospheric distillation or flashing, and where the residue fraction is atmospheric residue that is further fractionated under vacuum conditions to obtain vacuum residue, and wherein the vacuum residue is the residue fraction subjected to the step of removing asphaltenes.

12. The process as in claim 1, wherein the naphtha fraction is separated into a light naphtha fraction and a heavy naphtha fraction; and all or a portion of the light naphtha fraction is used for as solvent in the step of removing asphaltenes.

13. The process as in claim 12, wherein the heavy naphtha fraction is hydroprocessed with the asphaltene reduced fraction.

14. The process as in claim 1, wherein asphaltenes are discharged from the step of removing asphaltenes, and gasifying all or a portion of the asphaltenes.

15. The process as in claim 14, wherein gasifying produces hydrogen that used in the step of hydroprocessing all or a portion of the asphaltene reduced fraction.

16. The process as in claim 15, wherein hydrogen from gasifying is the only source of hydrogen for hydroprocessing when equilibrium is reached.

17. The process as in claim 1, wherein removing asphaltenes further comprises contacting the residue fraction with solid adsorbent material, and discharging spent solid adsorbent material, and the process further comprising gasifying all or a portion of the spent solid adsorbent material.

18. The process as in claim 1, wherein the feedstock is crude oil and all or a portion of the hydroprocessed effluent is recovered as synthetic bottomless crude oil.

19. A process for upgrading a feedstock comprising:

separating the feedstock into at least a light naphtha fraction, a heavy naphtha fraction, and a residue fraction;

removing asphaltenes from all or a portion of the residue fraction with an asphaltene separation zone by contacting with a deasphalting solvent to induce phase separation into an asphaltene reduced residue fraction and an asphaltene phase by solvent-flocculation of solid asphaltenes; and hydroprocessing all or a portion of the asphaltene reduced residue fraction and all or a portion of the heavy naphtha fraction in the presence of hydrogen to produce a hydroprocessed effluent, and optionally separating hydrocracked naphtha or hydrocracked light naphtha from the hydroprocessed effluent;

wherein the deasphalting solvent comprises all or a portion of the light naphtha fraction obtained from separating the feedstock, and optionally all or a portion of a hydrocracked naphtha fraction or hydrocracked light naphtha fraction obtained from the hydroprocessed effluent.

20. The process as in claim 19, wherein the feedstock is separated by fractionating in a distillation unit or one or more flash unit(s) to separate the naphtha fraction or light naphtha fraction, a middle distillate fraction, and the residue fraction.

21. The process as in claim 20, wherein the middle distillate fraction is hydroprocessed together with the asphaltene reduced fraction.

22. The process as in claim 21, wherein the feedstock is crude oil and all or a portion of the hydroprocessed effluent is recovered as synthetic bottomless crude oil.

23. A system for upgrading a feedstock comprising:

a separation zone having an inlet in fluid communication with the feedstock, and at least a naphtha outlet and a residue outlet, wherein the separation zone is operable to separate the feedstock into at least a naphtha fraction or a light naphtha fraction that is discharged from the naphtha outlet, and a residue fraction that is discharged from the residue outlet;

an asphaltene separation zone having one or more inlets in fluid communication with a source of deasphalting solvent and with the residue outlet, one or more outlets for discharging an asphaltene reduced residue fraction and one or more outlets for discharging asphaltenes;

a hydroprocessing zone having an inlet in fluid communication with the asphaltene reduced residue fraction outlet and a hydroprocessed effluent outlet; and a hydroprocessed effluent fractionating zone having one or more inlets in fluid communication with the hydroprocessed effluent outlet, and having at least a hydrocracked naphtha outlet operable to discharge a hydrocracked naphtha fraction or a hydrocracked light naphtha fraction;

wherein the source of deasphalting solvent comprises the hydrocracked naphtha outlet of the fractioning zone.

24. A process for upgrading a feedstock comprising:

separating the feedstock into at least a naphtha fraction or a light naphtha fraction, and a residue fraction;

mixing the residue fraction, a deasphalting solvent and solid adsorbent material at a temperature and pressure that are below the critical pressure and temperature of the deasphalting solvent and for a time sufficient to adsorb contaminants contained in the residue fraction on the solid adsorbent material;

passing the residue fraction, the deasphalting solvent and the solid adsorbent material to a first separation vessel to separate a bottoms phase comprising asphaltenes and solid adsorbent material from a deasphalted oil phase including deasphalting solvent;

hydroprocessing all or a portion of the deasphalted oil phase including deasphalting solvent in the presence of hydrogen to produce a hydroprocessed effluent, and optionally separating hydrocracked naphtha or hydrocracked light naphtha from the hydroprocessed effluent; and contacting the bottoms phase with a stripping solvent to desorb the adsorbed contaminants and to recover regenerated solid adsorbent material, and optionally using at least a portion of the regenerated solid adsorbent material as the solid adsorbent material in the mixing step;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent, and wherein the stripping solvent comprises all or a portion of the naphtha fraction or the light naphtha fraction obtained from separating the feedstock, and/or all or a portion of the hydrocracked naphtha fraction or hydrocracked light naphtha fraction obtained from the hydroprocessed effluent.

25. A process for upgrading a feedstock comprising:

separating the feedstock into at least a naphtha fraction or a light naphtha fraction, and a residue fraction;

mixing the residue fraction and a deasphalting solvent in a first separation vessel at a temperature and pressure that are below the critical pressure and temperature of the deasphalting solvent;

discharging asphalt from the first separation vessel;

passing a mixture of deasphalted oil and deasphalting solvent stream from the first separation vessel, and solid adsorbent material, to a second separation vessel;

maintaining the mixture in the second separation vessel for a time sufficient for adsorption by the solid adsorbent material of contaminants in the deasphalted oil; and contacting a slurry of deasphalted oil and solid adsorbent material from the second separation vessel with a stripping solvent to desorb the adsorbed contaminants and to recover a deasphalted oil stream, to regenerate solid adsorbent material, and to discharge asphalt and process reject material that was adsorbed on the solid adsorbent material, and optionally using at least a portion of the regenerated solid adsorbent material as the solid adsorbent material in the second separation vessel;

hydroprocessing all or a portion of the deasphalted oil stream in the presence of hydrogen to produce a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent, and wherein the stripping solvent comprises all or a portion of the naphtha fraction or the light naphtha fraction obtained from separating the feedstock, and/or all or a portion of the hydrocracked naphtha fraction or hydrocracked light naphtha fraction obtained from the hydroprocessed effluent.

26. A process for upgrading a feedstock comprising:

separating the feedstock into at least a naphtha fraction or a light naphtha fraction, and a residue fraction;

removing asphaltenes from all or a portion of the residue fraction with an asphaltene separation zone by contacting with a deasphalting solvent to induce phase separation into an asphaltene reduced residue fraction and an asphaltene phase by solvent-flocculation of solid asphaltenes;

contacting the asphaltene reduced residue fraction obtained from the asphaltene separation zone with solid adsorbent material to produce an adsorbent-treated asphaltene reduced fraction, and stripping adsorbed contaminants from the solid adsorbent material with a stripping solvent;

hydroprocessing all or a portion of the adsorbent-treated asphaltene reduced residue fraction in the presence of hydrogen to produce a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent, and wherein the stripping solvent comprises all or a portion of the naphtha fraction or the light naphtha fraction obtained from separating the feedstock, and/or all or a portion of the hydrocracked naphtha fraction or hydrocracked light naphtha fraction obtained from the hydroprocessed effluent.

27. A process for upgrading a feedstock comprising:

separating the feedstock into at least a naphtha fraction or a light naphtha fraction, and a residue fraction;

contacting the residue fraction from the separating step with solid adsorbent material to produce an adsorbent-treated residue fraction, and stripping adsorbed contaminants from the solid adsorbent material with a stripping solvent;

removing asphaltenes from all or a portion of the adsorbent-treated residue fraction with an asphaltene separation zone by contacting with a deasphalting solvent to induce phase separation into an asphaltene reduced residue fraction and an asphaltene phase by solvent-flocculation of solid asphaltenes; and hydroprocessing all or a portion of the asphaltene reduced residue fraction in the presence of hydrogen to produce a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent, and wherein the stripping solvent comprises all or a portion of the naphtha fraction or the light naphtha fraction obtained from separating the feedstock, and/or all or a portion of the hydrocracked naphtha fraction or hydrocracked light naphtha fraction obtained from the hydroprocessed effluent.

28. A process for upgrading a feedstock comprising:

separating the feedstock into at least a naphtha fraction or a light naphtha fraction, and a residue fraction;

removing asphaltenes from all or a portion of the residue fraction with an asphaltene separation zone by contacting with a deasphalting solvent to induce phase separation into an asphaltene reduced residue fraction and an asphaltene phase by solvent-flocculation of solid asphaltenes; and hydroprocessing all or a portion of the asphaltene reduced residue fraction in the presence of hydrogen to produce a hydroprocessed effluent, and separating the hydroprocessed effluent into light gases, hydrocracked naphtha, hydrocracked diesel and unconverted oil;

wherein the deasphalting solvent comprises all or a portion of the hydrocracked naphtha, or all or a portion of a light naphtha fraction obtained from the hydrocracked naphtha, and optionally all or a portion of the naphtha fraction or the light naphtha fraction obtained from separating the feedstock.

29. A process for upgrading a feedstock comprising:

separating the feedstock into at least a naphtha fraction or a light naphtha fraction, and a residue fraction;

removing asphaltenes from all or a portion of the residue fraction with an asphaltene separation zone by contacting with a deasphalting solvent to induce phase separation into an asphaltene reduced residue fraction and an asphaltene phase by solvent-flocculation of solid asphaltenes;

discharging and gasifying all or a portion of the asphaltene phase to produce at least hydrogen; and hydroprocessing all or a portion of the asphaltene reduced residue fraction in the presence of hydrogen produced by gasifying all or a portion of the asphaltene phase, wherein hydrogen from gasifying is the only source of hydrogen for hydroprocessing when equilibrium is reached, wherein hydroprocessing produces a hydroprocessed effluent, and optionally separating hydrocracked naphtha or hydrocracked light naphtha from the hydroprocessed effluent;

wherein the deasphalting solvent comprises all or a portion of the naphtha fraction or the light naphtha fraction obtained from separating the feedstock, and/or all or a portion of a hydrocracked naphtha fraction or hydrocracked light naphtha fraction obtained from the hydroprocessed effluent.

* * * * *